US012628907B2

(12) United States Patent
Bidal

(10) Patent No.: US 12,628,907 B2
(45) Date of Patent: May 19, 2026

(54) GOLF SHOE WITH TRACTION ELEMENTS

(71) Applicant: Acushnet Company, Fairhaven, MA (US)

(72) Inventor: Jean-Marie Bidal, Marlborough, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/922,548

(22) Filed: Oct. 22, 2024

(65) Prior Publication Data

US 2025/0040659 A1 Feb. 6, 2025

Related U.S. Application Data

(63) Continuation-in-part of application No. 18/133,841, filed on Apr. 12, 2023, now Pat. No. 12,389,979.

(51) Int. Cl.
*A43B 13/22* (2006.01)
*A43B 5/00* (2022.01)

(52) U.S. Cl.
CPC ..... *A43B 13/22* (2013.01); *A43B 5/001* (2013.01)

(58) Field of Classification Search
CPC ..... A43C 15/16; A43C 15/161; A43C 15/162; A43B 13/223
USPC ..... D2/950–953, 962, 959
See application file for complete search history.

(56) References Cited

U.S. PATENT DOCUMENTS

| | | | | |
|---|---|---|---|---|
| 6,016,613 | A | 1/2000 | Campbell et al. | |
| 7,762,009 | B2 | 7/2010 | Gerber | |
| 9,883,716 | B2 | 2/2018 | Jones | |
| D891,063 | S * | 7/2020 | Shi | D2/947 |
| D929,095 | S * | 8/2021 | Cass | D2/947 |
| 11,206,897 | B2 | 12/2021 | Bell et al. | |
| 11,425,959 | B2 * | 8/2022 | Bidal | A43B 13/122 |
| 11,751,639 | B2 | 9/2023 | Ekstrom et al. | |
| 11,974,632 | B2 | 5/2024 | Bidal | |
| D1,037,636 | S * | 8/2024 | Tran | D2/951 |
| D1,048,683 | S * | 10/2024 | Hartwell | D2/947 |
| 2009/0272008 | A1 * | 11/2009 | Nomi | A43B 13/16 36/103 |
| 2013/0326908 | A1 * | 12/2013 | Grott | A43C 15/16 36/62 |
| 2018/0242688 | A1 | 8/2018 | Madore | |

(Continued)

FOREIGN PATENT DOCUMENTS

| | | |
|---|---|---|
| EP | 1234516 | 8/2002 |
| WO | 2014167713 | 10/2014 |

*Primary Examiner* — Ted Kavanaugh

(57) ABSTRACT

A golf shoe with a plurality of traction elements positioned around a central forefoot region and a central rearfoot region of the outsole of the golf shoe. The plurality of traction elements comprises: (i) a first set of traction elements arranged in a first outsole zone along a perimeter or edge of a medial or lateral forefoot region of the golf shoe, (ii) a second set of traction elements arranged in a second outsole zone along a perimeter or edge of a lateral or medial rearfoot region of the golf shoe, and (iii) a third set of traction elements arranged along a third outsole zone extending diagonally across a midfoot region of the golf shoe between the medial or lateral forefoot region and the lateral or medial rearfoot region. The third outsole zone includes a plurality of tracks extending across the third outsole zone.

20 Claims, 55 Drawing Sheets

(56) References Cited

U.S. PATENT DOCUMENTS

| | | | | |
|---|---|---|---|---|
| 2020/0315285 | A1 | 10/2020 | Winskowicz et al. | |
| 2021/0244136 | A1* | 8/2021 | Fedderly | A43C 15/165 |
| 2024/0172839 | A1* | 5/2024 | Couture | A43B 13/122 |

* cited by examiner

OFF-COURSE

GOLF SHOE WITH TRACTION ELEMENTS

CROSS REFERENCE

This application is a Continuation-in-Part (CIP) of U.S. patent application Ser. No. 18/133,841 filed on Apr. 12, 2023, which application is incorporated herein by reference in its entirety for all purposes.

BACKGROUND

The sport of golf can involve a variety of actions that a subject (e.g., a golfer) can perform, such as swinging a golf club, walking a golf course, and/or crouching down to line up a putt. The equipment used to play golf can affect how well a golfer performs golf-related actions or movements.

Golf shoes are one example of a piece of equipment that can affect performance. When a golfer executes a golf-related action, there are a number of forces that can be exerted on the sole assembly of the golf shoe and/or the ground surface under the golf shoe. In some cases, the forces exerted during the golf-related action can cause the shoe to move relative to the ground surface in a manner that is unintentional or undesired, which can negatively impact performance. To minimize undesired or unintentional movements of the shoe, some golf shoes may utilize traction elements that physically or mechanically engage with the ground surface.

SUMMARY

Recognized herein are various shortcomings and disadvantages of conventional shoes and traction element designs and configurations for golf shoes. Many conventional shoes utilize traction elements that are designed or configured to minimize slip and fall scenarios (e.g., by maximizing coefficients of friction between the traction elements and various off course ground surfaces). However, conventional traction element designs and configurations that attempt to maximize coefficients of friction solely to mitigate slips and falls do not always provide the optimal set of traction properties desired or needed to elevate the golf games of both casual and dedicated golfers alike.

The present disclosure addresses the abovementioned shortcomings of shoes with conventional traction element designs and configurations by providing various embodiments of golf shoes with traction elements that optimize shoe traction stiffness for on course ground surfaces. The golf shoes of the present disclosure may utilize traction elements that are (1) optimally sized and shaped and/or (2) collectively arranged in an optimal layout on the outsole of the shoe in order to minimize the amount of movement of the golf shoe relative to the ground surface during a golf-related action or movement. The size, shape, and/or arrangement (e.g., position and/or orientation) of each of the traction elements may be optimized based on (i) the biomechanical characteristics of a subject's golf swing and/or (ii) the anatomical or physiological characteristics of the subject's body. The traction elements may be individually and collectively configured to provide an optimal traction stiffness to different selective regions of the shoe, which can minimize the movement of the shoe relative to an on course ground surface during a golf-related action or movement, and ultimately help to maximize (i) consistency, e.g., by producing tighter ball dispersions and/or (ii) performance, e.g., by enabling longer carry distances.

The traction element designs and configurations described herein may provide numerous benefits in addition to maximizing consistency and performance. For instance, the traction elements may be designed and configured to preserve and minimize damage to on course surfaces. As described in greater detail below, the size and/or shape of the individual traction elements may be optimized to preserve a quality or characteristic of an on course surface across a greater number of golf-related actions or movements, and over a longer period of time compared to traditional or conventional golf shoe traction elements. The quality or characteristic may relate to a ball roll distance for a golf ball traversing the on course surface, or a smoothness or a roughness of the on course surface. Preserving the on course surfaces may help to minimize the maintenance needed to keep the state of the on course surface consistent over time and as more rounds are played. The traction elements of the present disclosure may reduce the need for routine maintenance, which can be both time and labor intensive, and can ensure that the conditions of the on course surfaces remain within an acceptable tolerance or threshold during, between, or after a golf round involving one or more golf-related movements, or actions involving a physical or mechanical interaction between the on course surfaces and the presently disclosed traction elements.

In a related aspect, the present disclosure provides various embodiments of golf shoes with adaptive traction elements that can be designed or configured for both on course and off course applications. Unlike the traction elements of traditional golf shoes, which are generally uncomfortable or impractical for use off course, the adaptive traction element designs and configurations referenced herein may provide a flexible solution for both on course and off course traction by utilizing a traction element that can adapt or deform to provide (1) a first horizontal and/or vertical cross-sectional area or dimension that is optimized for an on course surface and (2) a second horizontal and/or vertical cross-sectional area or dimension that is optimized for an off course surface. The adaptability of the presently disclosed traction elements may allow a subject to wear a single pair of golf shoes that is comfortable both on and off a golf course, without sacrificing comfort, fit, or performance on a variety of different types of ground surfaces.

The present disclosure also provides various examples of traction element configurations and arrangements to enhance or fine tune the regional traction characteristics of the golf shoe (e.g., along a perimeter or edge of the outsole of the golf shoe). The optimal placement of both directional and omni-directional traction elements in accordance with the present disclosure can provide golf shoes with a level of customizability and flexibility with respect to regional traction performance that cannot be practically realized using other conventional configurations or arrangements of traction elements, which may not provide the full range of traction performance characteristics needed for a high performance golf shoe.

In some embodiments, the traction elements described herein may be configured to optimally direct loads exerted on the sole assembly during golf-related movements to select locations or regions on the ground surface, and effectively minimize a movement of the shoe relative to the ground during a golf-related movement in order to control, guide, and/or manage (i) a movement of a subject's feet during the golf-related movement, (ii) a distribution of one or more forces across the shoe to facilitate or execute the golf-related movement, and/or (iii) a direction or a magnitude of the one or more forces exerted on (a) the shoe or any components thereof or (b) a ground surface underneath the shoe. In some embodiments, the traction elements may be configured or arranged based on (1) the unique anatomical or biomechanical characteristics of the subject wearing the shoe and/or (2) the unique properties or characteristics of the subject's swing. In some embodiments, the traction elements may be configured or arranged in a manner that is optimal for a particular subject, based on his or her swing type, swing speed, anatomy, or biomechanical characteristics.

In some embodiments, the traction elements may be configured to optimally direct loads and minimize a movement of the shoe relative to the ground during a golf-related action even if the subject executes the action in a manner that is sub-optimal for the subject given his or her swing type, swing speed, anatomy, or biomechanical characteristics. In some cases, a sub-optimal execution of the golf-related action may involve an actual movement by the subject that deviates from an optimal movement that can provide (i) maximum consistency, e.g., tighter ball dispersions and/or (ii) maximum performance, e.g., longer carry distances. The actual movement or the optimal movement may include, for example, a movement of the subject's arms or wrists, a rotation of a subject's body (hips, waist, etc.), a change in weight distribution across the subject's feet, or a pivoting of the subject's feet during a golf swing. In some cases, a sub-optimal execution of the golf-related action may involve a deviation between an actual posture of the subject and an optimal posture that can provide (i) maximum consistency and/or (ii) maximum performance. The actual posture or the optimal posture may include, for example, a position or an orientation of the subject's feet relative to a golf ball or a ground surface, and/or a position or an orientation of a first body part of the subject relative to a second body part of the subject. In some non-limiting embodiments, the sub-optimal execution of the golf-related action may be associated with a sub-optimal loading profile on the midsole of the shoe or a ground surface underneath the shoe. In some cases, the sub-optimal loading profile may involve a sub-optimal application or exertion of pressure on the midsole or the ground surface before, during, and/or after a golf-related movement. In some cases, the sub-optimal loading profile may involve a sub-optimal change in the application or exertion of pressure on the ground surface or various portions of the midsole over a period of time. In some cases, the sub-optimal loading profile may involve a sub-optimal application or exertion of pressure on one or more portions or regions of the midsole before, during, and/or after a golf-related movement. The sub-optimal application or exertion of pressure may involve the application or exertion of one or more forces (either at various regions of the midsole or at various time points over a select period of time) with a magnitude or a direction that deviates from an optimal magnitude or direction that can translate to or facilitate a golf-related movement with (i) maximum consistency and/or (ii) maximum performance.

In some embodiments, the traction elements disclosed herein may be configured to optimally direct loads and control a movement of the shoe relative to the ground surface in a predictable manner in order to assist with a subject's golf swing, regardless of any deviations between the actual movements or posture of the subject and the movements or posture which may be considered optimal for the subject given his or her swing type, swing speed, anatomy, or biomechanical characteristics. In some embodiments, the traction elements may be configured to optimally direct loads and control a movement of the shoe relative to the ground surface for multiple subjects in order to assist with their golf swings, regardless of any differences in or variations between each subject's swing type, swing speed, anatomy, biomechanical characteristics, or personal preferences for golf-related movements or postures.

In any of the embodiments described herein, the traction element designs and configurations may provide different traction characteristics in or along different zones or regions of the outsole. The traction characteristics may be associated with, for example, a traction stiffness of the various zones or regions, or a directional bias of one or more traction elements or a set of traction elements. In some cases, the traction characteristics for the different zones or regions can be optimized based on a subject's bodily characteristics (e.g., weight, stature, foot shape or profile, center of gravity or center of mass, etc.) and/or the subject's preferences for comfort, fit, and/or performance. In some cases, the traction characteristics for the different zones or regions can be optimized for a variety or a range of different subjects with different bodily characteristics or different preferences for comfort, fit, and/or performance.

In any of the embodiments described herein, the traction element designs and configurations may provide or impart a desired set of properties or characteristics to the shoe. The desired set of properties or characteristics may include, for example, a traction stiffness of a particular zone or region, or a directional bias of one or more traction elements. In some non-limiting embodiments, the traction elements may be directionally biased in various regions of the outsole. In some non-limiting embodiments, the traction elements may be biased in different directions. In some non-limiting embodiments, the traction elements may be omni-directional or directionally neutral (i.e., may not be biased in a particular direction, or may be biased equally in two or more different directions).

In any of the embodiments described herein, the traction element designs and configurations may assist with a golfer's specific and/or unique swing characteristics and effectively (1) realign a golfer's swing with an optimal swing path or trajectory, (2) align a golfer's body or movements with an optimal posture and/or an optimal set of movements in or along one or more optimal axes or planes in three-dimensional space, and/or (3) compensate for any deviations or variations between (a) the golfer's actual posture or movements and (b) the optimal posture or the optimal set of movements for the golfer. In any of the embodiments described herein, the traction elements designs and configurations may be implemented to reduce the occurrence or likelihood of any undesirable shot trajectories (e.g., pull, push, hook, and/or slice) that may result from the actual movements or posture of a particular golfer (whether preferred or unintentional).

In one aspect, the present disclosure provides a golf shoe comprising an upper; a sole assembly attached to the upper, the sole assembly comprising an outsole; and a plurality of traction elements positioned around a central region of the outsole. In some embodiments, the plurality of traction elements comprise: (i) a first set of traction elements arranged along a perimeter or edge of the shoe in a first spatial configuration corresponding to a shape or profile of the perimeter or edge of the shoe, and (ii) a second set of traction elements nested between the first set of traction elements and a third set of traction elements. In some embodiments, the second set of traction elements is arranged in a second spatial configuration corresponding to a shape or profile of the first spatial configuration.

In some embodiments, the first spatial configuration defines a first enclosed shape around the central region of the outsole, and the second spatial configuration defines a second enclosed shape around the central region of the outsole. In some embodiments, the second enclosed shape is nested within the first enclosed shape.

In some embodiments, the first and second sets of traction elements comprise (i) one or more directional traction elements and (ii) one or more omni-directional traction elements. In some embodiments, the one or more directional traction elements are positioned on a medial side or a lateral side of the outsole. In some embodiments, the one or more omni-directional traction elements are positioned on an anterior side or a posterior side of the outsole. In some embodiments, the one or more omni-directional traction elements comprise a set of directional traction elements that collectively provide the shoe with an omni-directional traction property or response.

In some embodiments, the first and second sets of traction elements include (i) one or more traction elements arranged along an anterior side and a posterior side of the outsole and (ii) one or more traction elements arranged along a medial side and a lateral side of the outsole. In some embodiments, the anterior or posterior side of the outsole has a greater traction element density than the medial or lateral side of the outsole.

In some embodiments, the first set of traction elements and the second set of traction elements each comprise a series of spaced apart traction elements respectively arranged in the first or second spatial configuration. In some embodiments, the first and second sets of traction elements are staggered relative to each other in a non-channeling and non-trenching configuration.

In some embodiments, the plurality of traction elements comprise two or more traction elements having different sizes and/or different shapes. In some embodiments, the plurality of traction elements comprise two or more traction elements oriented in different directions. In some embodiments, a size, a shape, an orientation, or a directional bias of the plurality of traction elements changes or varies along a medial or lateral side of the shoe. In some embodiments, a size, a shape, an orientation, or a directional bias of the plurality of traction elements gradually changes or varies between (i) a medial or lateral side of the shoe and (ii) an anterior or posterior side of the shoe.

In some embodiments, the plurality of traction elements are arranged around the central region of the outsole to expose an interior region or component of the sole assembly. In some embodiments, the interior region or component of the sole assembly comprises a midsole of the golf shoe. In some embodiments, the interior region or component of the sole assembly comprises a functional insert that is positioned (i) within the midsole or (ii) between the midsole and the outsole.

In some embodiments, the plurality of traction elements comprise one or more adaptive traction elements arranged on the outsole. In some embodiments, the adaptive traction elements comprise a pointed end configured to (i) penetrate a first type of ground surface to provide grip or traction and (ii) flatten towards the outsole during contact with a second type of ground surface that is harder than the first type of ground surface. In some embodiments, the first type of ground surface comprises grass, turf, dirt, or sand. In some embodiments, the second type of ground surface comprises cement, concrete, asphalt, tile, or wood. In some embodiments, the one or more adaptive traction elements have a half moon shape or a fanged profile.

In some embodiments, the outsole comprises one or more openings. In some embodiments, the one or more adaptive traction elements are configured to move through the one or more openings in order to flatten against the outsole of the golf shoe.

In another aspect, the present disclosure provides a golf shoe optimized for on course and/or off course surfaces. In some embodiments, the golf shoe may comprise an upper; a sole assembly attached to the upper, the sole assembly comprising an outsole; and a plurality of traction elements arranged on the outsole to enhance shoe traction, grip, and stability on a plurality of different surface types. In some embodiments, the traction elements have a depth to height ratio of about 5:3. In some embodiments, the traction elements comprise a first feature for mechanically interlocking with a deformable ground surface. In some embodiments, the first feature comprises a first material with a modulus of elasticity ranging from about 1 megapascal (MPa) to at least about 1 gigapascal (GPa). In some embodiments, the traction elements may comprise a second feature comprising a second material for frictionally engaging with the deformable ground surface.

In some embodiments, the traction elements provide a traction stiffness ranging from about 60 N/mm to at least about 80 N/mm in a medial-lateral direction on the deformable ground surface. In some embodiments, the traction elements are configured to provide a traction stiffness ranging from about 80 N/mm to at least about 120 N/mm in an antero-posterior direction on the deformable ground surface. In some embodiments, the deformable ground surface may comprise an on course ground surface which includes at least one of grass, turf, soil, dirt, or sand.

In some embodiments, a coefficient of friction between the traction elements and an off course ground surface is at least about 0.4 to about 0.6. In some embodiments, the off course ground surface may comprise cement, concrete, asphalt, tile, or wood.

In some embodiments, the first or second feature comprises a textured surface, an elongate rib, a channel, a ridge, a line, a depression, a fin, or a blade. In some embodiments, the first feature and/or the second feature is positioned and oriented along a direction of one or more ground reaction forces exerted on the golf shoe. In some embodiments, the one or more ground reaction forces are associated with a golf-related action or movement.

In some embodiments, the first or second feature comprises one or more particles configured to enhance an abrasion resistance of the traction elements for off course wear. In some embodiments, the one or more particles may comprise carbon, titanium, diamond, silicon, or glass. In some embodiments, the first or second feature comprises one or more nanoparticles configured to enhance a frictional engagement between the traction elements and the deformable ground surface. In some embodiments, the one or more nanoparticles have a particle size of at most about 100 nanometers (nm).

In some embodiments, a first subset of the traction elements comprises the first feature, and a second subset of the traction elements comprises the second feature. In some embodiments, the first and second subsets of traction elements are interspersed along the outsole. In some embodiments, the first subset of traction elements has a greater height or aspect ratio than the second subset of traction elements. In some embodiments, the second subset of traction elements corresponds to a base surface of the outsole. In some embodiments, the second subset of traction elements is disposed on or provided along the base surface of the outsole.

In some embodiments, the first feature comprises a core of the traction element, and the second feature comprises a material coating on or around the core. In some embodiments, the first feature comprises a body of the traction elements, and the second feature comprises a surface of the traction elements.

In some embodiments, the first material has a greater hardness or modulus of elasticity than the second material. In some embodiments, a coefficient of friction between the second material and the deformable ground surface is greater than a coefficient of friction between the first material and the deformable ground surface.

In some embodiments, the first or second material comprises a rubber material. In some embodiments, the first or second material comprises a thermoplastic elastomer or a thermoplastic polyurethane material.

In some embodiments, the traction elements may have a pyramidal or quadrilateral frustrum shape. In some embodiments, the traction elements may have a taper ranging from about ⅙ to about ⅔.

In another aspect, the present disclosure provides a golf shoe optimized to preserve on course and/or off course surfaces. In some embodiments, the golf shoe may comprise an upper; a sole assembly attached to the upper, the sole assembly comprising an outsole; and a plurality of traction elements arranged on the outsole to enhance shoe traction, grip, and stability on a plurality of different surface types. In some embodiments, the traction elements are configured to reduce or minimize an amount of damage to the first surface when a subject wearing the golf shoe executes a golf-related movement on the first surface.

In some embodiments, the golf-related movement includes a golf swing. In some embodiments, the golf-related movement includes walking, running, or crouching. In some embodiments, the golf-related movement includes a translational motion and/or a rotational motion of the traction elements relative to the first surface. In some embodiments, the golf-related movement involves one or more ground reaction forces ranging from at least about 100 Newtons (N) to at least about 1000 N.

In some embodiments, the traction elements are configured to preserve a quality or characteristic of the first surface across a plurality of golf-related movements executed over a period of time. In some embodiments, the quality or characteristic of the first surface includes a ball roll distance for a golf ball traversing the first surface. In some embodiments, the quality or characteristic of the first surface includes a smoothness or a roughness of the first surface. In some embodiments, the traction elements provide the golf shoe with a surface preservation metric ranging from about 0% to about 100%.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples and embodiments of the present disclosure are described and schematically illustrated with reference to the following figures.

DETAILED DESCRIPTION

Figure 1:
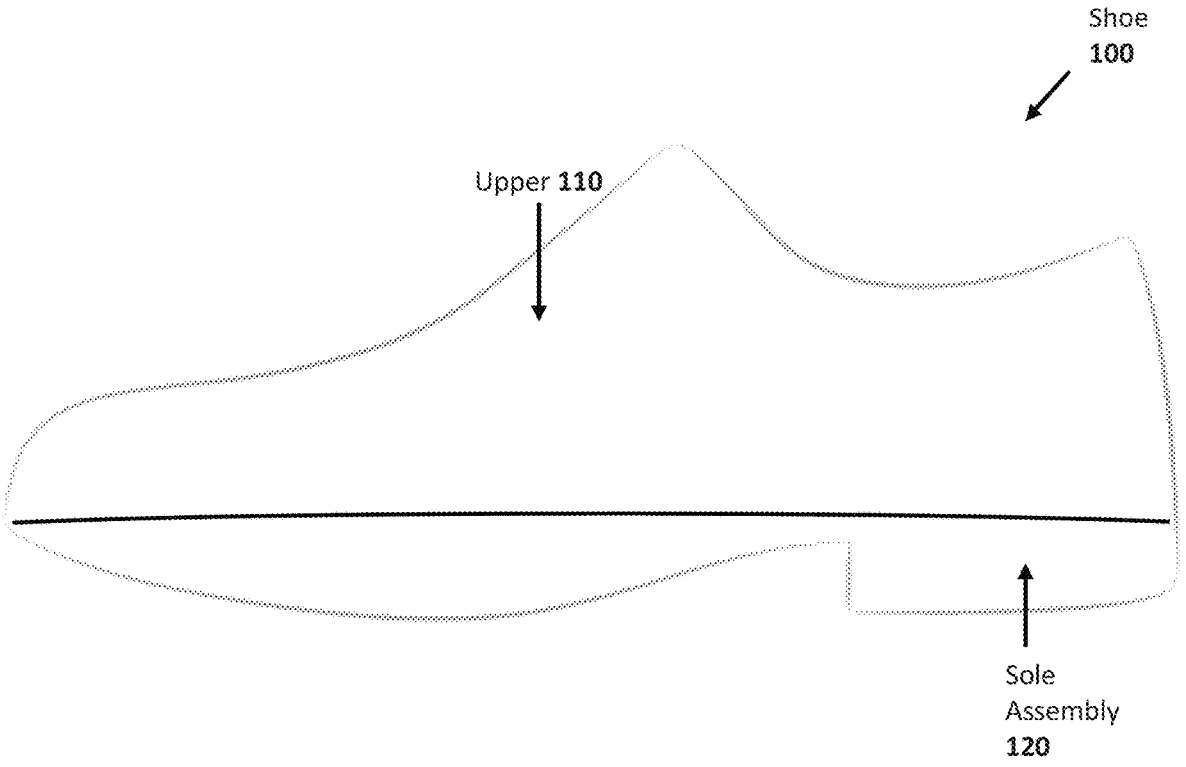
FIG. 1 schematically illustrates an exemplary golf shoe, in accordance with some embodiments.

The present disclosure will now be described more fully in reference to the accompanying figures, in which various non-limiting embodiments are shown. However, this disclosure should not be construed as limited to the embodiments set forth herein. In the drawings, like numbers refer to like elements throughout. Thicknesses and dimensions of some components may be exaggerated for clarity. The views shown in the accompanying figures may correspond to a right shoe, and it is understood that in some cases, the components for a left shoe can be mirror images of the right shoe. It also should be understood that the shoe can be made in various sizes and thus the size of the components or features (e.g., the traction elements) of the shoe may be adjusted depending on the shoe size.

The terminology used herein is for the purpose of describing various embodiments only and is not intended to be limiting. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element (with or without any intervening elements). In contrast, when an element is referred to as being "directly attached, "directly coupled" or "directly connected" to another element, there may not or need not be any intervening elements.

It is noted that any one or more aspects or features described with respect to one embodiment may be incorporated in a different embodiment. That is, all embodiments and/or features of any embodiment can be combined in any way and/or in any order. Applicant reserves the right to modify any originally filed claim or file any new claim(s) accordingly, including the right to amend any originally filed claim to depend from and/or incorporate any feature of any other claim although not originally claimed in that manner. The various aspects and features of the present disclosure are explained in further detail in the specification set forth below.

Overview

From a performance standpoint, a golf shoe needs to provide sufficient traction so that a subject wearing the golf shoe can perform various different golf-specific actions (e.g., walking a golf course, addressing a golf ball, swinging a golf club, and/or crouching down to line up a shot) on a variety of different surfaces and/or in a variety of different climates or environmental conditions. Traction is especially important in golf because many golf-related movements can involve significant pressure and/or torsion being applied to the sole assembly through a complex series of biomechanical events. In some cases, the pressure and torsion applied can cause a shoe to move in an unintentional or undesired manner relative to the ground surface, which can compromise a subject's balance, stability, posture, or weight distribution and negatively impact performance or consistency.

In some cases, the traction elements described herein may be optimized, both in form and function, to effectively minimize an amount of shoe or foot movement or displacement during a golf-related action (e.g., a golf swing). Minimizing the movement of the shoe relative to an on course ground surface can help casual and dedicated golfers to maximize (i) consistency, e.g., by producing tighter ball dispersions and/or (ii) performance, e.g., by enabling longer carry distances.

In some cases, the traction elements described herein may be arranged to enhance or fine tune the regional traction characteristics of the golf shoe along a perimeter or edge of the outsole of the golf shoe. The optimal placement of both directional and omni-directional traction elements can provide casual and performance golf shoes with regional traction performance that cannot be practically realized using other conventional configurations or arrangements of traction elements.

In some cases, the traction elements of the present disclosure can be designed or configured for both on course and off course applications. The adaptability of the traction elements may allow a subject to wear a single pair of golf shoes that is comfortable both on and off a golf course, without sacrificing comfort, fit, or performance on a variety of different types of ground surfaces.

In some cases, the presently disclosed traction elements may be designed and configured to preserve or minimize damage to on course surfaces. In some cases, the size and/or shape of the individual traction elements may be optimized to preserve a quality or characteristic of an on course surface across a greater number of golf-related movements and over a longer period of time compared to traditional or conventional golf shoe traction elements.

Golf Shoe

In an aspect, the present disclosure provides a golf shoe. The golf shoe may comprise an article of footwear (e.g., a shoe) that can be worn by a subject to aid in a physical activity such as golf, or any other physical activity involving one or more actions or movements that can be used in the sport of golf. The golf shoe may comprise one or more traction elements configured to enhance shoe traction, grip, and stability on a plurality of different surface types, as described in greater detail below.

The golf shoe may be worn by a subject. The subject may be, for example, an athlete or a golf player. When worn by the subject, the golf shoe may provide an optimal balance of comfort and control that allows the subject to focus on his or her game and maximize performance. The golf shoe may be sized, shaped, and configured to support the subject's foot and/or control a movement of the subject's foot during a golf-related movement to enhance (i) comfort, (ii) stability, and/or (iii) the subject's stance, swing, stability, or overall performance (e.g., accuracy or precision).

FIG. 1 depicts an exemplary golf shoe 100, also referred to herein generally as a shoe 100. In some embodiments, the shoe 100 may comprise a shoe upper 110 and a sole assembly 120. In some cases, the upper 110 may include an insole. The insole may comprise an insole component such as an insole footbed and/or an insole board. In some cases, the sole assembly 120 may include a midsole and/or an outsole. In some embodiments, the sole assembly 120 may be connected to the upper 110.

Foot Subregions

In any of the embodiments described herein, the upper 110 and/or the sole assembly 120 and/or any components thereof (e.g., the insole footbed, the insole board, the midsole, and/or the outsole of the shoe) may comprise a forefoot region, a midfoot region, and a rearfoot region. Each of the forefoot region, the midfoot region, and the rearfoot region may correspond to a respective forefoot, midfoot, and rearfoot anatomy of a subject's foot. In general, the anatomy of a human foot can be divided into three bony regions. A rearfoot region of the foot may include the ankle (talus) and heel (calcaneus) bones. A midfoot region of the foot may include the cuboid, cuneiform, and navicular bones that form the longitudinal arch of the foot. The forefoot region of the foot may include the metatarsals and the toes. The shoe, and accordingly, the components of the upper and/or the sole assembly (e.g., the insole footbed, the insole board, the midsole, and/or the outsole), may comprise a rearfoot region corresponding to the rearfoot and/or heel area, a midfoot region that corresponds to the midfoot, and a forefoot region corresponding to the forefoot and/or toe area. In some cases, the rearfoot region (and heel area) can correspond to a posterior end of the shoe. In some cases, the forefoot area, including the toe area, can correspond to an anterior end of the shoe.

In addition to having a rearfoot region, midfoot region, and forefoot region, the shoe, and accordingly, the components of the upper and/or the sole assembly (e.g., the insole footbed, the insole board, the midsole, and/or the outsole), may also have a medial side and a lateral side that are opposite one another. The medial side may generally correspond to an inside area of the wearer's foot and a surface that faces towards the wearer's other foot. The lateral side may generally correspond to an outside area of the wearer's foot and a surface that faces away from the wearer's other foot. The lateral side and the medial side may extend through each of the rearfoot area, the midfoot area, and the forefoot area. In some cases, the medial side and a lateral side may extend around the periphery or perimeter of the shoe.

Figure 2:
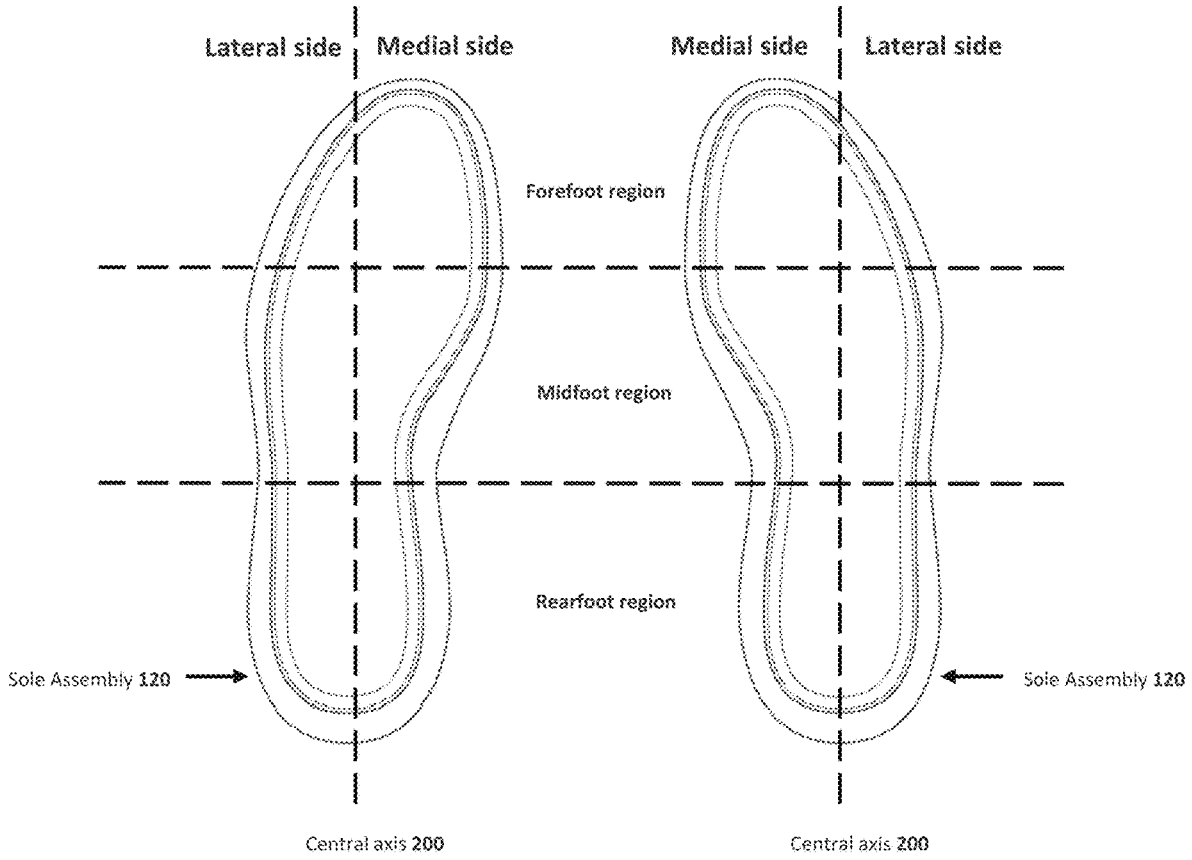
FIG. 2 schematically illustrates an exemplary golf shoe comprising a forefoot region, a midfoot region, and a rearfoot region, in accordance with some embodiments.

FIG. 2 illustrates the various regions of an exemplary left and right sole assembly 120. The sole assembly 120 may comprise a forefoot region, a midfoot region, and/or a rearfoot region. The forefoot, midfoot, and rearfoot regions may extend laterally along a first dimension (e.g., a width) of the sole assembly 120. The forefoot, midfoot, and rearfoot regions may extend laterally between a medial side and a lateral side of the sole assembly, as described above. The forefoot, midfoot, and rearfoot regions may extend laterally along different portions or sections of a second dimension (e.g., a length) of the sole assembly 120. The forefoot, midfoot, and rearfoot regions may extend between a posterior end and an anterior end of the sole assembly 120, as described above.

Figure 3A:
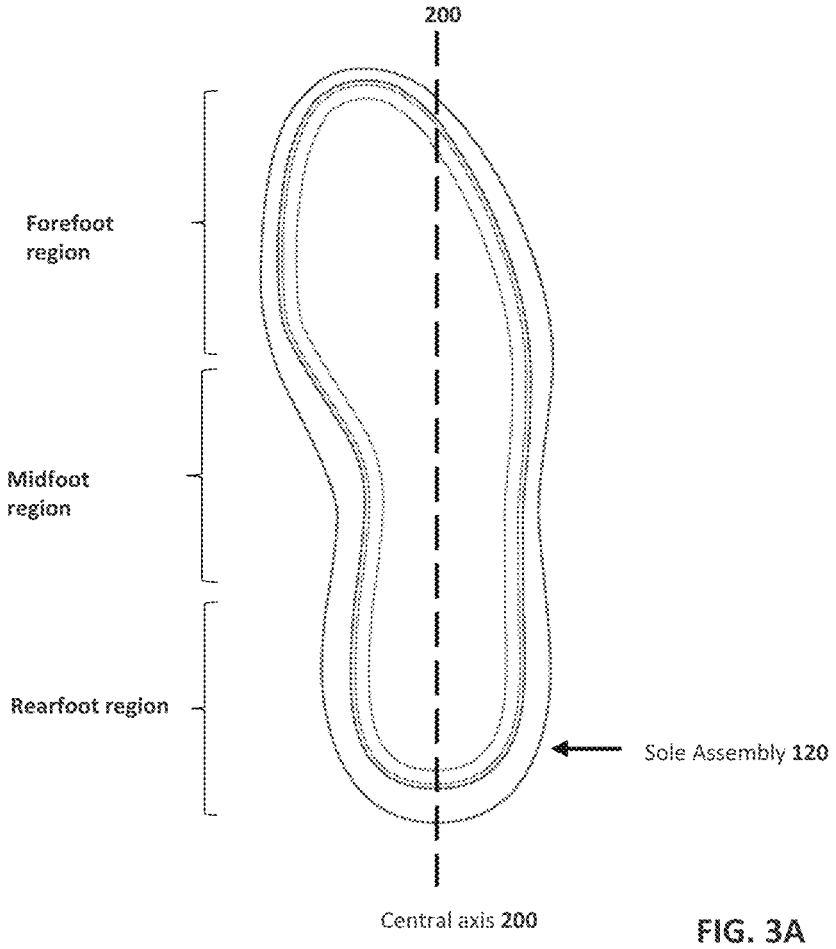
FIGS. 3A and 3B schematically illustrate a central axis extending through the forefoot, midfoot, and/or rearfoot regions of an exemplary golf shoe to divide the golf shoe into a medial side and a lateral side, in accordance with some embodiments.
Figure 3B:
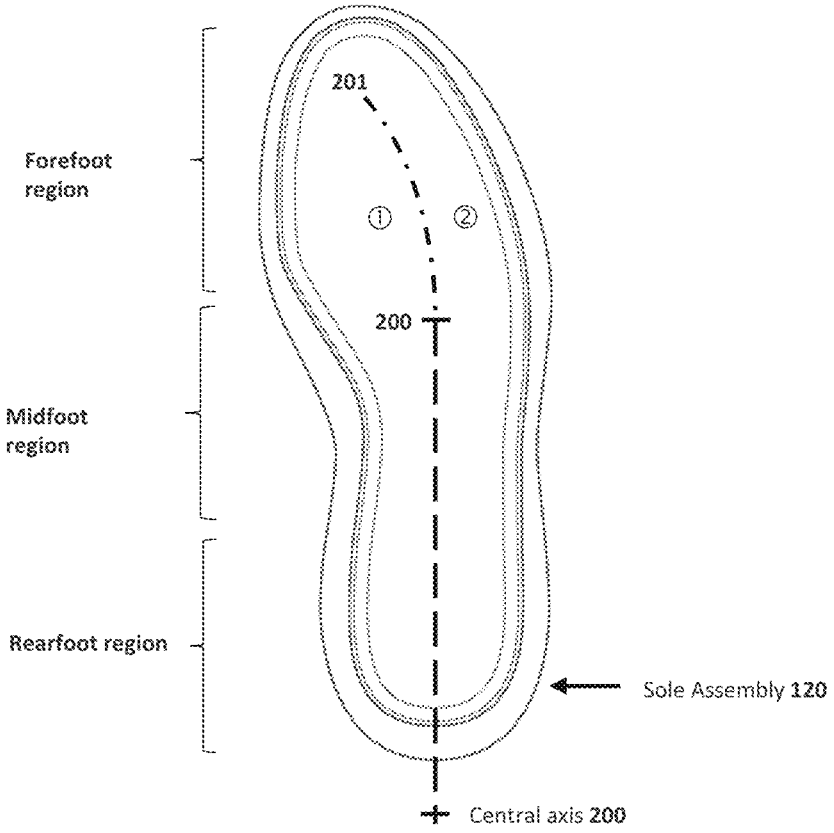

FIGS. 2, 3A, and 3B schematically illustrate a central axis 200 of the sole assembly 120. The central axis 200 may extend from a rear most portion of the rearfoot region of the sole assembly 120 towards the midfoot and/or forefoot regions of the sole assembly 120. In some embodiments, the central axis 200 may extend in a direction that is perpendicular or normal to an axis tangential to the rear most portion of the rearfoot region of the sole assembly 120.

Referring to FIG. 3A, in some embodiments, a portion of the central axis 200 (e.g., the portion extending through at least the rearfoot and/or midfoot regions of the sole assembly 120) may divide or bisect the sole assembly 120 into a medial side and a lateral side as described above. In some cases, a portion of the central axis 200 (e.g., the portion extending from the midfoot region of the sole assembly 120 to the forefoot region of the sole assembly 120) may not precisely divide or bisect the sole assembly 120 into a medial side and a lateral side. As shown in FIG. 3B, in some embodiments, the medial side ① and lateral side ② of the forefoot region of the sole assembly may be divided along a curved axis 201 that deviates from the central axis 200. Any references herein to a medial side or a lateral side of an insole, a midsole, or an outsole may contemplate a delineation of the medial and lateral sides of the insole footbed, the insole board, the midsole, or the outsole along the central axis 200 and/or the curved axis 201 as shown in FIGS. 3A and 3B.

Upper

In some embodiments, the golf shoe 100 may comprise an upper 110. In some cases, the upper 110 may comprise a vamp for covering at least a forefoot region of a subject's foot. In some cases, the upper 110 may comprise a quarter for covering and/or supporting one or more side or rear portions of a subject's foot (e.g., the area adjacent to, surrounding, and/or below the Achilles tendon, the posterior of the heel, and/or the talus and calcaneus bones).

In some embodiments, the heel region of the quarter may comprise a heel cup. In some cases, the heel cup may comprise a molded heel cup. In some embodiments, at least a portion of the quarter may form a part of the molded heel cup. In some embodiments, the quarter may comprise a plurality of layers that can be molded together to form the heel cup.

In some embodiments, the vamp and the quarter may comprise separate pieces of material that are connected or fused to each other mechanically, chemically, thermally, or adhesively. In some cases, the upper material may comprise various materials that are stitched or bonded together to form an upper structure.

In some embodiments, the upper 110 may comprise a continuous piece of material for the vamp and quarter. In some cases, the continuous piece of material may comprise a single material comprising a plurality of regions each having different material properties. In other cases, the continuous piece of material may comprise a plurality of materials having different material properties. The material properties associated with the plurality of regions or the plurality of materials may include, for example, density, porosity, water absorbency/repellence, strength, flexibility, elasticity, softness, durability, chemical resistance, thermal conductivity, and the like.

In some cases, the upper 110 may comprise, for example, natural leather, synthetic leather, knits, non-woven materials, natural fabrics, and/or synthetic fabrics. In other cases, the upper 110 may comprise breathable mesh and/or synthetic textile fabrics made from materials such as nylons, polyesters, polyolefins, polyurethanes, rubbers, foams, or any combinations thereof. The material of the upper 110 may be selected and/or optimized based on desired properties such as breathability, durability, flexibility, comfort, and/or water resistance.

In some embodiments, the shoe 100 may be waterproof. In some cases, at least a forefoot, midfoot, and/or rearfoot area of the upper may be constructed of one or more materials or layers (e.g., membranes) having water resistant properties. Additional features (e.g., non-porous or semi-porous membranes that permit a selective movement or passage of moisture) may be applied when fabricating the shoe 100 to provide additional waterproofing capabilities.

In some embodiments, the upper 110 may comprise an instep region with an opening for inserting a subject's foot. In some cases, the instep region may include a tongue member for covering an upper portion of a subject's foot.

In some embodiments, the upper 110 may comprise a heel collar extending around at least a portion of the opening. In some embodiments, the heel collar may be configured to provide enhanced comfort and fit around the subject's foot or leg (e.g., the ankle region of the subject's foot or leg).

In some embodiments, the upper 110 may comprise an insole component (e.g., an insole footbed or an insole board). In some cases, the insole component may be designed to provide support for a subject's foot (e.g., as the subject exerts a force on the insole while walking, running, kneeling, squatting, or executing a swing). The insole component may be flexible, semi-rigid, or rigid. In some cases, the insole component may be a removable insert that can be positioned within the shoe 100. In some examples, the insole component can be worn inside the shoe 100 and may be designed to provide cushioning or support for the subject wearing the shoe 100.

In some embodiments, the forefoot region of the upper 110 may comprise an eye stay that may be attached to the vamp. In some cases, the eye stay may cover at least a portion of the tongue member. In some cases, the eye stay may comprise one or more eyelets through which one or more laces can be threaded.

In some embodiments, a tightening system can be used for tightening the shoe around the contour of the foot. For example, laces of various types of materials (e.g., natural or synthetic fibers, metal cable) may be included in the tightening system. In some cases, the shoe may utilize a cable-based tightening assembly comprising a dial, spool, and housing and locking mechanism for locking the cable in place.

Sole Assembly

In some embodiments, the golf shoe 100 may comprise a sole assembly 120. The sole assembly 120 may comprise a midsole and/or an outsole. In some cases, the sole assembly 120 may be connected to the upper 110.

Midsole

In some embodiments, the sole assembly 120 may comprise a midsole. The midsole may comprise a relatively lightweight material configured to provide cushioning and/or support to the shoe 100. In some embodiments, the midsole may be made from one or more midsole materials such as, for example, a foamed material. In some cases, the foamed material may comprise a material (e.g., a molding agent) that is foamed using a foaming agent. In some case, the foamed material may comprise a material that comprises a foam or foam-like structure. In some cases, the foamed material may comprise an open cell foam comprising one or more open or partially open cells. In other cases, the foamed material may comprise a closed cell foam comprising one or more closed or partially closed cells. In some non-limiting embodiments, the foamed material may comprise an elastic foam. The elastic foam may include, for example, ethylene vinyl acetate copolymer (EVA), an elasticized closed-cell foam with rubber-like softness and flexibility. In other non-limiting embodiments, the foamed material may comprise a viscous foam. The viscous foam may include, for example, a polyurethane foam or a polyethylene foam. In some alternate embodiments, the foamed material may comprise a viscoelastic foam. The viscoelastic foam may have the elastic properties of an elastic foam and the viscous properties of a viscous foam. In some cases, the viscoelastic foam may comprise a memory foam or a memory foam-like material. In some embodiments, the midsole may comprise a plurality of different foamed materials. The plurality of different foamed materials may include, for example, foamed ethylene vinyl acetate copolymer (EVA) and/or foamed polyurethane compositions.

Outsole

In some embodiments, the sole assembly 120 may comprise an outsole. The outsole may be designed to provide support and traction for the shoe. In some embodiments, the outsole may be integrated with the midsole. For example, the midsole may be fused with the outsole or otherwise attached to outsole (e.g., using an adhesive or as part of a manufacturing process for the midsole and/or the outsole). In some cases, the midsole can be molded as a separate piece and then joined to a top surface of the outsole by stitching, adhesives, or other suitable means. For example, the midsole can be heat-pressed and bonded to the top surface of the outsole. In some examples, the midsole and the outsole can be molded using a 'two-shot' molding method. In any of the embodiments described herein, the midsole may be positioned above the outsole such that at least a portion of the midsole is between a subject's foot and the outsole.

In some embodiments, the outsole may comprise an outsole material. In some cases, at least a portion of the outsole material may be configured to grip or otherwise engage a ground surface underneath the shoe (e.g., during a golf-related action or movement). In some embodiments, the outsole material may include, for example, thermoplastics such as nylons, polyesters, polyethers, polyolefins, and/or polyurethanes. In some non-limiting embodiments, the outsole material may include polyurethane compositions such as, for example, Estane® TRX thermoplastic polyurethanes. In some embodiments, the outsole material may include a rubber material or a thermoplastic rubber material, such as polybutadiene, polyisoprene, ethylene-propylene rubber ("EPR"), ethylene-propylene-diene ("EPDM") rubber, and/or styrene-butadiene rubber. In some embodiments, the outsole material may comprise a plastic material, a thermoplastic material, a thermoset plastic material, or any combination thereof. In some non-limiting embodiments, the outsole material may comprise acrylic, polymethyl methacrylate (PMMA), polycarbonate (PC), polyethylene (PE), polypropylene (PP), polyethylene terephthalate (PET), polyvinyl chloride (PVC), or acrylonitrile-butadiene-styrene (ABS).

In some embodiments, the outsole may comprise a plurality of strands or fibers of material that are directionally aligned along one or more select directions. In some cases, the one or more select directions may correspond to a direction along which one or more forces are exerted on the outsole or the traction elements of the outsole during a golf-related action or movement. In some cases, the plurality of strands or fibers of material may be directionally grippy. In some cases, the plurality of strands or fibers of material may be oriented to provide traction in one or more select or pre-determined directions. In some cases, the plurality of strands or fibers of material may not or need not be oriented in one or more select or pre-determined directions. In some cases, the plurality of strands or fibers of material may be oriented to provide traction or grip along a first direction, but not in a second direction. In some cases, the outsole material may comprise a Mohair fabric or yarn comprising a keratin-based material derived from a living organism (e.g., an Angora goat).

In some embodiments, the outsole material may comprise a carbon-based material. In some cases, the carbon-based material may be provided in a granulated form and dispersed along or throughout a surface or a volume of the outsole material. In some cases, the carbon-based material may comprise a composite material (e.g., a carbon fiber composite material).

In some embodiments, the outsole material may be configured to reduce or minimize interlock with a ground surface beyond a certain depth (e.g., to help preserve on course and/or off course surfaces). In some cases, the outsole material may not or need not be arranged to promote a deep mechanical interlock between the traction elements of the shoe and a ground surface under the shoe.

Traction Elements

In some embodiments, a bottom surface of the outsole may include a plurality of traction elements. The plurality of traction elements may be configured to provide and enhance traction between the shoe and various different ground surfaces.

In some non-limiting embodiments, the plurality of traction elements may comprise spikes (e.g., hard spikes or soft spikes). The spikes may comprise a protrusion that is configured to at least partially penetrate or otherwise physically interface with or contact a ground surface.

In other non-limiting embodiments, the plurality of traction elements may not or need not comprise any spikes. For example, the traction elements may comprise a feature that is configured to reduce a lateral or translational movement of the shoe relative to a ground surface when a force is exerted on the shoe. The feature may include a spikeless feature. In some embodiments, the feature may have a higher coefficient of friction (static and/or dynamic frictional coefficient) than other portions of the outsole. In some embodiments, the feature may comprise a protrusion, a depression, or a grooved or textured surface or material provided on or integrated with the outsole.

In some embodiments, at least one of the plurality of traction elements may be permanently integrated with, attached, or coupled to the outsole or another portion of the sole assembly. In some embodiments, at least one of the plurality of traction elements may be removable or detachable from the outsole.

Traction Mechanics

In some embodiments, the traction elements disclosed herein may be configured to enhance and/or facilitate certain traction mechanics that are particular to on course surfaces. The traction mechanics for golf-related actions or movements may involve a plurality of different traction modes, each involving different factors or combinations of factors that can influence traction.

In some cases, the traction elements may be optimized to maximize turf traction (i.e., traction on a turf surface or another comparable on course ground surface that can be found on a golf course or a golf range). Turf traction may represent an ability of a golf shoe to resist movement relative to the turf due to forces that are applied to the turf (e.g., during a golf-related movement).

In some embodiments, the relative motion of a golf shoe or a traction element of the golf shoe relative to a ground surface may be a function of several different traction/movement modes which can collectively characterize the complex physical interactions between the traction elements and the ground surface during a golf-related movement or action. In some cases, the different traction/movement modes may involve (i) a mechanical interlock between the traction elements and the ground surface and/or (ii) a frictional engagement between the traction element material and the ground surface.

To accommodate the various modes of movement/traction and maximize traction stiffness on deformable turf surfaces to restrict or limit shoe movement during golf-related actions, the presently disclosed traction elements may be optimally dimensioned as described in greater detail below. In some embodiments, the geometry and/or the material properties of the traction elements may be optimized to account for different types of interactions or different modes of engagement between the traction elements and a turf surface, including, for example, frictional engagement and/ or mechanical interlock. In some embodiments, the geometry of the traction elements may include a dimension of the traction elements (e.g., height, width, depth, taper, etc.) or a ratio between the dimensions of the traction elements. In some embodiments, the material properties of the traction elements may comprise a material composition or a bending stiffness of the traction elements. In some embodiments, the material properties of the traction elements may correspond to a coefficient of friction between the traction elements and the ground surface contacting the traction elements.

Traction Stiffness

In some embodiments, the plurality of traction elements may comprise one or more traction elements that optimize shoe traction stiffness for on course and/or off course ground surfaces. In some embodiments, the golf shoe may utilize traction elements that are (1) optimally sized and shaped and (2) collectively arranged in an optimal layout on the outsole of the shoe in order to minimize the amount of movement of the golf shoe relative to the ground surface during a golf-related action or movement. The traction elements may be individually and collectively configured to provide an optimal traction stiffness to different selective regions of the shoe, which can help to minimize the movement of the shoe relative to an on course ground surface during a golf-related action or movement, and ultimately help to improve or maximize (i) consistency, e.g., by producing tighter ball dispersions and/or (ii) performance, e.g., by enabling longer carry distances.

The traction elements of the present disclosure may be configured to provide the golf shoe with an optimal traction stiffness. As used herein, the term "traction stiffness" may refer to an ability of a traction element to resist movement relative to a ground surface (e.g., an on course surface) in situations where the traction element is engaged with the ground surface (e.g., by frictional engagement and/or by penetrating through the ground surface to create a mechanical interlock). The mechanical interlock may involve contact between a portion of the ground surface (e.g., soil or a blade of grass) and one or more side portions of the traction element. In some cases, the portion of the ground surface that is in a mechanical interlock with the one or more side portions of the traction element may at least partially restrain or limit a movement of the traction element relative to the ground surface during a golf-related movement. Traction stiffness as referred to herein may measure how well a traction element grips an on course surface (e.g., turf), either by way of frictional engagement and/or a mechanical interlock. Traction elements that produce greater traction stiffness may move less across a ground surface for a generated ground reaction force. In some cases, the amount of frictional engagement and/or mechanical interlock may change or vary dynamically during a golf-related action or movement.

The traction elements described herein may be configured to provide golf shoes with an optimal traction stiffness across a wide variety of different environmental conditions and/or turf conditions. In some cases, the traction elements may provide an optimal traction stiffness on an on course ground surface when a temperature of the surrounding environment ranges from about 0 degrees Celsius to about 40 degrees Celsius or more. In some cases, the traction elements may provide an optimal traction stiffness on an on course ground surface when a humidity of the surrounding environment ranges from about 0% to about 100%. In some cases, the traction elements may provide an optimal traction stiffness on an on course ground surface when the ground surface has a compaction ranging from about 0.400 to about 0.800. In some cases, the traction elements may provide an optimal traction stiffness on an on course ground surface when the moisture of the ground surface ranges from about 10% to about 30%.

In some embodiments, the golf shoe may have a traction stiffness ranging from about 50 Newtons per millimeter (N/mm) to about 150 N/mm or more. In some embodiments, the golf shoe may have a traction stiffness that is greater than about 150 N/mm. In some embodiments, the golf shoe may have a traction stiffness that is at least about 150 N/mm, 160 N/mm, 170 N/mm, 180 N/mm, 190 N/mm, 200 N/mm, or more.

In some embodiments, the traction elements may be configured to provide a first traction stiffness ranging from about 50 N/mm to about 150 N/mm on a first surface. In some embodiments, the traction elements may be configured to provide a second traction stiffness ranging from about 50 N/mm to about 150 N/mm on a second surface. In some cases, the first surface may include an on course ground surface. In some cases, the on course ground surface may include, for example, grass, turf, dirt, soil, sand, or any other type of ground surface that can be found on a golf course. In some cases, the second surface may include an off course ground surface. In some cases, the off course ground surface may include, for example, cement, concrete, asphalt, tile, wood, or any other material that can be processed and formed into a ground surface (or a component thereof) by a human or a machine.

In some embodiments, when used on course, the traction elements of the present disclosure may provide a traction stiffness in the antero-posterior direction ranging from about 80 N/mm to about 120 N/mm depending on the type of turf and the conditions of the turf. In some embodiments, when used on course, the traction elements of the present disclosure may provide a traction stiffness in the medial-lateral direction ranging from about 60 N/mm to about 80 N/mm.

In some embodiments, the arrangement and/or configuration of the traction elements may be adjusted or modified to provide an optimal traction stiffness for different individual golfers. In some cases, the optimal traction stiffness may be selected or determined based on (i) the biomechanical characteristics of a subject's golf swing and/or (ii) the anatomical or physiological characteristics of the subject's body. In some cases, the optimal traction stiffness may be based on the preferences or performance needs of the different individual golfers.

Figure 4:
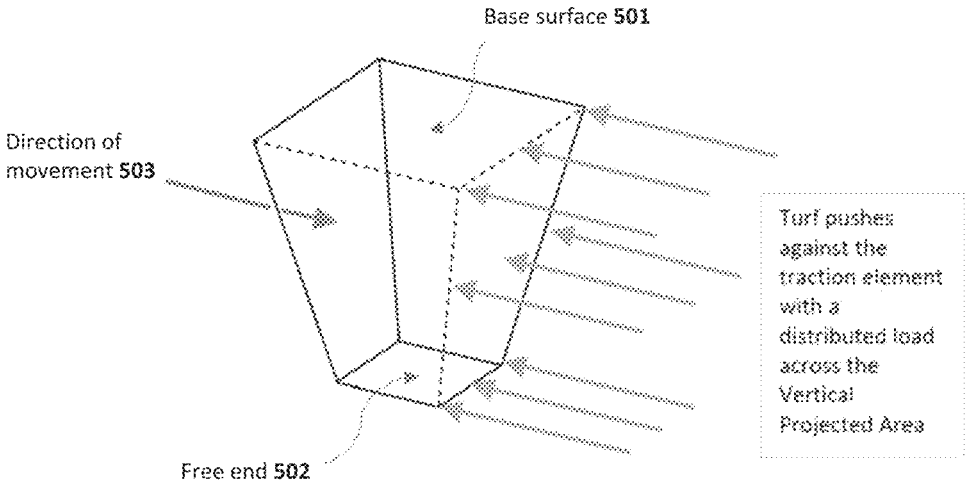
FIGS. 4 and 5 schematically illustrate various exemplary configurations for a traction element optimized for a golf shoe, in accordance with some embodiments.
Figure 5:
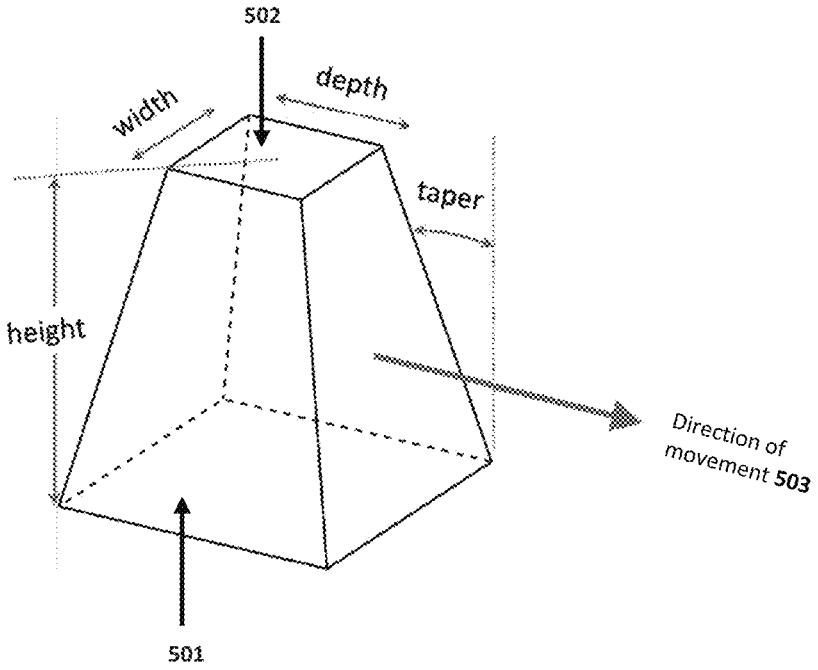

FIGS. 4 and 5 schematically illustrate various perspective views of an exemplary traction element that can be used on a golf shoe. In some non-limiting embodiments, the traction element may have the shape of a pyramidal frustrum or a quadrilateral frustrum.

In some embodiments, the traction element may have a base surface 501 that is attached or fixed to the outsole of the shoe. In some embodiments, the traction element may have a free end 502 that is disposed opposite the base surface 501. In some cases, the free end 502 may be configured to contact and interact with a ground surface. In some cases, the free end 502 may be embedded into a ground surface (e.g., turf). In some cases, the free end 502 may be configured to penetrate into a ground surface to mechanically interlock with a portion of the ground surface. In some embodiments, when the free end 502 is mechanically interlocked with the ground surface and a subject performs a golf-related action that causes the traction element to move in a direction of movement 503, the ground surface may push against the traction element in an opposite direction, in part due to the initial mechanical interlock between the traction element and the ground surface. In some cases, the counter-reaction of the ground surface in response to the movement of the traction element may result in a distributed load across a vertical projected area (VPA) of the traction element. In some cases, the distributed load exerted by the ground surface may reduce or minimize the amount by which the traction element moves during a golf-related movement involving one or more forces exerted along the direction of movement 503.

In some embodiments, the traction elements may be sized to provide an optimal traction stiffness when the traction elements are engaged with an on course ground surface (e.g., turf). In some embodiments, the traction element may have a height. The height may span from a base surface 501 of the traction element to a free end 502 of the traction element. In some cases, the height may range from about 3 millimeters (mm) to about 6 mm. In some embodiments, the traction element may have a width. The width may correspond to a width of the free end 502 of the traction element. The width of the free end 502 of the traction element may be approximately perpendicular or orthogonal to the direction of movement 503 of the traction element during a golf-related action. In some cases, the width may range from about 5 mm to about 10 mm. In some embodiments, the traction element may have a depth. The depth may correspond to a depth of the free end 502 of the traction element. The depth of the free end 502 of the traction element may be approximately parallel to the direction of movement 503 of the traction element during a golf-related action. In some cases, the depth may range from about 5 mm to about 10 mm. In some embodiments, the traction element may have a taper. The taper may extend from the base surface 501 of the traction element to the free end 502 of the traction element, and may represent a ratio of (i) the horizontal run of the traction element face in the direction of movement 503 to (ii) the vertical rise of the traction element face along the height of the traction element. In some cases, the taper may range from about ⅙ to about ⅔.

In some embodiments, the taper of the traction elements may be increased to further enhance shoe traction stiffness. In some cases, the taper of the traction element may be optimized by increasing a cross-sectional area of the fixed base of the traction element relative to the cross-sectional area of the free end of the traction element, or by decreasing a cross-sectional area of the free end relative to the cross-sectional area of the fixed base. In any case, since the bending moment of the traction element is greatest at the fixed base (i.e., where the traction element interfaces with the shoe outsole) when shear forces are applied, the fixed base cross-sectional area may be greater than the free end cross-sectional area to achieve the greatest bending stiffness for the amount of material used.

In some embodiments, the shoe traction stiffness can be further enhanced by orienting the traction element to maximize area moment of inertia and minimize the amount of bending that a traction element experiences under load, thereby allowing the traction element to resist bending to a greater extent, and maintain a greater loaded vertical projected area (VPA) within the turf to minimize any undesired sliding motions. In some cases, the area moment of inertia can be maximized by orienting the traction element parallel to the direction of a load. When oriented as such, the depth of the traction element may be parallel to the direction of the load, and the width of the traction element may be perpendicular to the depth of the traction element or the direction of the load. In some cases, the traction stiffness of the shoe can be further enhanced by increasing the depth of the traction element relative to the width of the traction element, or by decreasing the width of the traction element relative to the depth of the traction element. In some cases, the traction element may have a depth that is greater than a width of the traction element. In other cases, the traction element may have a width that is greater than a depth of the traction element. Orienting and dimensioning the traction elements as described herein can increase the area moment of inertia for the traction elements, which minimizes the amount of bending experienced by the traction elements under load and ultimately enhances traction stiffness.

In some embodiments, the dimensions of the traction elements can spatially vary across the outsole to further optimize the role of mechanical interlock versus friction during various traction modes. In some cases, the dimensions of the traction elements may include, for example, a length, a width, a height, a depth, or a taper of the traction elements. In some cases, the dimensions of the traction elements may include a ratio between two or more dimensions of the traction elements.

In some embodiments, traction stiffness can be enhanced by increasing height and depth proportionally. In other embodiments, traction stiffness can be enhanced by decreasing height and depth proportionally. In some cases (e.g., for a traction element having a pyramidal frustrum shape or profile), the optimal ratio between depth and height to maximize traction stiffness can be about 5:3. In some cases, a ratio below the optimal 5:3 ratio may result in a traction element that is too slender and that has a small area moment of inertia (I) and a large height (H), and therefore may easily bend, pull out of, and wipe across the surface, instead of maintaining penetration within the turf and dragging through the turf to maintain traction. In some cases, a traction element with a dimensional ratio above the optimal 5:3 ratio may have too much horizontal projected area (HPA) and therefore may not quite penetrate the turf and instead slide across the surface.

In some embodiments, traction stiffness can be enhanced by increasing the taper of the traction element. In some embodiments, the taper of the traction element may correspond to a ratio of (a) the horizontal run of the traction element face in the direction of movement to (b) the vertical rise of the traction element face along the height of the traction element. In some embodiments, traction stiffness can be enhanced by increasing taper and also reducing the height of the traction element. In cases where a TPU material is used for at least a portion of the traction elements, traction stiffness can be enhanced by increasing the taper of the traction elements. In cases where a rubber material is used for at least a portion of the traction elements, traction stiffness can be enhanced by increasing both the taper and the width of the traction elements.

In some non-limiting embodiments, the traction element may have a shape or profile that is different than a frustrum. In these non-limiting embodiments, the traction element may have a first dimension corresponding to a length of the traction element, a second dimension corresponding to a width of the traction element, and a third dimension corresponding to a height of the traction element. The first dimension may extend between a lateral side and a medial side of the shoe, or between an anterior end and a posterior end of the shoe. The second dimension may extend between an anterior end and a posterior end of the shoe, or between a lateral side and a medial side of the shoe. The third dimension may extend from a lower edge of the traction element (e.g., an edge of the traction element in direct proximity to the ground surface on which the shoe is worn)

to an upper edge of the traction element (e.g., an edge of the traction element that is in direct proximity with a portion of the sole to which the traction element is attached or integrated).

In some non-limiting embodiments, the ratio between the first dimension and the second dimension may range from about 1:10 to about 10:1. In some non-limiting embodiments, the ratio between the first dimension and the third dimension may range from about 1:10 to about 10:1. In some non-limiting embodiments, the ratio between the second dimension and the third dimension may range from about 1:10 to about 10.1.

In some embodiments, the one or more traction elements may have one or more cross-sections. In some cases, the cross-sections may include a lateral cross-section along a plane that extends through a portion of the traction elements. In some cases, the cross-sections may include a lateral cross-section along a plane that extends vertically or horizontally through the traction elements. In any of the embodiments described herein, the plane may be oriented at an angle relative to a surface of the traction elements. In some cases, the angle may range from about 1 degree to about 179 degrees. In some non-limiting embodiments, the plane may be normal, orthogonal, or perpendicular to a surface of the one or more traction elements.

In some embodiments, the one or more cross-sections of the traction elements may have a cross-sectional shape. The cross-sectional shape may correspond to a lateral or vertical cross-section of the traction elements. In some cases, the cross-sectional shape may comprise a circular shape or a polygonal shape. In some cases, the cross-sectional shape may comprise, for example, a circle, an ellipse, a triangle, a square, a rectangle, a parallelogram, or any polygon having three or more sides. The cross-sectional shape may comprise a regular shape (e.g., a shape having two or more sides with a same length) or an irregular shape (e.g., a shape having two or more sides with different lengths). In some cases, the cross-sectional shape may comprise at least one linear portion or section. In some cases, the cross-sectional shape may comprise at least one curved or non-linear portion or section. In some cases, the cross-sectional shape may comprise at least one linear portion or section and at least one curved or non-linear portion or section.

In some embodiments, the one or more traction elements may have a cross-sectional shape that changes along a dimension of the traction elements. In some cases, the dimensions of the cross-sectional shape may also vary along a portion of the traction elements. The dimension may include, for example, a length, a width, and/or a height of the cross-sectional shape.

Friction-Based Traction

In one aspect, the present disclosure provides a high performance friction-based traction outsole for use on deformable surfaces that can exacerbate sliding movements. The golf shoes described herein may utilize materials that enhance friction-based traction performance for deformable surfaces that can induce sliding during a golf-related action, such as, for example, natural turfs of all types and/or wet artificial turf surfaces. In some cases, the traction outsole may utilize a minimal number of traction elements while still providing enhanced on course traction for golf shoes.

The presently disclosed traction outsoles may be configured to provide enhanced traction on deformable on course surfaces such as turf, compared to conventional traction outsoles. The traction outsoles described herein may be configured to provide sufficient traction when engaged with on course surfaces, even in instances or scenarios where conventional outsoles would slip or slide along or across the on course surfaces.

Despite the possibility of a golf shoe slipping or sliding on a turf surface during a golf-related action, many conventional traction solutions still use high modulus materials for on course traction, such as TPUs and/or polyamides which tend to have low coefficients of friction and can be slippery on turf playing surfaces, especially under wet conditions. To reduce the likelihood of slipping and/or sliding on soft ground and/or in wet conditions, conventional traction solutions typically use high aspect ratio geometrical configurations (e.g., long or tall spikes or cleats). However, as conditions dry and the ground surface becomes firmer, the effectiveness of higher aspect ratio traction elements can decrease, and the shoe can become uncomfortable to wear. From a surface preservation standpoint, high aspect ratio traction elements can also damage greens (e.g., by picking up and retaining grass or soil), accelerate on course surface wear, and negatively impact overall course quality.

The traction outsoles described herein may be configured to minimize slipping or sliding on turf surfaces by utilizing high friction materials that can contact the ground surface to enhance traction, especially in scenarios where mechanical interlock is reduced or even non-existent. In some embodiments, the traction outsoles may utilize a relatively soft outsole material that is comfortable for both on course and/or off course use. The relatively soft outsole material can provide enhanced grip between the outsole and on course or off course surface, especially in traction modes that can involve a lateral displacement of the shoe across the surface during a golf-related action. In some embodiments, the traction outsole may comprise a relatively soft and tacky outsole material applied across a plantar surface of the traction outsole. In some embodiments, the outsole material can be soft, pliable, and conformable to a ground surface. In some embodiments, the relatively soft and tacky outsole material may include one or more thermoplastic elastomers (TPEs). In some embodiments, the relatively soft and tacky outsole material may be optimized for on course and/or off course surface traction.

In some embodiments, the use of high friction materials and/or relatively soft and tacky materials for the outsole can allow for a simplification of the outsole geometry. In some embodiments, the traction element geometry can be scaled back in terms of complexity and/or size in order to increase a surface area of the traction outsole contacting the turf Increasing the surface of the traction outsole contacting the turf can help to facilitate the role of surface friction in providing traction when the shoe is sliding or slipping along a deformable ground surface. In some cases, the combination of a simplified traction outsole geometry and a relatively soft outsole material with high frictional properties can collectively enhance traction performance and comfort, both on course and off course. In some cases, the simplified traction outsole geometry can also enhance the greens friendliness of the traction outsole, since the simplified traction outsole geometry may not or need not require the use of high aspect ratio structures that can damage a ground surface.

In some embodiments, the presently disclosed traction outsoles may have a simplified outsole geometry that preserves or enhances on course traction performance and slip resistance without compromising the comfort of the shoe or excessively damaging greens. In some embodiments, the outsole may comprise a minimalistic or simplified geometry that increases an amount of surface area of the outsole material that contacts the turf blades of an on course surface. In some cases, the geometry may include a soft or subtle texturing of the outsole surface. In some cases, the geometry may include a very fine texturing of the outsole material with features (e.g., elongate ribs, channels, depressions, protrusions, bumps, ridges, lines, etc.) that are appropriately positioned and/or oriented relative to (i) the contours of the shoe outsole and/or (ii) the ground reaction forces exerted on the shoe during a golf-related action or movement. In some cases, the outsole geometry may include short, narrow fins or blades that can work interstitially into grass or turf, similar to a gecko toe pad.

In some embodiments, the traction outsole may have various other materials or geometrical features to further enhance abrasion resistance and improve off course traction. For example, in some embodiments, one or more particles may be added to a base polymer of the traction outsole. The one or more particles may comprise, for example, carbon, titanium, diamond, silicon, or glass particles. In some embodiments, the one or more particles may be configured to improve grip with the turf surface and greatly enhance the abrasion resistance of the traction outsole for off course usage.

In some embodiments, the traction outsole may comprise a polymeric material with a filler added or dispersed therein to enhance the frictional properties and durability of the traction outsole. In some cases, the filler may comprise a nano filler with a particle size of around 100 nanometers (nm) or less. In some cases, the filler may comprise a nanoparticle, a nanofiber, or nanoplate. In some cases, the filler may comprise a graphene nano filler.

In some embodiments, the amount of filler added to the traction outsole material may depend on the coefficient of friction between the polymeric base material and a smooth on course surface. In some cases, the amount of filler added by mass or volume may be adjusted based on the frictional properties of the polymeric base material. In some cases, the texturing, positioning, and/or spatial arrangement of the filler material in, on, or within the polymeric base material may be modified to further augment the frictional grip provided by the base material.

In some embodiments, the traction outsole may have a frictional coefficient ranging from about 0.4 to about 0.6 or more when used off course. In other embodiments, the traction outsole may have a frictional coefficient ranging from about 0.4 to about 0.7 or more when used off course. In some alternative embodiments, the traction outsole may have a frictional coefficient ranging from about 0.4 to about 0.8 or more when used off course.

Multi-Modal Traction

In another aspect, the present disclosure provides various examples and embodiments of traction elements that are optimized for both mechanical interlock and friction-based traction performance on soft deformable surfaces that induce sliding, such as natural turfs of all types and/or wet artificial turf surfaces. In some embodiments, the traction elements may comprise a material with a relatively high modulus of elasticity to minimize loaded outsole deformation during a golf-related action. In some embodiments, the traction elements may comprise a material with a relatively high frictional coefficient to minimize sliding along a deformable surface such as turf. The modulus of elasticity and the frictional coefficient of the traction element material can collectively enhance grip during different modes of traction that can occur on a deformable surface such as turf.

Many conventional shoes use high modulus materials such as TPUs and polyamides, which tend to have low coefficients of friction and are slippery against most turf playing surfaces, especially under wet conditions. These conventional shoes typically have higher aspect ratio cleats or spikes for use on soft ground and/or in wet conditions, to further complement and enhance the frictional properties and traction performance of high modulus materials.

Unlike other conventional shoes, the present disclosure provides various examples and embodiments of traction elements comprising at least one high modulus material for bending resistance and at least one high friction material for slip resistance. Utilizing these types of materials in combination can provide a multi-material solution for enhanced grip between the outsole and various playing surfaces, which can be very beneficial in the game of golf, where even small visually unnoticeable relative movements between the outsole and playing surface can affect golf ball flight significantly.

EXAMPLES

In some embodiments, the traction elements may comprise at least one high modulus material that can be used to reduce traction element bending, and at least one low modulus material that can increase friction between the outsole material and a turf surface. Various examples of high performance traction solutions utilizing multi-material designs to enhance the traction performance by way of mechanical interlock and friction are described below, and it shall be noted that these embodiments may be implemented individually and/or in combination with one another to best suit the traction needs of a particular golfer and/or a wide variety of different golfers.

In some embodiments, the traction elements may individually comprise either the high modulus or the low modulus material. For example, a first set of traction elements may comprise the high modulus material that reduces traction element bending, and a second set of traction elements may comprise the low modulus material that increases friction between the outsole material and a turf surface. The first and second sets of traction elements can be strategically positioned on the outsole to enhance traction stiffness when a subject performs a golf-related action (e.g., swinging a golf club), or when the subject walks on course or off course.

In some embodiments, the traction elements may comprise a first set of traction elements that resist bending and provide mechanical interlock, and a second set of traction elements that enhance friction. In some cases, the first set of traction elements may have a greater height and/or aspect ratio than the second set of traction elements. In some cases, the second set of traction elements may be wider, longer, and/or flatter than the first set of traction elements. In some cases, the first and second sets of traction elements can be interspersed along the outsole of the shoe.

In some embodiments, the traction elements may comprise a plurality of layers having different material properties. In some cases, the traction elements may comprise a high modulus core that resists bending and can mechanically interlock with a ground surface. In some cases, the high modulus core may be coated with a high friction material having a lower modulus than the core of the traction element.

In some embodiments, the traction elements may comprise a high modulus material that resists bending and allows the traction elements to mechanically interlock with a ground surface. In some cases, a base surface of the outsole may comprise a softer material with a lower modulus than the high modulus material of the traction elements. In some cases, the softer material may have a high coefficient of friction to enhance grip when sliding across deformable ground surfaces such as turf. In some cases, the base surface of the outsole may have additional geometries or features to further enhance the frictional grip between the shoe and the ground surface. The geometries or features may include, for example, one or more protrusions, bumps, ridges, ribs, lines, depressions, indents, channels, grooves, or any other two-dimensional or three-dimensional feature extending into or away from the outsole.

In some embodiments, the coating applied to the traction elements can vary (in terms of physical configuration and/or material composition) depending on the location on the outsole, in order to further optimize frictional traction between the shoe and an on course surface. In some embodiments, the size, shape, and/or dimensions of and the traction elements and/or the base surface of the outsole can vary based on the location on the outsole, to further optimize both traction based on mechanical interlock and traction based on frictional forces.

Traction Element Positioning

The traction elements described herein may be positioned in one or more select regions of the outsole to enhance traction. In some cases, the one or more select regions may include a perimeter or edge of the outsole. In some cases, the one or more select regions may include a central portion of the outsole (e.g., a portion of the outsole that is within the perimeter or edge of the outsole).

In some embodiments, the one or more select regions may include one or more tracks extending around a central region of the outsole. In some cases, the one or more tracks may comprise a physical track that is formed on the outsole. In other cases, the one or more tracks may not or need not comprise a track that is physically formed on the outsole or visible on the outsole. For instance, the one or more tracks may include an abstract track or pathway that (i) traces a perimeter or edge of the outsole and/or (ii) circumscribes a central region of the outsole.

In some non-limiting embodiments, the one or more tracks or pathways may have one or more breaks (i.e., one or more sections or segments of the tracks or pathways may be broken or discontinuous). In some cases, the one or more breaks may be configured to provide a localized or specific flex profile along the one or more breaks. In other cases, the one or more breaks may be implemented to expose the midsole or outsole material underneath and to reduce a weight of the shoe in various select locations corresponding to the one or more breaks. In some cases, a plurality of breaks may be used to produce a sole assembly with multiple discrete zones that can move or flex independently of one another. In any of the embodiments described herein, breaking the tracks or pathways may help to counterbalance the overall stiffness of the shoe.

In some cases, the one or more traction elements may be arranged along the one or more tracks in a spatial configuration that traces a shape of the perimeter or edge of the outsole. In some cases, the one or more traction elements may be arranged along one or more tracks which are in a nested configuration relative to each other. In some cases, the nested tracks may trace or approximate a shape similar to that of the perimeter or edge of the outsole.

In some embodiments, the traction elements may be positioned around one or more central regions of the outsole. The one or more central regions of the outsole may include any regions of the outsole that are within the perimeter or edge of the outsole. In some embodiments, the one or more central regions may include any regions of the outsole that are circumscribed by the one or more tracks extending around the outsole. In some embodiments, one or more traction elements may be positioned within the one or more central regions of the outsole.

In any of the embodiments described herein, the traction elements may be disposed on a forefoot, midfoot, and/or rearfoot region of the outsole. In any of the embodiments described herein, the traction elements may be disposed on a medial side and/or a lateral side of the outsole. In some non-limiting embodiments, the traction elements may be disposed along a central axis of the outsole.

In some embodiments, the traction elements may extend between a medial side and a lateral side of the outsole to enhance traction along a lateral axis extending across a width of the shoe. In other embodiments, the traction elements may extend between a forefoot region and a rearfoot region of the outsole to enhance traction along a lateral axis extending across a length of the shoe.

In some embodiments, the one or more traction elements may be arranged along the lateral side and/or the medial side of the outsole. The arrangement of the one or more traction elements along the lateral side and/or the medial side of the outsole may enhance the regional traction performance of the shoe at or near the medial and/or lateral side of the shoe.

In some embodiments, the traction elements arranged along the lateral and/or medial side of the outsole may span a length of the outsole. The length of the outsole may correspond to a distance between the anterior side and the posterior side of the outsole. In some embodiments, the traction elements may extend between a forefoot region and a rearfoot region of the medial and/or lateral sides of the outsole to enhance traction at the medial and/or lateral edges of the shoe. In some embodiments, the traction elements may extend between a forefoot region and a midfoot region of the medial and/or lateral sides of the outsole to enhance traction at the medial and/or lateral edges of the shoe. In some embodiments, the traction elements may extend between a midfoot region and a rearfoot region of the medial and/or lateral sides of the outsole to enhance traction at the medial and/or lateral edges of the shoe.

In some embodiments, the one or more traction elements may be arranged along the anterior and/or the posterior end of the outsole. The arrangement of the one or more traction elements along the anterior end and/or the posterior end of the outsole may enhance the regional traction performance of the shoe at or near the anterior and/or posterior regions of the shoe.

In some embodiments, the traction elements arranged along the anterior and/or posterior end of the outsole may span a width of the outsole. The width of the outsole may correspond to a distance between the medial side and the lateral side of the outsole. In some embodiments, the traction elements may extend between a medial side and a lateral side of the anterior and/or posterior ends of the outsole to enhance traction at the anterior and/or posterior regions of the shoe.

Traction Element Density

In some embodiments, the outsole may comprise at least one traction element per square inch. In some embodiments, the outsole may comprise at least two or more traction elements per square inch. In some embodiments, the outsole may comprise at least three or more traction elements per square inch. In some embodiments, the outsole may comprise at least four or more traction elements per square inch. In some embodiments, the outsole may comprise at least five or more traction elements per square inch. In some embodiments, the outsole may comprise at least ten or more traction elements per square inch.

In some embodiments, the outsole may comprise a plurality of regions each having one or more traction elements disposed within said plurality of regions. In some cases, the plurality of regions may comprise a first region having a first traction element density and a second region having a second traction element density. The traction element density may correspond to a number of traction elements per unit area. In some cases, the first traction element density may be greater than or equal to the second traction element density. In some cases, the second traction element density may be greater than or equal to the first traction element density.

In some non-limiting embodiments, the anterior or posterior side of the outsole may have a greater traction element density than the medial or lateral side of the outsole. In other embodiments, the medial or lateral side of the outsole may have a greater traction element density than the anterior or posterior side of the outsole.

Track

In one aspect, the present disclosure provides a golf shoe comprising a plurality of traction elements arranged in a track configuration around a central region of the outsole of the shoe. The track configuration may comprise one or more tracks extending around the central region of the shoe outsole. The track configuration may comprise one or more tracks extending along a perimeter or edge portion of the shoe outsole. In some cases, the one or more tracks may extend continuously around the central region of the outsole. In some cases, the one or more tracks may extend continuously along a path or region extending along the perimeter or edge of the outsole. The path or region extending along the perimeter or edge of the outsole may be directly adjacent to the perimeter or edge of the shoe, or may be offset by a predetermined distance from the perimeter or edge of the shoe. In some non-limiting embodiments, the predetermined distance may range from about 0.1 millimeters (mm) to about 25 millimeters (mm) or more.

In some embodiments, the one or more tracks or pathways may be broken or segmented to provide various performance enhancements. For instance, in some cases, the tracks or pathways may be broken or segmented to enhance the flexibility of the sole assembly in various select locations or zones.

In some embodiments, various groups or subsets of traction elements may be staggered along the one or more tracks or pathways to enhance the performance aspects of the shoe. For example, in some cases, the traction elements may be staggered to provide more flexibility in the sole assembly without (i) breaking the shape of the tracks or pathways, (ii) disrupting the overall flow or curvature of the tracks or pathways, or (iii) compromising the performance benefits provided by the shape or configuration of the tracks or pathways.

Figure 6A:
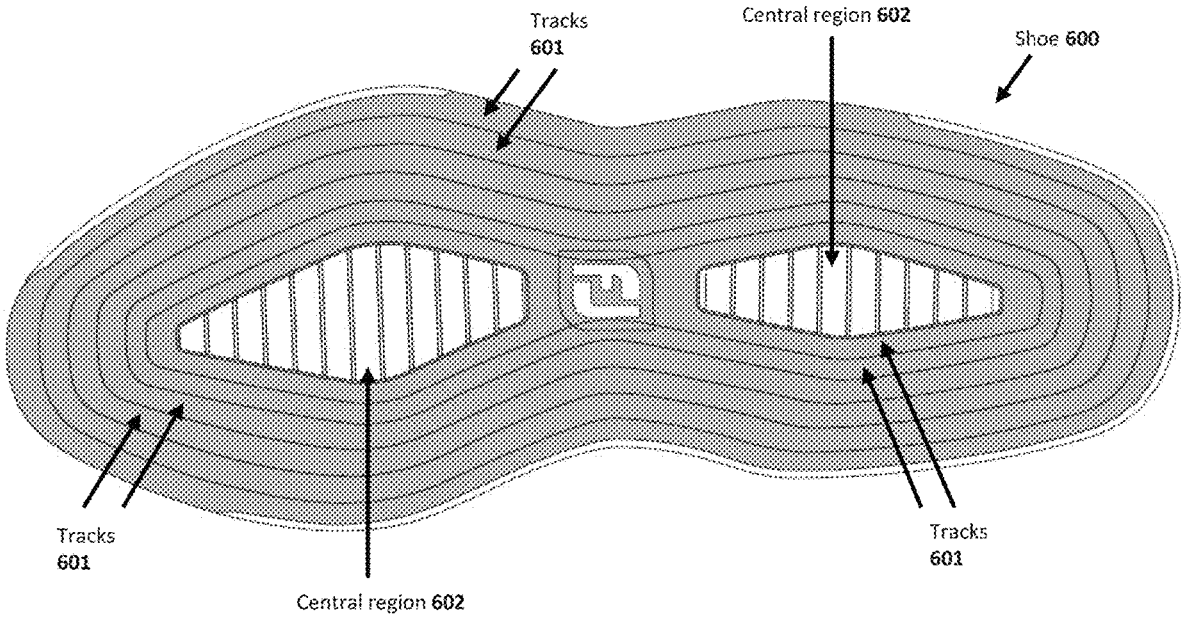
FIGS. 6A-6C schematically illustrate various examples of a golf shoe outsole with one or more tracks or pathways extending continuously around a central region of the outsole, in accordance with some embodiments.

FIG. 6A schematically illustrates a golf shoe 600 comprising a plurality of tracks or pathways 601 extending around the outsole of the shoe. The plurality of tracks or pathways 601 may extend around one or more central regions 602 of the outsole. The one or more central regions 602 may or may not include additional traction elements to further enhance shoe traction on course and/or off course.

Figure 6B:
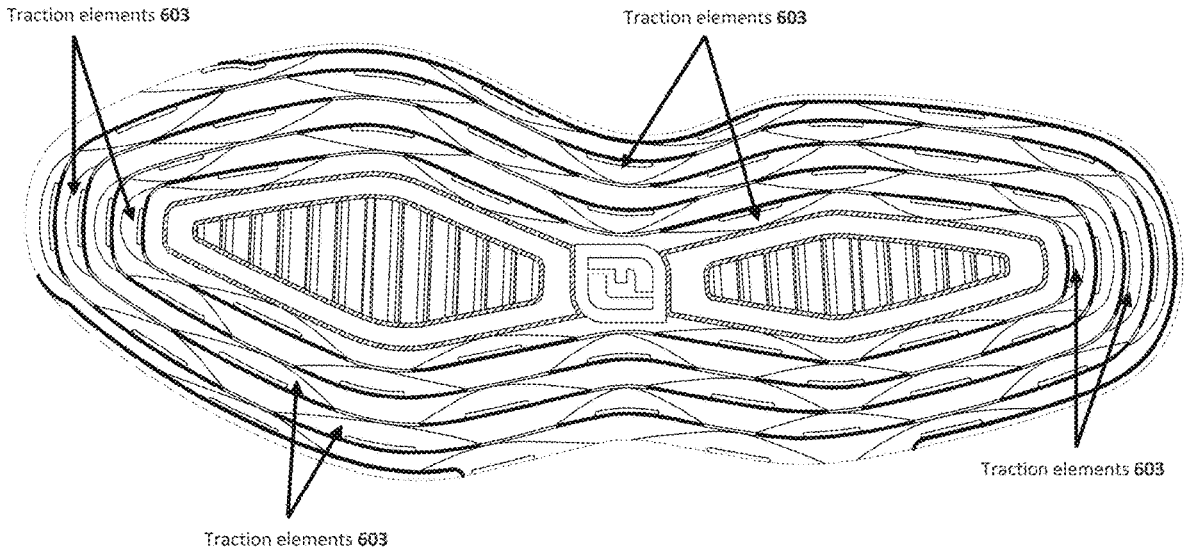

FIG. 6B schematically illustrates a plurality of traction elements 603 that can be arranged along the tracks or pathways of the outsole. In some embodiments, the plurality of traction elements 603 can include multiple sets of traction elements that are arranged along different tracks or pathways. In some cases, the multiple sets of traction elements may comprise a first set of traction elements and a second set of traction elements each comprising a series of spaced apart traction elements respectively arranged in first or second spatial configurations.

In some embodiments, the plurality of traction elements may comprise a first set of traction elements arranged along a perimeter or edge of the shoe in a first spatial configuration corresponding to a shape or profile of the perimeter or edge of the shoe. In some embodiments, the first spatial configuration can define a first enclosed shape around the central region of the outsole. In some embodiments, the first set of traction elements can define a first enclosed shape or profile around the central region of the outsole.

In some embodiments, the plurality of traction elements may comprise a second set of traction elements. In some embodiments, the second set of traction elements can be arranged in a second spatial configuration corresponding to a shape or profile of the first spatial configuration for the first set of traction elements. In some embodiments, the second spatial configuration can define a second enclosed shape around the central region of the outsole. In some embodiments, the second enclosed shape may be similar to the first enclosed shape defined by the first set of traction elements arranged in the first spatial configuration described above. In some embodiments, the second enclosed shape may be nested within the first enclosed shape. In some embodiments, the second set of traction elements can be nested within the first set of traction elements. In some embodiments, the second set of traction elements may be nested between the first set of traction elements and a central region of the outsole. In some embodiments, the second set of traction elements may be nested between the first set of traction elements and a third set of traction elements.

In some embodiments, the plurality of traction elements may comprise a third set of traction elements. In some cases, the third set of traction elements may be nested between the second set of traction elements and the central portion or region of the outsole. In some cases, the third set of traction elements may be nested between the second set of traction elements and one or more additional sets of traction elements (e.g., a fourth set of traction elements).

As used herein, the term "nested" may refer to a spatial configuration in which a set of elements or tracks are successively offset from each other and arranged within a boundary or perimeter that is set or defined by an adjacent set of elements or an adjacent track. The nested elements or tracks may be spatially arranged to form a series of similar shapes that are located within or around each other. The similar shapes may be approximately similar (i.e., there may be some minor or moderate variations in the exact shape, but such variations may lie within an acceptable tolerance range). In some cases, the similar shapes may be geometrically similar (i.e., similar in shape but different in size to achieve a nested configuration).

In some embodiments, the plurality of traction elements may be arranged in a track configuration around the central region of the outsole to expose an interior region or component of the sole assembly. In some cases, the interior region or component of the sole assembly may comprise or correspond to a midsole of the golf shoe. In some cases, the interior region or component of the sole assembly may comprise or correspond to a functional insert that is positioned (i) within the midsole or (ii) between the midsole and the outsole of a shoe. In some non-limiting embodiments, the functional insert may include, for example, a plate, a torsion bar, an endoskeleton, or any internal structure that is configured to enhance the suspension or stiffness characteristics of the shoe. In some cases, the functional insert may include a support with arms or members that extend across or through a portion of the sole of the shoe.

Directionality

In some embodiments, the first set of traction elements and/or the second set of traction elements may comprise (i) one or more directional traction elements and (ii) one or more omni-directional traction elements. As used herein, the term "directional traction element" may refer to a traction element that is configured to provide traction and reduce or minimize movement of the golf shoe relative to a ground surface when one or more forces are exerted on traction elements in one or more select directions. In some cases, the directional traction element may not or need not provide a same level of traction performance in response to forces exerted on the traction element in other non-select direction. As used herein, the term "omni-directional traction element" may refer to a traction element or a set of traction elements that is configured to provide a same or similar amount of traction and reduce or minimize movement of the golf shoe relative to a ground surface when one or more forces are exerted on the traction element(s), regardless of the directionality of the forces exerted. In some cases, the omni-directional traction element(s) may provide a same or similar level of traction performance in response to forces exerted on the traction element in a plurality of different directions. In some non-limiting embodiments, the one or more omni-directional traction elements may comprise a set of directional traction elements that collectively provide the shoe with an omni-directional traction property or response.

In some embodiments, the first set of traction elements may comprise one or more directional traction elements. In some embodiments, the first set of traction elements may comprise one or more omni-directional traction elements. In some embodiments, the first set of traction elements may comprise a combination of directional and omni-directional traction elements.

In some embodiments, the second set of traction elements may comprise one or more directional traction elements. In some embodiments, the second set of traction elements may comprise one or more omni-directional traction elements. In some embodiments, the second set of traction elements may comprise a combination of directional and omni-directional traction elements.

In some embodiments, the first set of traction elements may comprise a set of omni-directional traction elements, and the second set of traction elements may comprise a set of directional traction elements. Alternatively, in some embodiments, the first set of traction elements may comprise a set of directional traction elements, and the second set of traction elements may comprise a set of omni-directional traction elements.

Arrangement of Traction Elements

In some cases, the first and second sets of traction elements may include (i) one or more traction elements arranged along an anterior side and a posterior side of the outsole and (ii) one or more traction elements arranged along a medial side and a lateral side of the outsole. In some cases, the one or more directional traction elements may be positioned on a medial side or a lateral side of the outsole. In some cases, the one or more omni-directional traction elements may be positioned on an anterior side or a posterior side of the outsole.

In some embodiments, the anterior or posterior side of the outsole may have a greater traction element density than the medial or lateral side of the outsole. In other embodiments, the medial or lateral side of the outsole may have a greater traction element density than the anterior or posterior side of the outsole.

Staggered Configuration

In some embodiments, the first and second sets of traction elements can be arranged along adjacent tracks or pathways extending around the central region of the outsole. In some embodiments, the traction elements arranged along the adjacent tracks or pathways can be staggered relative to each other.

In some embodiments, the first and second sets of traction elements can be arranged in a staggered configuration. The staggered configuration may comprise a spatial arrangement of the traction elements in which the traction elements in adjacent tracks or pathways are offset from a reference axis extending across the adjacent tracks or pathways. The reference axis may extend laterally across the adjacent tracks or pathways. In some cases, the reference axis may extend horizontally across the adjacent tracks or pathways. In some cases, the reference axis may be perpendicular or orthogonal to a surface of a traction element positioned along a track or pathway. In some cases, the reference axis may be perpendicular or orthogonal to a portion of the track or pathway along which the traction element is positioned. In some cases, the reference axis may be disposed at an angle relative to a horizontal axis extending across the adjacent tracks or pathways. In some cases, the angle may range from about 1 degree to about 179 degrees.

Figure 6C:
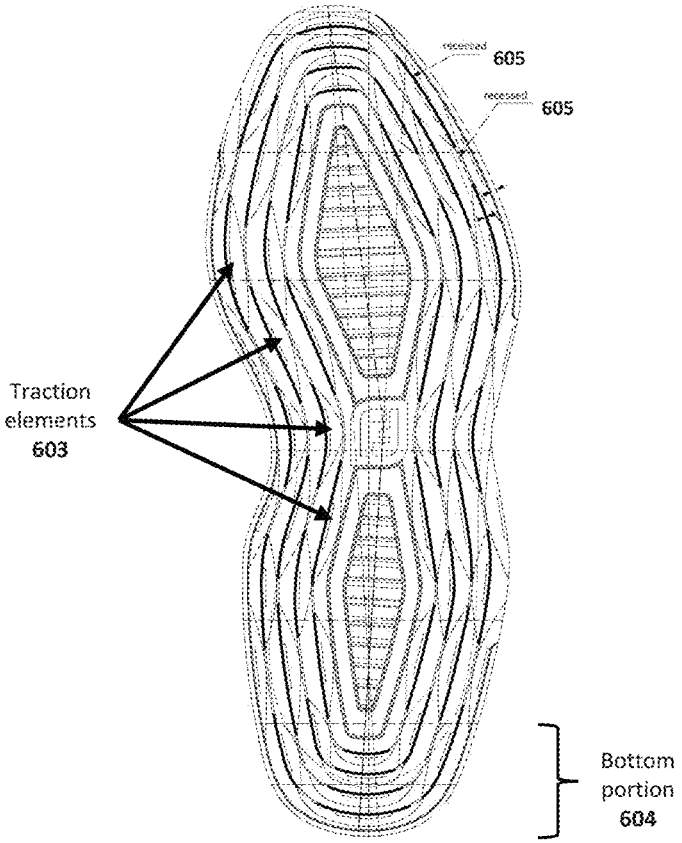

FIGS. 6B and 6C show various examples of traction elements 603 arranged in a staggered configuration. In some embodiments, the staggered configuration may comprise a spatial arrangement in which the traction elements in directly adjacent tracks or pathways are offset from a reference axis extending across the adjacent tracks or pathways. Additionally, or alternatively, the staggered configuration may comprise a spatial arrangement of the traction elements 603 in which the traction elements nearest each other in two or more directly adjacent tracks or pathways are positioned at different distances from a bottom portion 604 of the tracks or pathways.

The staggered arrangement of traction elements may promote a non-channeling and non-trenching traction design by offsetting various traction elements relative to a path along which a neighboring traction element moves through a ground surface during a golf-related movement. In some cases, a golf-related movement may involve a movement of a traction element through or across a ground surface (e.g., due to compressive or rotational forces exerted on the shoe), which can create one or more channels in the ground surface that lack sufficient material to effectively interlock with a traction element. The offsetting the traction elements relative to the channels created by other neighboring traction elements can increase the amount of ground surface available to interlock with the traction elements, thereby enhancing traction during various golf-related movements.

In some embodiments, the staggered arrangement of traction elements may comprise a first set of traction elements that are spaced apart along a first track or pathway extending around the outsole. In some embodiments, the staggered arrangement of traction elements may comprise a second set of traction elements that are spaced apart along a second track or pathway extending around the outsole. The separation distance between the first and second sets of traction elements can be the same. Alternatively, the separation distance between the first and second sets of traction elements can be different.

In some embodiments, a first and second traction element can be positioned along a first track or pathway, and a third and fourth traction element can be positioned along a second track or pathway. The first traction element may be positioned at a first distance from a bottom portion of the first track or pathway and the second traction element may be positioned at a second distance from the bottom portion of the first track or pathway. The second distance may be greater than the first distance. The third traction element may be positioned at a third distance from a bottom portion of the first track or pathway and the fourth traction element may be positioned at a fourth distance from the bottom portion of the first track or pathway. The third distance may be greater than first distance and less than the second distance. The fourth distance may be greater than the first distance, the second distance, and the third distance.

In some embodiments, the first and second sets of traction elements may be staggered in a non-channeling and non-trenching configuration to improve traction performance. In some embodiments, the non-channeling and non-trenching design can enhance the on course surface friendliness of the traction elements (i.e., the traction elements may be spaced apart in an optimal manner to preserve the condition or quality of an on course surface, without sacrificing traction performance).

Referring back to FIG. 6C, in some cases, a portion of the outsole or a portion of the tracks or pathways extending around the outsole may comprise one or more recessed regions 605. In some cases, the recessed regions 605 may comprise a groove that extends into the outsole material. The recessed regions 605 may be configured to promote flexing or bending of the traction elements when forces are applied to the traction elements (e.g., during a golf-related movement or action). In some cases, the recessed regions 605 may be positioned along a lateral or medial edge of the tracks or pathways. In some cases, the recessed regions 605 may be positioned along a lateral or medial side of the one or more traction elements 603.

In some embodiments, the recessed regions 605 may comprise an open window aperture. The geometry of the open window aperture may be configured to further promote the deformation of the traction elements to flatten out under a load of the subject wearing the shoe. When worn off course, the traction elements may flatten to provide better grip on the off course surface. When worn on course, the traction elements may retain a pointed shape or profile to penetrate the on course surface and enhance traction stiffness.

Figure 6D:
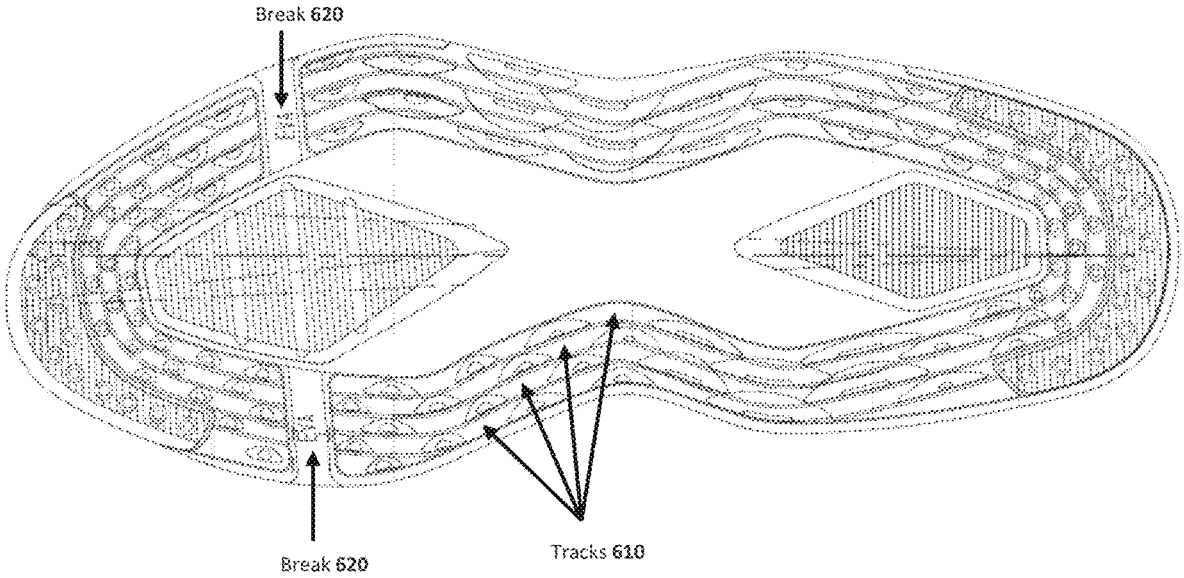
FIG. 6D schematically illustrates an example of an outsole comprising a plurality of tracks or pathways with at least one break, in accordance with some embodiments.

FIG. 6D illustrates an example of a shoe outsole comprising one or more tracks 610. The one or more tracks 610 may extend around the outsole as described elsewhere herein. In some embodiments, the one or more tracks 610 may be broken or segmented to enhance the flexibility of the sole assembly in various select locations or zones. In some embodiments, the shoe outsole may comprise one or more break regions 620 configured to divide or segment the one or more tracks 610. In some embodiments, the break region (s) 620 may be configured to reveal or expose the underlying midsole or outsole material. In some embodiments, the break region(s) 620 may not or need not contain any traction elements.

FIGS. 6E-6I schematically illustrate various different track configurations for a shoe outsole. As described in greater detail below, the different track configurations may provide different performance characteristics or flex profiles that are suitable for different individuals or different use cases or applications.

Figure 6E:
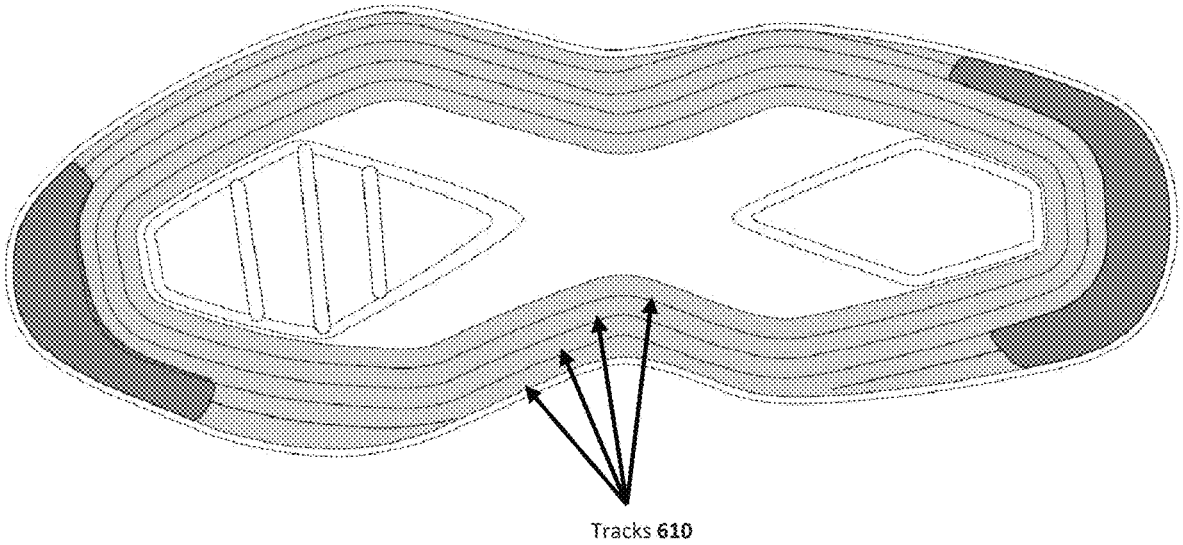
FIGS. 6E-6I schematically illustrate a variety of different track configurations for a shoe outsole, in accordance with some embodiments.

FIG. 6E illustrates one example of an outsole comprising a plurality of tracks 610 extending continuously around a central portion of the outsole. In some embodiments, the tracks 610 may not or need not contain any breaks in order to provide a progressive forefoot flex profile. In some embodiments, the tracks 610 may be configured to provide a 360 degree forefoot flex feel (i.e., a flex response that is not localized in a single flex point or along a single flex line).

Figure 6F:
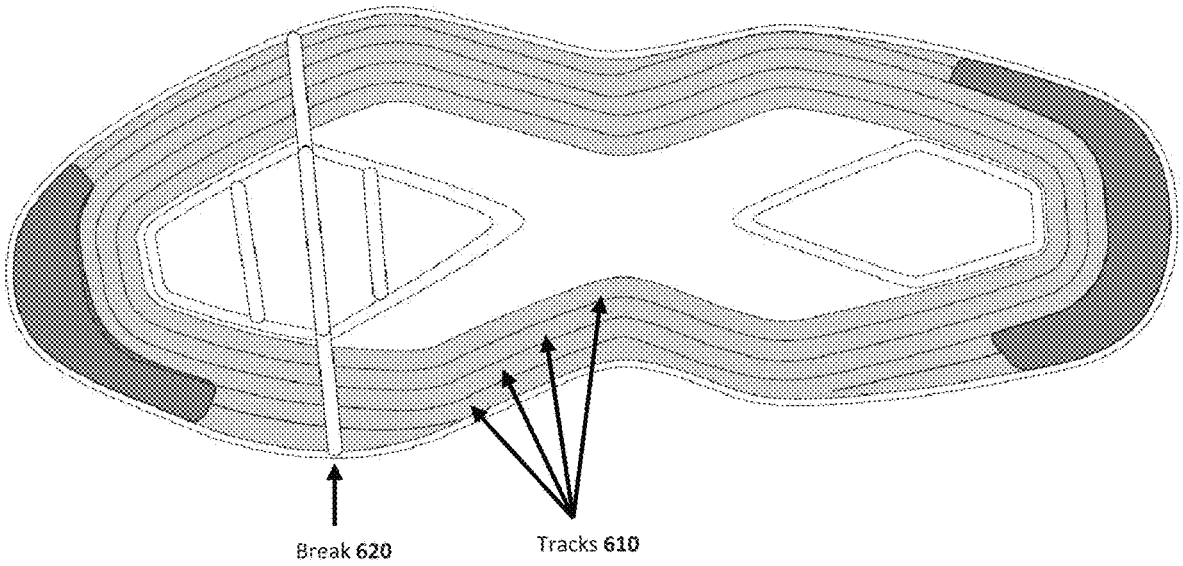

FIG. 6F illustrates an example of an outsole comprising a plurality of tracks 610 and a single break region 620. In some embodiments, the single break region 620 may be configured to extend laterally across the outsole to divide or segment the plurality of tracks 610. In some non-limiting embodiments, the single break region 620 may be located in a forefoot region of the shoe. The single break region 620 may be configured to provide a more localized and specific flex profile compared to the outsole track configuration shown in FIG. 6E.

Figure 6G:
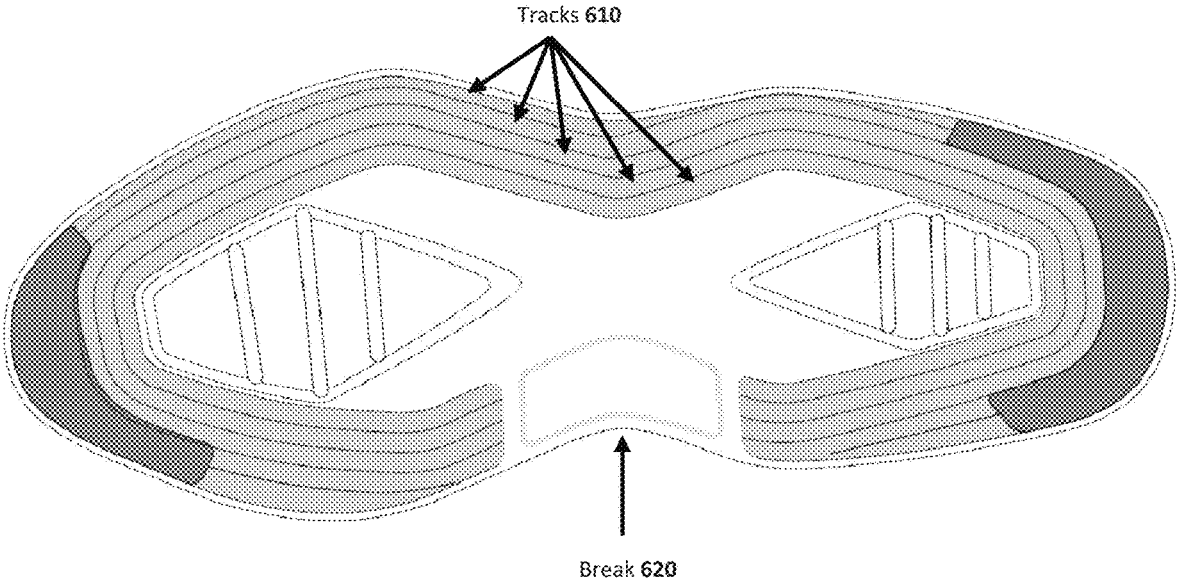

FIG. 6G illustrates another example of an outsole comprising a plurality of tracks 610 and at least one break region 620. The break region 620 may be strategically positioned and oriented to reduce a weight of the shoe in one or more select regions or zones. In some embodiments, the break region 620 may be located at or near a midfoot region of the outsole. In some embodiments, the at least one break region 620 may be located at or near a medial edge or a lateral edge of the outsole. In some embodiments, the break region 620 may have a shape or profile that complements the shape or profile of the track sections that are immediately adjacent to the break region 620. In some embodiments, the break region 620 may have a curvature that is similar to that of the sections of the tracks that are immediately adjacent to the break region 620.

Figure 6H:
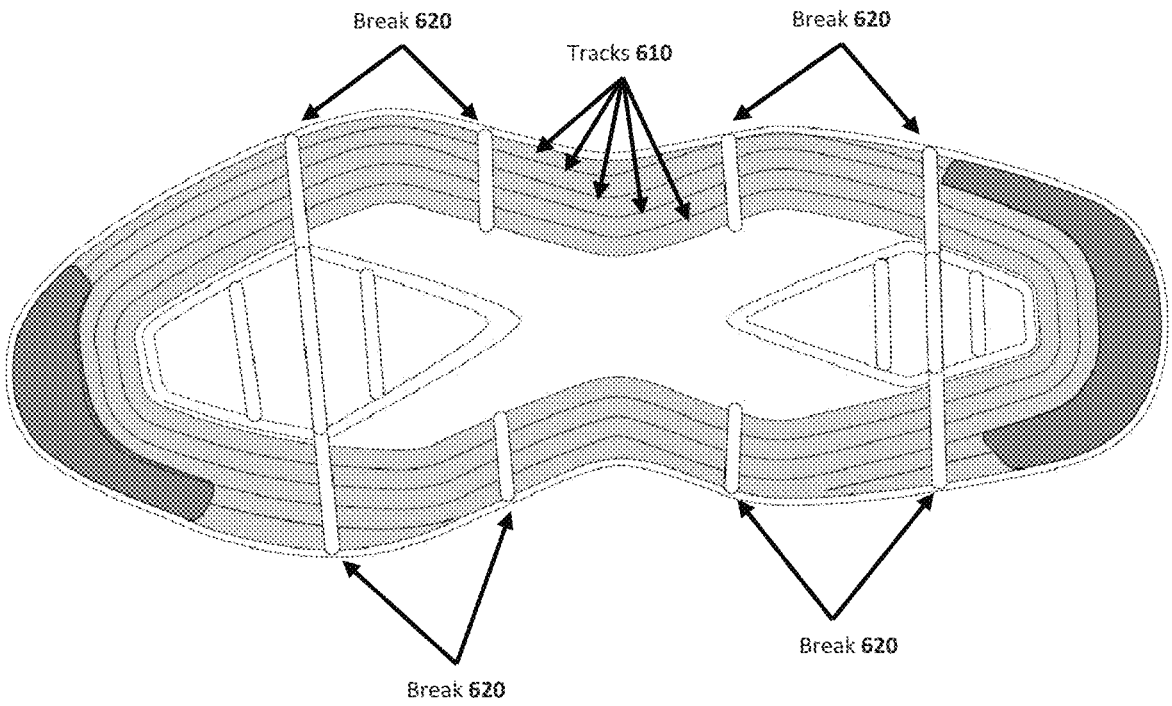

FIG. 6H illustrates an exemplary outsole comprising a plurality of tracks 610 and a plurality of break regions 620 dividing or segmenting the plurality of tracks 610 to create multiple independent outsole zones that are configured to move or flex relative to each other. In some embodiments, the break region(s) 620 may extend across a length or a width of the outsole (e.g., from a medial edge to a lateral edge of the outsole or vice versa). In some embodiments, the break region(s) 620 may extend across a select portion of the outsole containing the tracks 610 without extending across the central region of the outsole. In some non-limiting embodiments, the plurality of break regions 620 may have different dimensions depending on the location of the break regions 620 on the outsole. The different dimensions may include, for example, different lengths, widths, and/or depths.

Figure 6I:
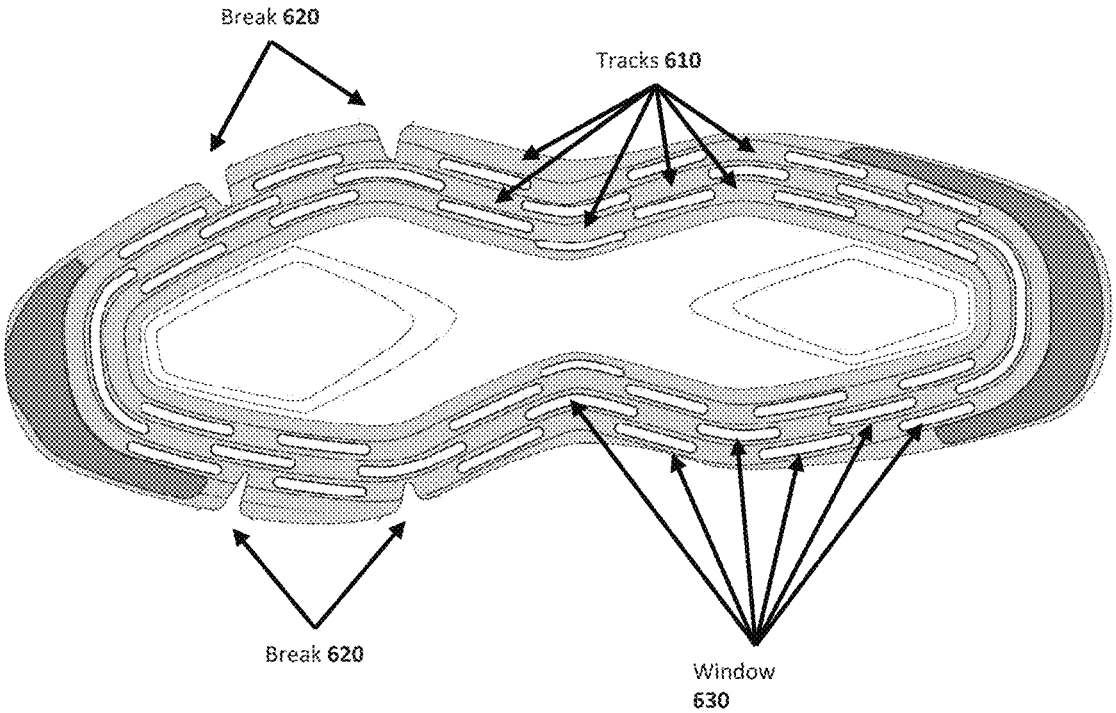

FIG. 6I illustrates another exemplary outsole comprising a plurality of tracks 610 and a plurality of break regions 620. In some non-limiting embodiments, the plurality of break regions 620 may comprise one or more notches. In some embodiments, the one or more notches may include one or more V-shaped notches located at or near a perimeter or an edge of the outsole. In some embodiments, the one or more notches may extend from the perimeter or edge of the outsole towards a central region of the outsole. In some embodiments, the one or more notches may extend across at least a portion of the tracks 610 to provide a softer flex response in one or more select regions (e.g., the forefoot region of the shoe).

In some embodiments, the outsole may further comprise one or more apertures or windows 630 positioned in front of and/or adjacent to one or more traction elements arranged along the tracks 610. In some embodiments, the one or more apertures or windows 630 may be configured to provide a 360 degree flex response along the entire length or pathway of the tracks 610. In some embodiments, the one or more apertures or windows 630 may be arranged along the plurality of tracks 610 (e.g., in a spaced apart and/or staggered configuration). In any of the embodiments described herein, the one or more apertures or windows 630 may be curved or non-linear to match a curvature of the tracks 610. In some embodiments, the one or more apertures or windows 630 may be implemented to reduce a weight of the shoe in one or more select locations or zones.

Figures 7A, 7B:
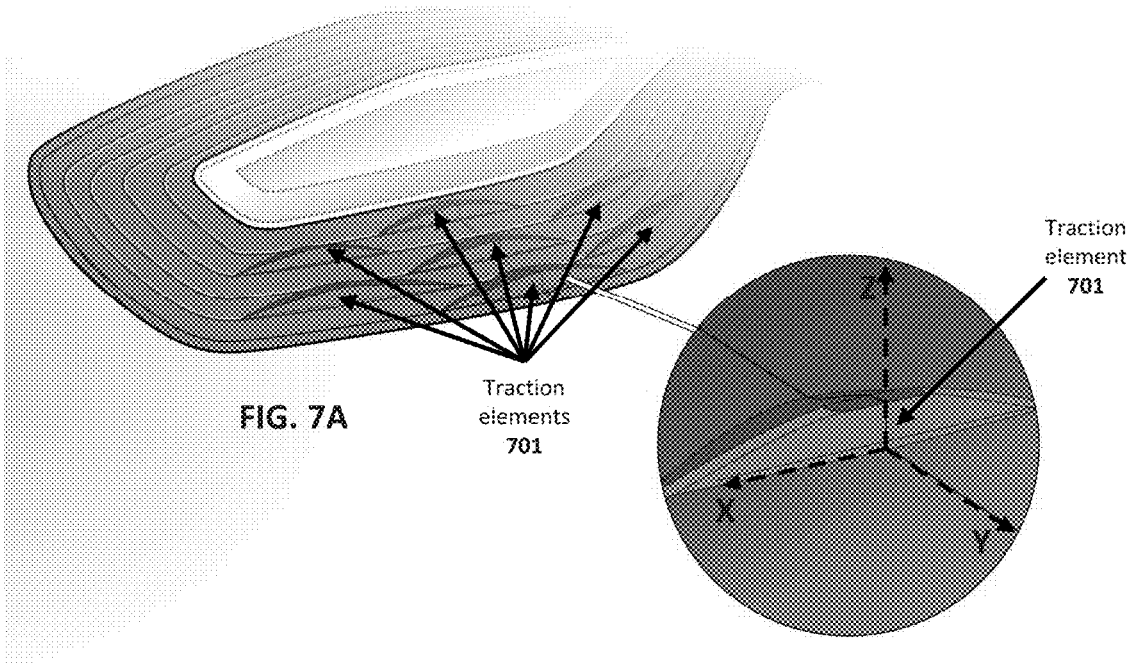
FIG. 7A schematically illustrates an enlarged view of an outsole having a track configuration for arranging a plurality of traction elements, in accordance with some embodiments.
FIG. 7B schematically illustrates an enlarged view of a traction element that can be provided on a golf shoe outsole, in accordance with some embodiments.

FIG. 7A illustrates an enlarged view of an exemplary outsole having a track configuration. The track configuration may allow for the positioning of various traction elements 701 in a staggered arrangement around the outsole as described elsewhere herein. FIG. 7B illustrates an enlarged view of a traction element 701 that can be provided on a golf shoe outsole. The shape or profile of the traction element 701 may be designed or based on the exemplary shapes and profiles shown in FIGS. 8A-8D, which are discussed in greater detail below. In some cases, the traction elements 701 shown in FIGS. 7A and 7B may include adaptive traction elements that are configured for both on course and off course use cases. In other cases, the traction elements 701 shown in FIGS. 7A and 7B may not or need not include adaptive traction elements that are configured for both on course and off course use cases.

Variations

In some embodiments, the plurality of traction elements may comprise two or more traction elements having different sizes and/or different shapes. In some embodiments, the size and/or shape of the traction elements arranged along a first track or pathway may change or vary along a portion of the first track or pathway. In some embodiments, the size and/or shape of the traction elements arranged along a second track or pathway may change or vary along a portion of the second track or pathway. In some embodiments, the traction elements arranged along the first track or pathway may have a different size and/or shape than the traction elements arranged along the second track or pathway.

In some embodiments, the plurality of traction elements may comprise two or more traction elements oriented in different directions. In some embodiments, an orientation or a directional bias of the plurality of traction elements may change or vary along a medial or lateral side of the shoe. In some embodiments, an orientation or a directional bias of the plurality of traction elements may change or vary along an anterior or posterior end of the shoe. In some embodiments, an orientation or a directional bias of the plurality of traction elements may gradually change or vary between (i) a medial or lateral side of the shoe and (ii) an anterior or posterior side of the shoe.

Figure 7C:
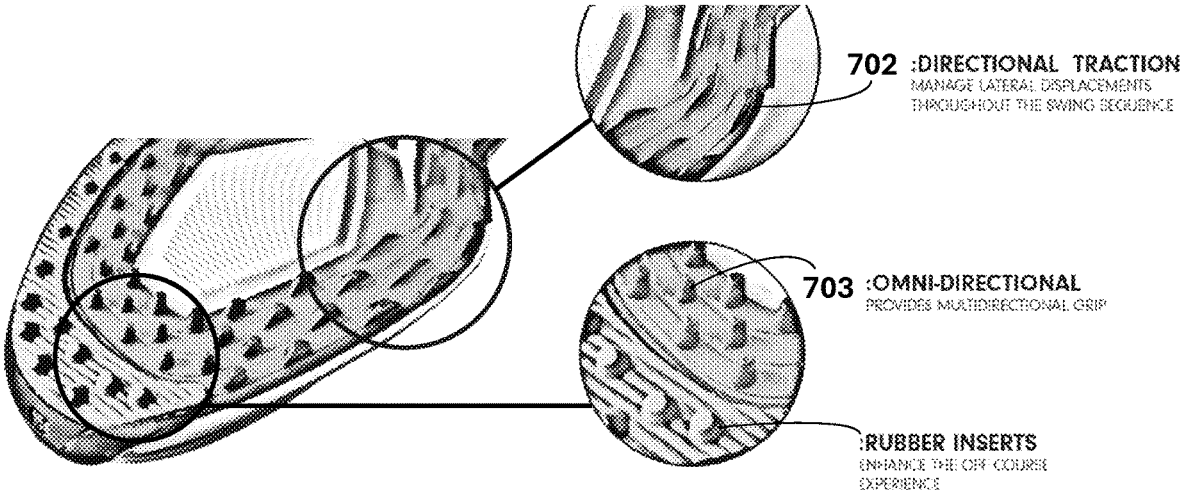
FIG. 7C schematically illustrates a golf shoe outsole having a plurality of directional and omni-directional traction elements, in accordance with some embodiments.

Referring to FIG. 7C, in some embodiments, the golf shoe may comprise a hybrid traction configuration that utilizes both directional traction elements 702 and omni-directional traction elements 703. In some cases, the directional traction elements 702 may be configured to manage lateral displacement of the shoe during a golf-related action (e.g., a golf swing). In some cases, the omni-directional traction elements 703 may be configured to provide multi-directional grip. The hybrid traction configuration may be implemented to manage multiple force vectors that are oriented in a plurality of different directions relative to the ground surface. The multiple force vectors may be managed by different sets or subsets of traction elements within the hybrid traction configuration.

In some non-limiting embodiments, the hybrid traction configuration may utilize one or more rubber inserts to further enhance off course comfort and traction performance. In some cases, the one or more rubber inserts may be positioned along an anterior or posterior end of the shoe outsole. In some cases, the rubber inserts may have a different size, shape, or material than the directional traction elements 702 and/or the omni-directional traction elements 703. In some embodiments, the rubber inserts may remain in a flat or substantially flat configuration in order to provide a greater contact area ratio with the ground, thereby enhancing off-course grip for certain surfaces such as smooth and/or hard cement surfaces.

Materials

In some embodiments, the traction elements can be made of any suitable material such as rubber or plastics and/or any combinations thereof. In some cases, thermoplastics such as nylons, polyesters, polyolefins, and polyurethanes can be used. In some cases, a polymer-based material may be used (e.g., any material derived from linking various molecular units or monomers). Alternatively or in addition, various rubber materials can be used, including, for example, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, and/or nitrile rubber.

In some embodiments, the traction elements may comprise a rigid or semi-rigid material. In some embodiments, the traction elements may comprise a deformable or elastic material. In some embodiments, the traction elements may be configured to bend or flex in response to a force exerted on the shoe by a subject (e.g., a golfer) during a golf-related movement or action.

In some embodiments, the traction elements may comprise a rubber material. The rubber material may have a modulus of elasticity ranging from about 1 megapascal (MPa) to about 10 MPa. In some instances, the rubber material may provide a greater traction stiffness than a thermoplastic polyurethane (TPU) material having a greater modulus of elasticity than the rubber material. For example, in instances where coefficient of friction (COF) has a more significant impact on traction stiffness, rubber can provide superior traction stiffness compared to other TPU materials, despite having a lower modulus of elasticity than TPU.

In some embodiments, the material for the traction elements may be selected based on the material modulus of elasticity of the material and/or the material coefficient of friction of the material on a ground surface. For on-course performance, the traction element material can be selected to minimize traction element bending through a large modulus of elasticity (E) while providing resistance to sliding by way of a large coefficient of friction (COF). In some embodiments, the traction elements may have a modulus of elasticity ranging from about 1 megapascal (MPa) to at least about 1 gigapascal (GPa) or more. In some cases, the traction elements may comprise a soft material such as natural rubber, which may have a modulus of elasticity of about 2 MPa. In some cases, the traction elements may comprise a TPU material with a modulus of elasticity of at least about 2 GPa. In some cases, the traction elements may comprise a hard plastic material such as Nylon 6, which can have a modulus of elasticity up to about 3 GPa. In some embodiments, the coefficient of friction between the traction elements and an off course ground surface may range from about 0.4 to about 0.6. In other embodiments, the coefficient of friction between the traction elements and an off course ground surface may range from about 0.4 to about 0.7. In some alternative embodiments, the coefficient of friction between the traction elements and an off course ground surface may range from about 0.4 to about 0.8. When used on course, the traction elements of the present disclosure may provide a traction stiffness in the antero-posterior direction ranging from about 80 N/mm to about 120 N/mm depending on the type of turf and the conditions of the turf. When used on course, the traction elements of the present disclosure may provide a traction stiffness in the medial-lateral direction ranging from about 60 N/mm to about 80 N/mm depending on the type of turf and the conditions of the turf.

In some cases, higher modulus materials can provide lower coefficients of friction, especially on wet surfaces. In some cases, the traction elements disclosed herein can be optimized by utilizing a multi-material approach. For example, at least one high modulus material can be used to reduce traction element bending, and at least one low modulus material can be used to increase friction between the outsole material and a turf surface.

In one aspect, the present disclosure provides various high performance traction solutions utilizing both mechanical interlock and friction. In some embodiments, the traction solutions may utilize traction elements individually composed of either a high modulus material or a low modulus material and strategically positioned on the outsole to gain function for swinging a golf club, walking on course, and/or walking off-course. In other embodiments, the traction solutions may utilize (i) greater height high modulus traction elements that resist bending and provide mechanical interlock, dispersed with (ii) lower, flatter, wider low modulus traction elements that enhance friction. In some alternative embodiments, the traction solutions may utilize traction elements with a high modulus core coated with a high friction material. In some optional embodiments, the traction elements can be high modulus while the base surface of the outsole is a high friction, softer material. In some cases, the base surface may also have added geometry to further enhance grip. In other optional embodiments, the coating applied to the traction elements can spatially vary across the outsole to further optimize the role of mechanical interlock versus friction. In any of the embodiments described herein, the traction stiffness provided by the traction elements of the present disclosure may be enhanced by utilizing a material or a traction element configuration that optimizes a coefficient of friction between the traction element and the ground surface engaged by the traction element during one or more modes of traction as described herein.

Material Properties

In any of the embodiments described herein, the material properties of the traction elements may be tuned to optimize traction response upon contacting a ground surface. The material properties may include, for example, a hardness, softness, stiffness, rigidity, and/or tensile strength of the traction elements. In any of the embodiments described herein, the various traction elements may have a different hardness, softness, stiffness, rigidity, and/or tensile strength in order to enhance the overall traction performance of the shoes described herein.

In some embodiments, the hardness of the traction elements may be tuned to optimize traction response upon contacting a ground surface. In some cases, the individual traction elements can deform differently when pressed against a ground surface. For example, a first traction element may have a relatively low hardness that is optimal for maximizing traction with a hard, wet surface, and a second traction element may have a relatively high hardness making it optimal for maximizing traction with soft natural grass.

In some embodiments, one or more of the traction elements may comprise a relatively hard thermoplastic polyurethane composition having a hardness greater than a threshold hardness. In some embodiments, one or more of the traction elements may comprise a relatively soft thermoplastic polyurethane composition having a hardness that is equal to or less than the threshold hardness. In some cases, the threshold hardness may be at most about 50 Shore A, about 60 Shore A, about 70 Shore A, or about 80 Shore A.

In any of the embodiments described herein, the material properties of the traction elements may be optimized or adjusted to complement or enhance the material properties of various regions of the insole, the midsole, and/or the outsole, thereby improving the overall performance of the shoes described herein. The material properties may include, for example, a hardness, stiffness, rigidity, and/or tensile strength of the insole, the midsole, and/or the outsole.

In some embodiments, the material properties of the traction elements may change or vary depending on the location the traction elements on the shoe outsole. In some embodiments, the material properties of the traction elements may change or vary depending on the material properties of various sections of the insole, the midsole, and/or the outsole that are adjacent or proximal to the traction elements. The material properties may include, for example, a hardness, stiffness, rigidity, and/or tensile strength of the insole, the midsole, and/or the outsole.

In some non-limiting embodiments, the traction element may comprise a multi-material composition. The multi-material composition may comprise a plurality of materials each having a different density. In some embodiments, the multi-material composition may comprise a structural core and one or more layers around the structural core. In some embodiments, the material of the structural core may have a higher density than the one or more layers. In some embodiments, the material of the one or more layers may have a lower density than the material of the structural core. In some embodiments, the material of the one or more layers around the structural core may have a greater coefficient of friction than the material of the structural core when engaged with a ground surface.

Adaptive Traction

In another aspect, the present disclosure provides various examples and embodiments of adaptive traction elements that can allow a subject to wear a single pair of golf shoes that is comfortable both on course and off course, without sacrificing comfort, fit, or performance. Unlike the traction elements of conventional golf shoes, which are generally uncomfortable or impractical for use off course, the adaptive traction element designs and configurations described herein may provide a flexible solution for both on course and off course traction by utilizing a traction element that can adapt or deform to provide (1) a first horizontal and/or vertical cross-sectional area or dimension that is optimized for an on course surface and (2) a second horizontal and/or vertical cross-sectional area or dimension that is optimized for an off course surface. In some embodiments, the adaptive traction elements may adapt or deform to provide (1) a first horizontal and/or vertical contact area ratio that is optimized for an on course surface and (2) a second horizontal and/or vertical contact area ratio that is optimized for an off course surface.

In a related aspect, the present disclosure provides a golf shoe having a plurality of adaptive traction elements that can be arranged on the outsole of a golf shoe. The adaptive traction elements may be used for both on course and off course situations and applications, without requiring a manual change or modification to the traction elements already integrated with the golf shoe.

In some embodiments, the plurality of adaptive traction elements can be used to provide traction when used on a first type of ground surface while preserving comfort and walkability when used on a second type of ground surface. In some cases, the first type of ground surface may include, for example, grass, turf, dirt, soil, or sand. In some cases, the second type of ground surface may include, for example, cement, concrete, asphalt, tile, or wood.

In some cases, the adaptive traction elements may be configured to penetrate a first type of ground surface to form a mechanical interlock between the first type of ground surface and the adaptive traction elements. In such cases, the adaptive traction elements may be configured to resist deformation along one or more select directions and provide support or traction when one or more forces are exerted on the adaptive traction elements along the one or more select directions. In some cases, the one or more select directions may be oriented laterally towards a surface of the adaptive traction elements that faces a perimeter or edge of the shoe outsole.

In some cases, the adaptive traction elements may not or need not be configured to penetrate a second type of ground surface that is harder than the first type of ground surface. In such cases, the adaptive traction elements may be configured to deform in response to one or more forces (e.g., compressive forces) exerted on the shoe in or along one or more select directions. In some cases, the one or more select directions may be oriented vertically downwards towards the ground surface. In some cases, the deformation of the adaptive traction elements may involve a bending or a flexing of the traction elements to move towards or flatten against (i) the ground surface and/or (ii) a surface of the outsole on which the traction elements are disposed.

In some cases, the amount or degree of deformation of the adaptive traction elements in response to the compressive forces exerted on the shoe may be adjusted or modulated by selecting a particular midsole material having a desirable material property. The desirable material property may include, for example, a midsole material hardness. In some non-limiting embodiments, the midsole material hardness may range from about 50 Shore A to about 80 Shore A. In some non-limiting embodiments, a softer midsole material may enhance the amount or degree of deformation of the adaptive traction elements compared to a harder midsole material.

In some embodiments, the adaptive traction elements described herein may exhibit a directionally biased flex characteristic. For example, the adaptive traction elements may be configured to bend or flex in response to a force exerted in a first direction, and resist bending or flexing in response to a force exerted in a second direction. The directional bias of the adaptive traction elements may allow the traction elements to respond differently to different types of ground surfaces.

In some cases, the adaptive traction elements may resist bending or flexing when the adaptive traction elements are mechanically interlocked with the ground surface and a lateral force is exerted against the adaptive traction elements (e.g., during a golf swing). In other cases, the adaptive traction elements may readily bend or flex when the adaptive traction elements are positioned on a hard surface that does not allow mechanical interlocking, and a vertical force is exerted against the adaptive traction elements.

Traction Element Shapes

Half Moon Shape/Fanged Profile

In some non-limiting embodiments, the one or more adaptive traction elements may have a half moon shape or a fanged profile. FIGS. 7A, 7B, and 7C show various examples of adaptive traction elements having a half moon shape or a fanged profile. In some embodiments, the half moon shape or fanged profile may have one or more sloping sides that extend from a bottom surface of the outsole towards an apex region. The apex region may be located between the sloping sides and may be disposed at a further distance from the outsole than the sloping sides. In some cases, the apex region may be flat or substantially flat. In other cases, the apex region may be curved or sloped. Alternatively, or optionally, the apex region may be angled to form a point or an edge.

Figure 8A:
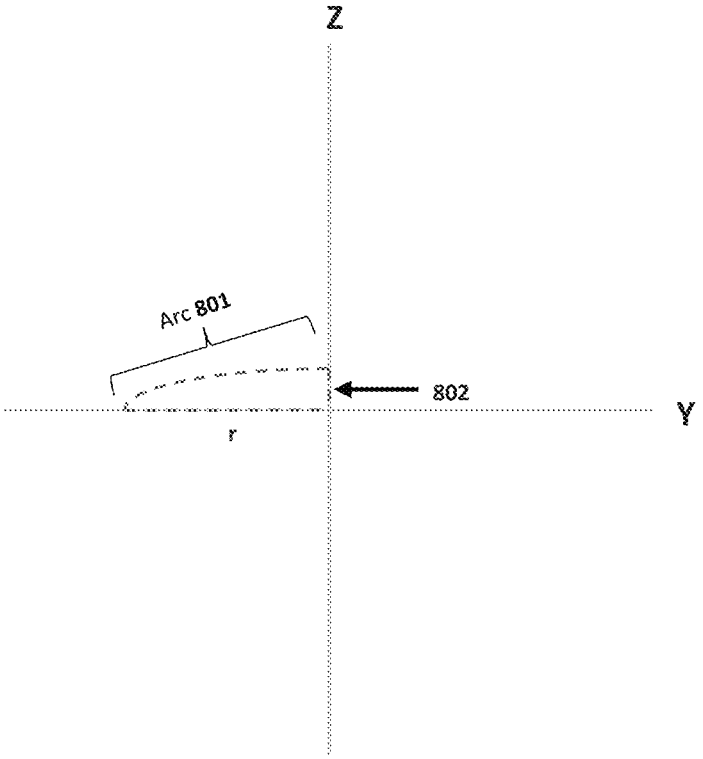
FIG. 8A schematically illustrates a vertical cross-section of an exemplary traction element, in accordance with some embodiments.

FIG. 8A shows an exemplary cross-sectional profile of an adaptive traction element having a half moon shape or a fanged profile. The cross-sectional profiles may be formed by dividing the traction element with a plane that extends through a vertical length of the traction element to bisect the traction element. The vertical plane may be, for example, a YZ-plane that is formed by the Y-axis and Z-axis as shown in FIG. 7B. The vertical cross-section of the traction element may reveal the side profile shown in FIG. 8A. The vertical plane may or may not extend through the apex region of the half moon shape or fanged profile.

In some embodiments, the vertical cross-sectional profile of the traction element may include an arc 801. The arc 801 may be bounded by two axis (e.g., the Y-axis and the Z-axis as illustrated in FIG. 8A) to define the two remaining sides that form the vertical cross-sectional profile of the traction element. In some embodiments, the vertical cross-sectional profile of the traction element may include a flat or substantially flat surface or side 802 that faces a medial or lateral edge of the shoe.

Figure 8B:
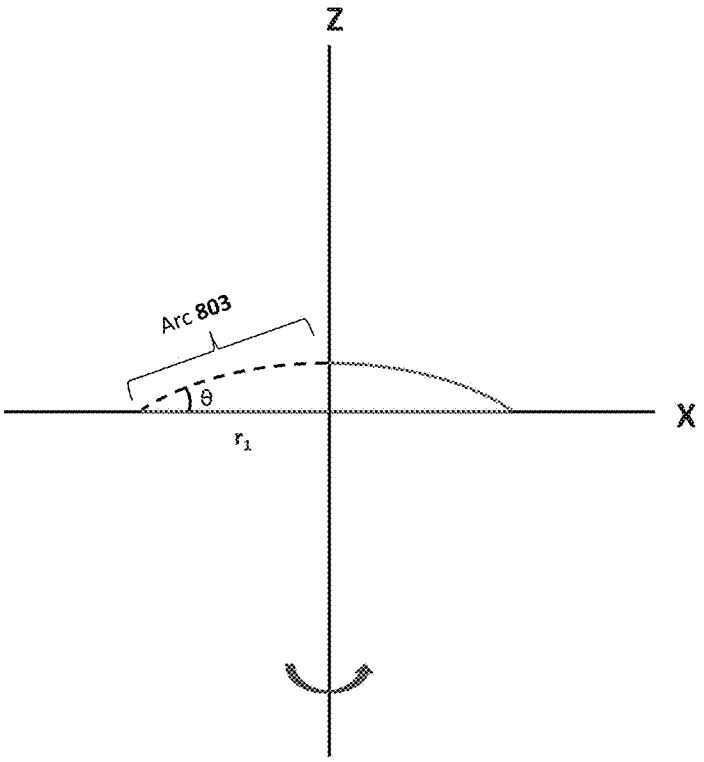
FIGS. 8B and 8C schematically illustrate various side views of a traction element, in accordance with some embodiments.
Figure 8C:
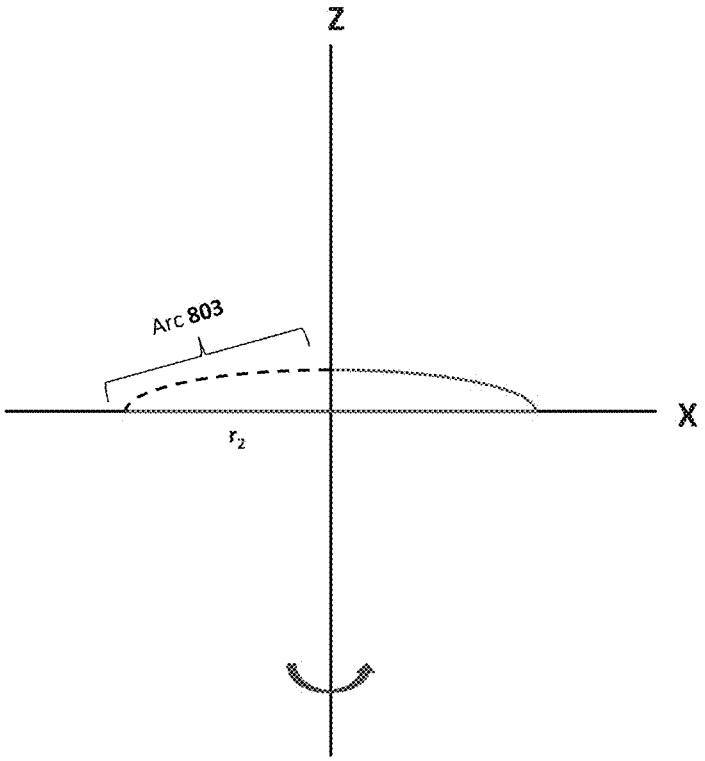

Referring to FIGS. 8B and 8C, in some cases, the half moon shape or fanged profile may be formed by rotating an arc 803 about a reference axis that lies on the vertical plane used to divide the traction element shown in FIG. 7B to reveal the vertical cross-sectional profile shown in FIG. 8A. In some cases, the arc 803 may be rotated 90 degrees clockwise and 90 degrees counterclockwise about the reference axis to form the half moon shape or fanged profile. In some cases, the arc 803 may be rotated 180 degrees about the reference axis. In some cases, the reference axis may be the Z-axis shown in FIG. 7B.

In some cases, the radius and/or the curvature of the arc may change as the arc 803 is rotated about the Z-axis. In some cases, as the absolute value of the angle of rotation about the Z-axis increases, the radius r of the arc 803 may gradually increase. In other cases, as the absolute value of the angle of rotation about the Z-axis decreases, the radius r of the arc 803 may gradually decrease.

In some non-limiting embodiments, the arc 803 may be represented or modeled using a function that is based on or associated with at least one of the following equations:

$$y = \log_a x, \text{ or}$$

$$y = \log_a(x + C_1) + C_2$$

The equations listed above are provided as non-limiting examples only, and it shall be noted that the variables or expressions used may be mathematically modified using any number of other variables, real number constants, or mathematical operators to yield a line segment that is rotatable about an axis to form the half moon shape or fanged profile. As discussed above, the radius r and/or the curvature of the arc 803 may change as the arc 803 is rotated about the Z-axis to form the half moon shape or fanged profile.

FIGS. 8B and 8C illustrate exemplary side views of the half moon shape or fanged profile that can be created when an arc 803 is rotated about a reference axis such as the Z-axis shown in FIG. 7B. The side views may correspond to a portion of the traction elements that faces an XZ-plane as shown in FIG. 7B. As discussed above, in some non-limiting cases, the radius r and/or the curvature of the arc 803 may change as the arc 803 is rotated about the Z-axis, and as such, the radii $r_1$ and $r_2$ shown in FIGS. 8B and 8C may be different than the radius r shown in FIG. 8A. However, in other non-limiting cases, the radius r and/or the curvature of the arc 801 may not or need not change as the arc 801 is rotated about the Z-axis, and as such, the radii $r_1$ and $r_2$ shown in FIGS. 8B and 8C may be equal or approximately equal to the radius r shown in FIG. 8A.

In some embodiments (e.g., as shown in FIG. 8B), the intersection between the sloping sides of the half moon shape or fanged profile and the shoe outsole (represented by the X-axis) may form an angle θ. In other embodiments (e.g., as shown in FIG. 8C), the intersection between the sloping sides of the half moon shape or fanged profile and the shoe outsole (represented by the X-axis) may form a curved section having a curvature that can be modeled as an arc (e.g., an elliptic arc, a parabolic arc, a hyperbolic arc, etc.).

Figure 8D:
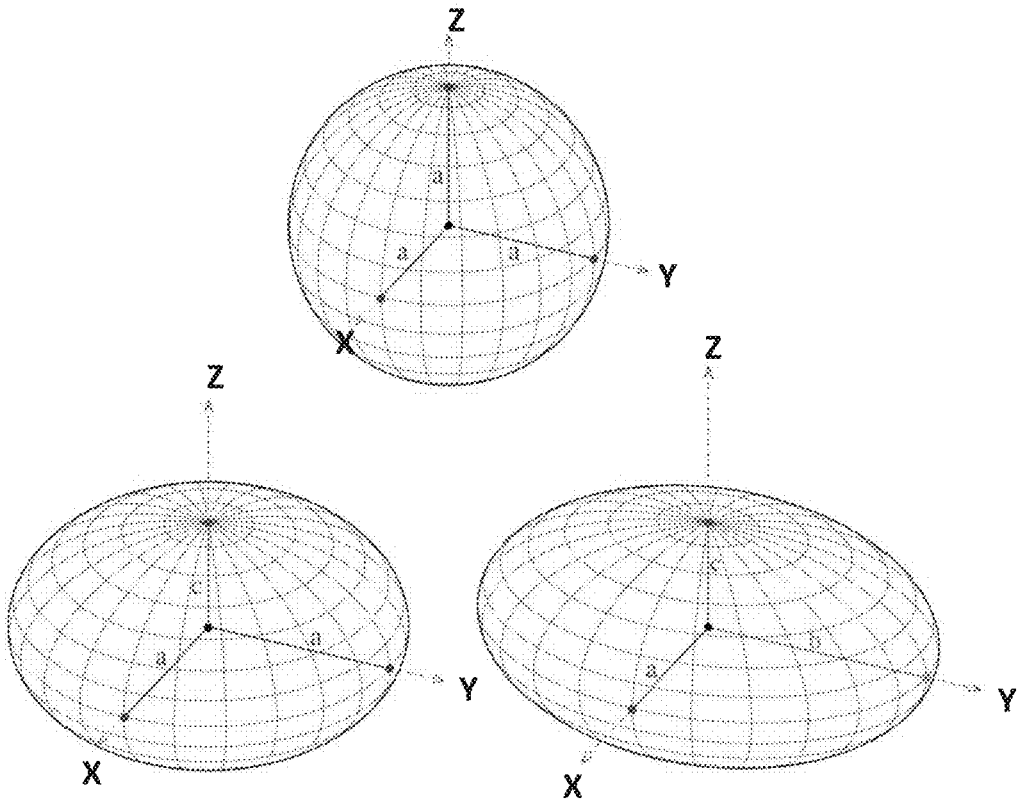
FIG. 8D schematically illustrates various examples of three-dimensional shapes that can be used to define or approximate a geometry of the half moon shape or fanged profile for the adaptive traction elements described herein.

FIG. 8D provides additional graphical references for deriving the shape or profile of the adaptive traction elements described herein. In some cases, the half moon shape or fanged profile may be formed by dividing a sphere, a spheroid, or an ellipsoid using two or more planes. The spheroid may comprise, for example, an oblate spheroid or a prolate spheroid. The ellipsoid may comprise, for example, a scalene ellipsoid or a triaxial ellipsoid. In some cases, the sphere, spheroid, or ellipsoid may be divided by two or more planes to yield the half moon shape or fanged profile.

The adaptive traction elements having the half moon shape or fanged profile described above may have a lateral cross-section. The lateral cross-section can be formed by dividing the sphere, a spheroid, or an ellipsoid using two or more orthogonal planes in three-dimensional space. In some cases, the lateral cross-section may be formed by taking a cross-section of the adaptive traction elements along an XY-plane and/or a YZ-plane. In some cases, the lateral cross-section may be formed by taking a cross-section of the adaptive traction elements along an XY-plane and/or an XZ-plane. In some cases, the lateral cross-section may be formed by taking a cross-section of the adaptive traction elements along a YZ-plane and/or an XZ-plane. In any case, the lateral-cross section may have a cross-sectional shape. In some non-limiting embodiments, the adaptive traction elements may have a concave cross section. In some cases, at least a portion of the concave cross section may be modeled as a concave arc. In other non-limiting embodiments, the adaptive traction elements may have a convex cross section. In some cases, at least a portion of the convex cross section may be modeled as a convex arc.

In some embodiments, the cross-sectional shape of the half moon shape or fanged profile may change or vary along a length, a width, or a height of the adaptive traction elements. In some embodiments, the change or variance in the cross-sectional shape may include a change in the curvature of or the angles between various portions or segments of the cross-sectional shape. In some embodiments, the change or variance in the cross-sectional shape may include a change in the size or the dimensions of various portions or segments of the cross-sectional shape.

In some embodiments, the various adaptive traction elements arranged along the pathways or tracks around the outsole may have different half moon shapes or fanged profiles depending on the position and/or orientation of the adaptive traction elements. In some cases, the size and/or shape of the half moon shapes or fanged profiles may vary for adaptive traction elements disposed within a same track or pathway (i.e., elements that are approximately equidistant from a neighboring track or pathway, or from a central region of the outsole or a perimeter or edge of the outsole). In some cases, the size and/or shape of the half moon shapes or fanged profiles may vary for adaptive traction elements disposed within different tracks or pathways (i.e., traction elements that are arranged along different neighboring tracks or pathways such that different sets or subsets of elements are positioned at different distances from a central region of the outsole or a perimeter or edge of the outsole).

In any of the embodiments described herein, the adaptive traction elements may comprise a ground contacting surface. The ground contacting surface may be located at or near a distal end of the traction elements. The distal end may correspond to a portion of the traction elements that is opposite a base portion of the traction elements. In some cases, the distal end may include an end of the traction elements that is furthest from the base portion. The base portion may correspond to a portion of the traction elements that is directly adjacent to the outsole.

In some embodiments, the ground contacting surface of the traction elements may comprise a flat or substantially flat surface. In some cases, the flat or substantially flat surface may be located at or near a peak or a plateau of the half moon shapes or fanged profiles described herein. In some cases, the flat or substantially flat surface may be formed by truncating a distal end of the presently described half moon shapes or fanged profiles with a lateral plane.

Figure 9A:
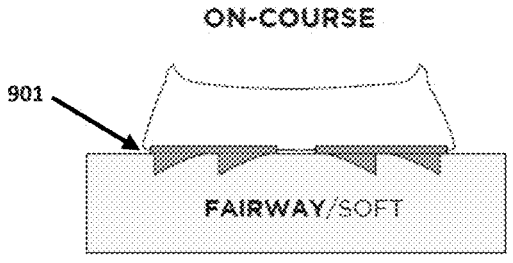
FIGS. 9A and 9B schematically illustrate another exemplary cross-sectional profiles that can be used for the adaptive traction elements of the present disclosure.
Figure 9B:
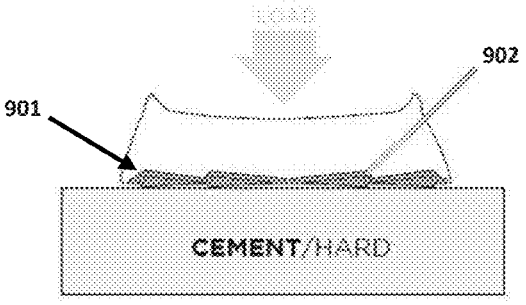

FIGS. 9A and 9B show additional examples of cross-sectional profiles that can be used to enhance the adaptability of the presently disclosed traction elements for both on course and off course use. As with the other adaptive traction elements described above, when the traction elements 901 shown in FIG. 9A are used on an on course surface (e.g., a fairway or any other soft ground surface), the traction elements 901 may penetrate the on course surface. Similar to the other embodiments described herein for adaptive traction elements, when the traction elements 901 shown in FIG. 9B are used off course (e.g., on cement or any other hard ground surface), the traction elements 901 may be configured to flatten under load. In some non-limiting embodiments, one or more strategically located grooves 902 may be provided to further promote or facilitate the flattening of the traction elements 901 against the shoe outsole when a load is exerted on the shoe. The grooves 902 may be placed in or on the outsole material towards a medial or lateral side or edge of the adaptive traction elements 901 as discussed in further detail elsewhere herein. In some non-limiting embodiments, the grooves 902 may be placed between adjacent traction elements 901.

Figure 10A:
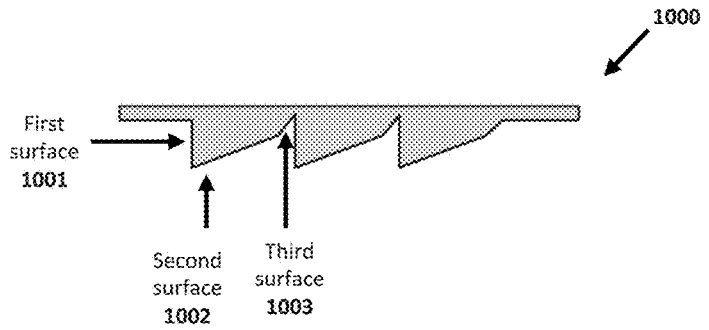
FIG. 10A schematically illustrates a side view of an exemplary set of adaptive traction elements for a golf shoe, in accordance with some embodiments.

FIG. 10A shows another exemplary cross-sectional profile for a set of adaptive traction elements 1000 as described herein. The cross-sectional profile may be defined by a plurality of surfaces that are disposed at various angles relative to each other.

In some embodiments, the adaptive traction elements 1000 may comprise a first surface 1001 that faces a perimeter or edge of the shoe. In some cases, the first surface 1001 may be flat or substantially flat. In some cases, the first surface 1001 may extend at an angle from a bottom most surface of the outsole. In some cases, the angle may be about 90 degrees. In some cases, the first surface 1001 may extend vertically downwards or substantially vertically downwards from a bottom most surface of the outsole.

In some embodiments, the adaptive traction elements 1000 may comprise a second surface 1002 that extends from the first surface (i) towards the bottom most surface of the outsole and/or (ii) towards a central region or portion of the shoe. In some cases, the intersection of the first surface 1001 and the second surface 1002 may form a pointed tip that is configured to penetrate a first type of ground surface to provide grip or traction. In some cases, the second surface 1002 may be disposed at an angle relative to the first surface 1001. In some cases, the angle may range from about 1 degree to at most about 90 degrees. The angle formed between the first surface 1001 and the second surface 1002 may facilitate the flexing or bending of the adaptive traction elements 1000 when used on a second type of ground surface that is harder than the first type of ground surface.

In some embodiments, the adaptive traction elements 1000 may comprise a third surface 1003 that extends from the second surface 1002 to the bottom most surface of the outsole. In some cases, the third surface 1003 may be disposed at an angle relative to the second surface 1002. In some cases, the angle may range from about 90 degrees to about 180 degrees. The angle formed between the second surface 1002 and the third surface 1003 may facilitate the flexing or bending of the adaptive traction elements 1000 when used on a second type of ground surface that is harder than the first type of ground surface.

Figure 10B:
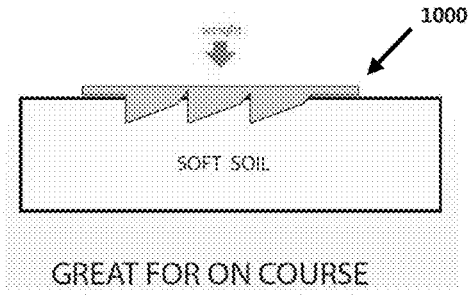
FIGS. 10B and 10C schematically illustrate the adaptability of the presently disclosed traction elements for both on course and off course surfaces.

In any of the embodiments described herein, the pointed end formed by the intersection of the first surface 1001 and the second surface 1002 may be configured to penetrate a first type of ground surface to form a mechanical interlock with the first type of ground surface. As shown in FIG. 10B, the first type of ground surface may have a softness and/or density that allows the pointed end to penetrate into the ground surface without causing the adaptive traction element 1000 to flex or bend towards the outsole due to vertical compressive forces. In some cases, the first type of ground surface may have a softness and/or density that allows the pointed end to penetrate into the ground surface while limiting or reducing the amount or degree of flexing or bending of the adaptive traction element 1000 due to vertical compressive forces.

Figure 10C:
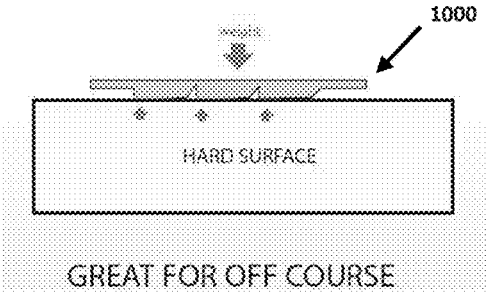
Figure 10D:
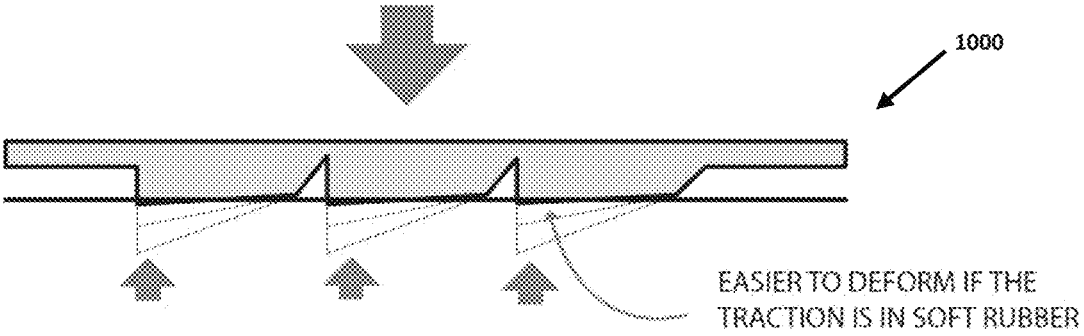
FIG. 10D schematically illustrates a deformation of an adaptive traction element on an off course surface, in accordance with some embodiments.

In some embodiments, the pointed end formed by the intersection of the first surface 1001 and the second surface 1002 may not or need not be configured to penetrate a second type of ground surface to form a mechanical interlock with the second type of ground surface. As shown in FIGS. 10C and 10D, the second type of ground surface may have a hardness and/or density that prevents penetration by the pointed end so that the traction elements 1000 deform when a load is applied to the shoe. The deformation of the traction elements 1000 can provide a high contact area ratio for the traction element when the shoe is worn on the second type of ground surface, which can increase the effect of frictional forces on traction performance. The second type of ground surface may have a hardness and/or density that induces the adaptive traction elements 1000 to flex or bend towards the outsole in response to vertical compressive forces. In some cases, the flexing or bending of the adaptive traction elements 1000 towards the outsole can cause the adaptive traction elements 1000 to substantially flatten against the outsole during contact with a second type of ground surface that is harder than the first type of ground surface.

Figure 11A:
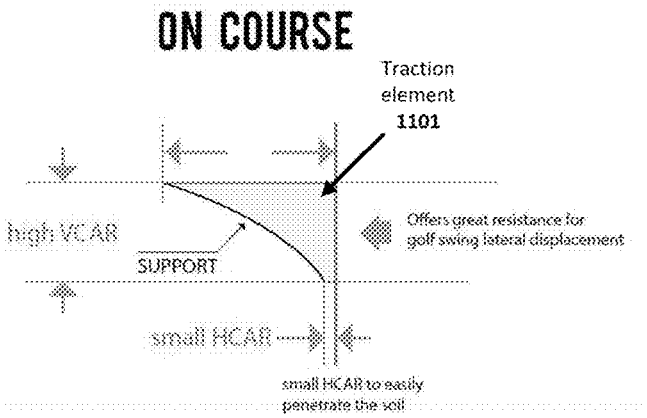
FIGS. 11A and 11B schematically illustrate various adaptable profiles for a traction element configured for both on course and off course use.
Figure 11B:
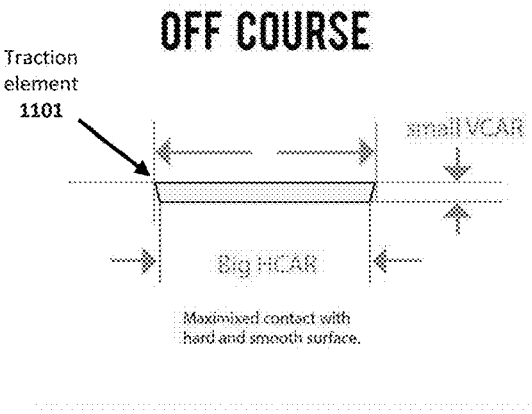

FIGS. 11A and 11B illustrate the different cross-sections of an adaptive traction element 1101 when used on an on course surface and an off course surface. As shown in FIG. 11A, the traction element 1101 may have a high vertical contact area ratio (VCAR) and a low horizontal contact area ratio (HCAR). As used herein, the term "VCAR" may refer to the ratio of the vertical surface contact area between the ground and the portion of each traction member area that penetrates into the ground and that is normal to the direction of horizontal ground reaction forces, divided by the total net area of that same specified portion of outsole area. As used herein, the term "HCAR" may refer to the ratio of the sum horizontal surface contact area between the traction members and the hard, flat surface with regard to any specified portion of outsole area, divided by the total net area of that same specified portion of outsole area. In some instances, it can be desirable to maximize the VCAR of a shoe and/or to minimize the HCAR of the shoe. For example, for on course applications, the shoe may have a high VCAR and/or a low HCAR to maximize penetration of the ground surface while providing greater resistance to lateral movement or displacement during a golf swing. In such cases, the adaptive traction elements 1101 may be configured to have a relatively large height and a relatively small cross-sectional area so that they can better penetrate on course ground surfaces.

As shown in FIG. 11B, in some instances, it can be desirable to maximize the HCAR of a shoe while minimizing the VCAR of the shoe. For example, for "off-course" applications, the shoe may have a high HCAR and/or a low VCAR to maximize the amount of frictional contact with the off course surface. This can help to improve the slip-resistance properties of the outsole (e.g., on hard or smooth surfaces). In such cases, the adaptive traction elements 1101 may be configured to have a relatively large width and a relatively low height to better grip hard or smooth surfaces. In any of the embodiments described herein, the adaptive traction elements may be configured to seamlessly shift between the two profiles shown in FIGS. 11A and 11B (and/or any intermediary profiles between those shown in the accompanying figures) in order to provide different traction characteristics based on the type of surface on which the golf shoe is worn. In any of the embodiments described herein, the traction elements may adapt to different surface types without any manual intervention by the subject wearing the golf shoe.

Figure 12A:
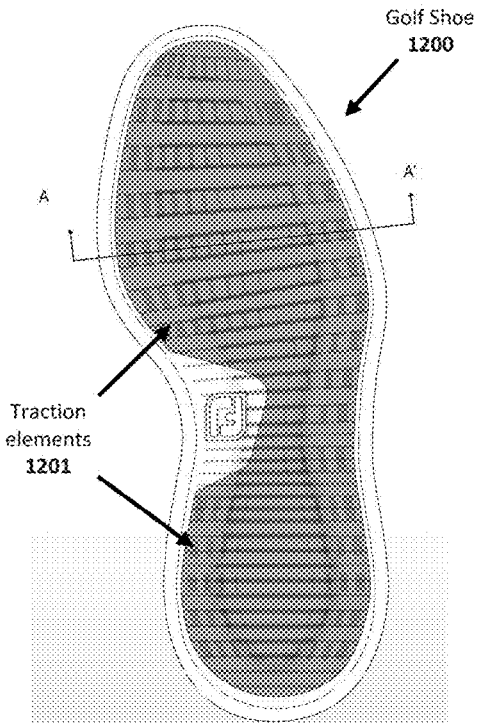
FIG. 12A schematically illustrates a golf shoe outsole with one or more adaptive traction elements, in accordance with some embodiments.
Figure 12B:
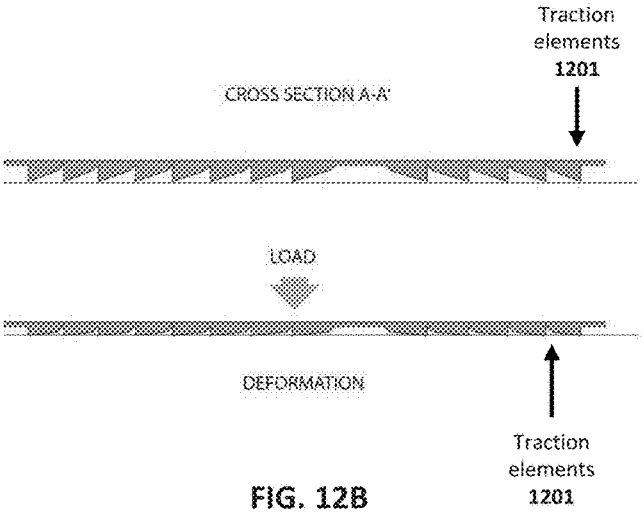
FIG. 12B schematically illustrates a deformability of the adaptive traction elements disclosed herein.

FIG. 12A schematically illustrates an exemplary golf shoe outsole 1200 with one or more adaptive traction elements 1201. As shown in FIG. 12B, the adaptive traction elements 1201 may be configured to deform under load when used on a hard surface (e.g., an off course surface as described elsewhere herein). In some embodiments, when the adaptive traction elements 1201 deform under load (e.g., as a subject executes an action or movement on an off course surface), the height of the adaptive traction elements 1201 may decrease, and the surface area of the traction elements that is in contact with the ground surface may increase to maximize friction-based traction.

Features

In some optional embodiments, the outsole surface may comprise one or more features that aid a deformation (e.g., flexing or bending) of the adaptive traction elements when the traction elements are used on an off course surface. The deformation may allow the adaptive traction elements to move towards the outsole surface and flatten for a more comfortable off course experience. The one or more features may include, for example, one or more openings, cutouts, grooves, channels, or depressions in the outsole material.

In some embodiments, the one or more features may be positioned adjacent to the adaptive traction elements. In some embodiments, the one or more features may directly border one or more sides or edges of the adaptive traction elements. The one or more features may allow the one or more sides or edges of the traction elements to remain detached from a portion of the outsole material, to enhance the deformability or flexibility of the traction elements in response to forces exerted on the shoe.

In any of the embodiments described herein, the adaptive traction elements may be configured to move relative to the one or more features when a force is exerted on the shoe. In some cases, the portions or sections of the adaptive traction elements that are detached from the outsole material may be configured to move upwards towards the outsole in response to various forces exerted on the shoe. In some cases, the one or more adaptive traction elements may be configured to move through a portion or volume of the outsole material in order to flatten against the outsole of the golf shoe. As discussed herein, the flattening of the adaptive traction elements against the shoe outsole may improve comfort and wearability of the golf shoes off course.

Figure 13A:
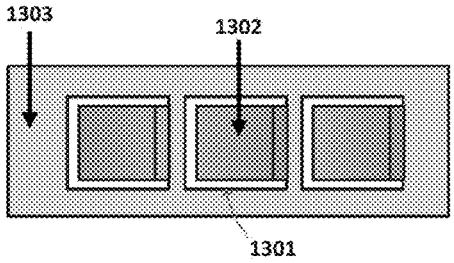
FIG. 13A schematically illustrates a top view of a set of adaptive traction elements, in accordance with some embodiments.

FIG. 13A illustrates an example of an outsole comprising one or more features 1301 for enhancing a deformability of one or more adaptive traction elements 1302. The one or more features 1301 may comprise an opening, cutout, groove, channel, or depression in the outsole 1303. In some cases, the one or more features 1301 may be positioned around an edge or a perimeter of the adaptive traction elements 1302. In some cases, the one or more features 1301 may extend around an edge or a perimeter of the adaptive traction elements 1302. In any case, at least one edge or side of the adaptive traction elements 1302 may be directly connected to the outsole 1303.

Figure 13B:
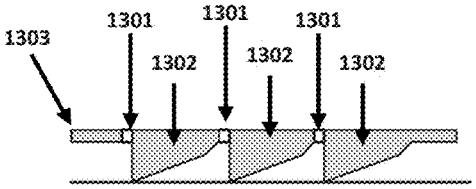
FIG. 13B schematically illustrates a side view of an exemplary golf shoe outsole comprising the adaptive traction elements shown in FIG. 13A.

FIG. 13B illustrates a side view of a plurality of adaptive traction elements 1302 that are arranged on the shoe outsole 1303. In some embodiments, the adaptive traction elements 1302 can be spaced apart along a track or pathway as described elsewhere herein. In some embodiments, the one or more features 1301 may be disposed or interspersed between adjacent or neighboring traction elements 1302.

Figure 13C:
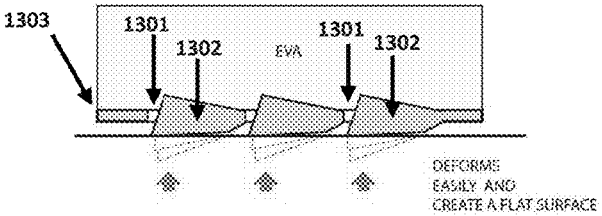
FIG. 13C schematically illustrates one or more adaptive traction elements that are movable through a portion of a shoe outsole, in accordance with some embodiments.

FIG. 13C illustrates an ability of the adaptive traction elements 1302 shown in FIGS. 13A and 13B to move through a portion of a golf shoe outsole 1303. In some embodiments, the one or more features 1301 may reduce an amount of material connecting the adaptive traction elements 1302 and the golf shoe outsole 1303. Reducing the amount of material connecting the adaptive traction elements 1302 and the golf shoe outsole 1303 may further enhance the deformability, flexibility, or bendability of the traction elements 1302 so that the traction elements can respond and adapt accordingly to different surfaces, including on course and off course surfaces. As described elsewhere herein, the adaptive traction elements 1302 may penetrate on course ground surfaces to mechanically interlock with the on course ground surface, and flatten towards the golf shoe outsole 1303 under load when worn on an off course surface that is harder than the on course surface.

Additional Embodiments

In another aspect, the present disclosure provides various examples and embodiments of golf shoes comprising one or more traction elements provided on the outsole(s) of the golf shoes. In some cases, the outsole(s) may comprise an outsole component from which the one or more traction elements can extend. In some cases, the outsole component may comprise a surface portion of the outsole. In some cases, the outsole component may comprise one or more pods provided on or integrated with the surface of the outsole.

In some embodiments, the one or more pods may be configured to provide a base region from which the one or more traction elements can extend. In some cases, the base region may serve as an intermediate physical interface between the surface of the outsole and the body of the traction elements. In some cases, the base region may be configured to fix a position and/or an orientation of the traction elements relative to the outsole or the ground surface in order to promote a mechanical interlock between the traction elements and the ground surface.

In some embodiments, the one or more pods may comprise a depression or a recess extending into the outsole material. In some cases, the one or more traction elements may be configured to extend from the depression or recess towards the ground surface under the shoe. In some embodiments, the one or more pods may comprise a protrusion extending from the surface of the outsole towards the ground surface. In some cases, the one or more traction elements may be configured to extend from a bottom surface of the protrusion towards the ground surface.

In some cases, the one or more pods may comprise a first material. In some cases, the one or more traction elements may comprise a second material. In some cases, the first material may have a greater hardness, firmness, stiffness, or tensile strength than the second material. In some cases, the second material may have a greater frictional coefficient (e.g., when moving or sliding along an on course ground surface) than the first material. In some non-limiting embodiments, the first material may comprise carbon or a carbon based material (e.g., carbon fiber). In some non-limiting embodiments, the second material may comprise a rubber material, a plastic material, or a thermoplastic material (e.g., TPU).

In some embodiments, the one or more pods may comprise a relatively high modulus material that can provide additional structural support for the traction elements. In some cases, the material for the one or more pods can help to reduce traction element bending at or near the base of the traction elements. As described elsewhere herein, the base of the traction elements may refer to a portion of the traction elements that is directly adjacent to or in direct contact with the outsole or the one or more pods integrated with the outsole. The base of the traction elements may be disposed opposite a free end of the traction elements, which free end may be configured to directly contact and interact with the ground surface. In some embodiments, the one or more traction elements may comprise a material configured to provide slip resistance when the mechanical interlock between the traction elements and the ground surface decreases below a certain threshold. In some cases, the material for the traction elements may have a high frictional coefficient to increase the grip between the traction elements and the ground surface (e.g., when the mechanical interlock between the traction elements and the ground surface is reduced or compromised during a golf-related action or movement).

In some embodiments, the one or more pods may be directly affixed to the outsole. In other embodiments, the one or more pods may be integrally formed with the outsole or formed as part of the outsole. In some cases, the one or more pods may be releasably coupled to the outsole. In other cases, the one or more pods may not or need not be releasably coupled to the outsole.

In some embodiments, the one or more traction elements may be directly affixed to the one or more pods. In other embodiments, the one or more traction elements may be integrally formed with the one or more pods. In some cases, the one or more traction elements may be releasably coupled to the one or more pods. In other cases, the one or more traction elements may not or need not be releasably coupled to the one or more pods.

Greens Preservation

In another aspect, the present disclosure provides various examples and embodiments of traction elements that are configured to reduce or minimize an amount of damage to a ground surface (e.g., an on course surface) when a subject executes a golf-related movement on the ground surface. The golf-related movement may include actions such as walking, running, crouching, or swinging a golf club. In some cases, the golf-related movement may include a translational motion and/or a rotational motion of the traction elements relative to the ground surface. In some cases, the golf-related movement may involve one or more ground reaction forces ranging from about 100 Newtons (N) to about 1000 N or more.

In some embodiments, the traction elements may be individually sized and shaped as described elsewhere herein to preserve a quality or characteristic of the ground surface. In some embodiments, the traction elements may be collectively arranged and spaced apart or staggered according to the optimal spatial configurations described herein in order to preserve a quality or characteristic of the ground surface. In some cases, the quality or characteristic may include a ball roll distance for a golf ball traversing the ground surface. In some cases, the quality or characteristic may include a smoothness or a roughness of the ground surface. In some embodiments, the traction elements may be configured to reduce an amount of turf that adheres to the outsole or an amount of turf that is removed from the ground surface after a subject performs or executes a golf-related action or movement.

In some embodiments, the traction element configurations described herein may be implemented to preserve a quality or characteristic of the ground surface over a period of time ranging from about 1 day to about 7 days or more. In some embodiments, the presently disclosed traction element configurations may be implemented to preserve a quality or characteristic of the ground surface over the course of at least about 10 or more golf-related movements or actions. In some cases, the traction elements of the present disclosure may be configured to preserve a quality or characteristic of an on course ground surface for a longer period of time and over the course of a greater number of golf-related movements or actions compared to conventional traction element configurations. In some non-limiting embodiments, the greens preservation performance of the presently disclosed traction element configurations may exceed that of conventional traction element configurations by at least about 5%, 10%, 15%, 20%, 25%, 30%, 35%, 40%, 45%, 50%, 55%, 60%, 65%, 70%, 75%, 80%, 85%, 90%, 95%, 100%, 200%, 300%, 400%, 500%, or more.

In some embodiments, the traction elements of the present disclosure may be configured to provide a golf shoe with a surface preservation metric ranging from about 0% to about 100%.

In some embodiments, the surface preservation metric may be computed based on one or more factors indicating (i) an amount of measurable or perceivable damage to a ground surface over a pre-determined period of time or after a pre-determined number of golf-related actions or movements are executed on the ground surface, or (ii) a magnitude of a change in a quality or a characteristic of the ground surface after a certain number of golf-related movements or actions are executed on the ground surface.

Methods

In an aspect, the present disclosure provides a method for designing or configuring traction elements. In some embodiments, the method may involve designing or configuring the traction elements for a particular subject or class of subjects by adjusting one or more traction parameters. The one or more traction parameters may include, for example, a shape, a size, a configuration, or an arrangement of one or more traction elements. The one or more traction parameters may be adjusted based on an individual subject's anatomy or biomechanics for golf-related actions to optimize traction stiffness. In some cases, the one or more parameters may include a dimension (e.g., height, width, length, depth, taper, etc.) of the traction elements. In some cases, the one or more parameters may include a position or an orientation of the traction elements on the outsole and/or a position or an orientation of the traction elements relative to one another.

In some embodiments, the method may comprise controlling an operation of a machine or system to produce or manufacture the traction elements or a shoe component having the traction elements integrated therewith. The shoe component may include, for example, an outsole of the shoe. The operation of the machine or system may be controlled based on the one or more traction parameters. The one or more traction parameters may be adjusted or modified for a particular subject based on his or her anatomy or biomechanics.

In any of the embodiments described herein, the various traction parameters may be used to control a manufacturing process for producing a set of traction elements that can be arranged on a shoe outsole. In some embodiments, the traction parameters can be used to control the operation of a system or machine comprising a processing unit (e.g., a computer, a processor, a logic circuit, etc.). In some embodiments, the processing unit may be configured to control or adjust an operation of the machine or system based on the one or more traction parameters selected for a particular subject. In some cases, the one or more traction parameters may be set by an operator of the machine or system. In other cases, the one or more traction parameters may be set or determined by an algorithm or an artificial intelligence or machine learning based system.

Multi-Stance/Multi-Swing/Multi-Shot Traction

In some embodiments, the shoes disclosed herein may comprise an outsole with traction members that are arranged and/or configured to provide multi-stance, multi-swing, and/or multi-shot traction performance. In some cases, the traction members may be configured to provide traction during golf-related actions or movements that are initiated or executed using different stances. In some cases, the traction members may be configured to provide traction during golf-related actions or movements involving a variety of different biomechanical actions or sequences that can result in different types of swings and/or different types of shots.

In some cases, the golf-related actions or movements may involve multiple golf swings executed by a subject in different stances, multiple different types of golf swings executed by the subject, or multiple different types of golf shots executed by the subject. In some cases, the golf-related actions or movements may involve multiple golf swings or multiple different types of golf swings executed by different subjects with different stances. In some cases, the outsoles and traction members disclosed herein may be configured to provide consistent traction regardless of the stance used by a subject when the subject initiates or executes a golf-related action or movement. In some cases, the outsoles and traction members disclosed herein may be configured to provide consistent traction regardless of the type of swing executed by a subject or the type of golf shot that the subject hits when the subject executes a golf swing.

Figure 14A:
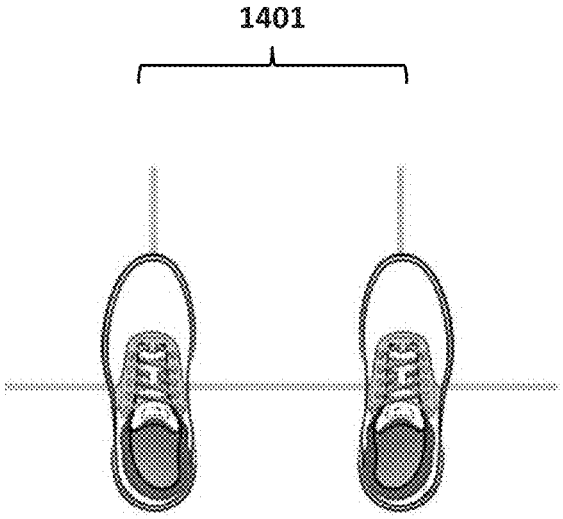
FIGS. 14A and 14B schematically illustrate various different types of stances that a subject can take when initiating or executing a golf swing.
Figure 14B:
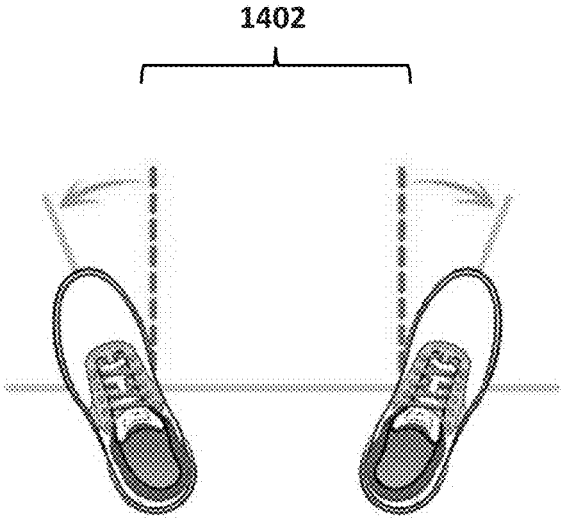

FIGS. 14A and 14B schematically illustrate various different types of stances that a subject can take when initiating or executing a golf swing. In some cases, the stance of a subject may influence the type of swing that the subject can execute or the type of shot that the subject can hit. In some cases, the stance of a subject may influence the biomechanical actions involved in executing a golf swing, including the physical movements associated with the golf swing and the relative timings of the physical movements needed to execute the golf swing. In some cases, the subject may take a neutral stance. In other cases, the subject may take an angled stance. In some alternative cases, the subject may have one foot in a more angled stance and another foot in a more neutral stance.

As shown in FIG. 14A, in some cases, the subject may take a neutral stance 1401 in which the subject's feet are aligned with one or more longitudinal (vertical) axes bisecting the subject's left and right feet. In some cases, the one or more longitudinal (vertical) axes may be perpendicular to a lateral (horizontal) axis intersecting a point or region in three-dimensional space corresponding to the subject's center of mass (e.g., when the subject is standing upright with an equal weight distribution across the subject's left and right feet).

As shown in FIG. 14B, in some cases, the subject may take an angled stance 1402 in which the subject's feet are oriented at an angle relative to the one or more longitudinal (vertical) axes. In some cases, at least one of the subject's left and/or right foot may be angled inwards by an angle ranging from about 0 degrees to about 45 degrees relative to the longitudinal (vertical) axis. In some cases, at least one of the subject's left and/or right foot may be angled outwards by an angle ranging from about 0 degrees to about 45 degrees relative to the longitudinal (vertical) axis. In some cases, the subject's left foot may be oriented at a different angle than the subject's right foot. For example, in some cases, the subject's left foot may be oriented inwards or outwards, and the subject's right foot may be oriented outwards or inwards. In other cases, the subject's left foot and right foot may both be oriented inwards or outwards, but at different angles relative to the longitudinal (vertical) axes for each respective foot.

Figure 15A:
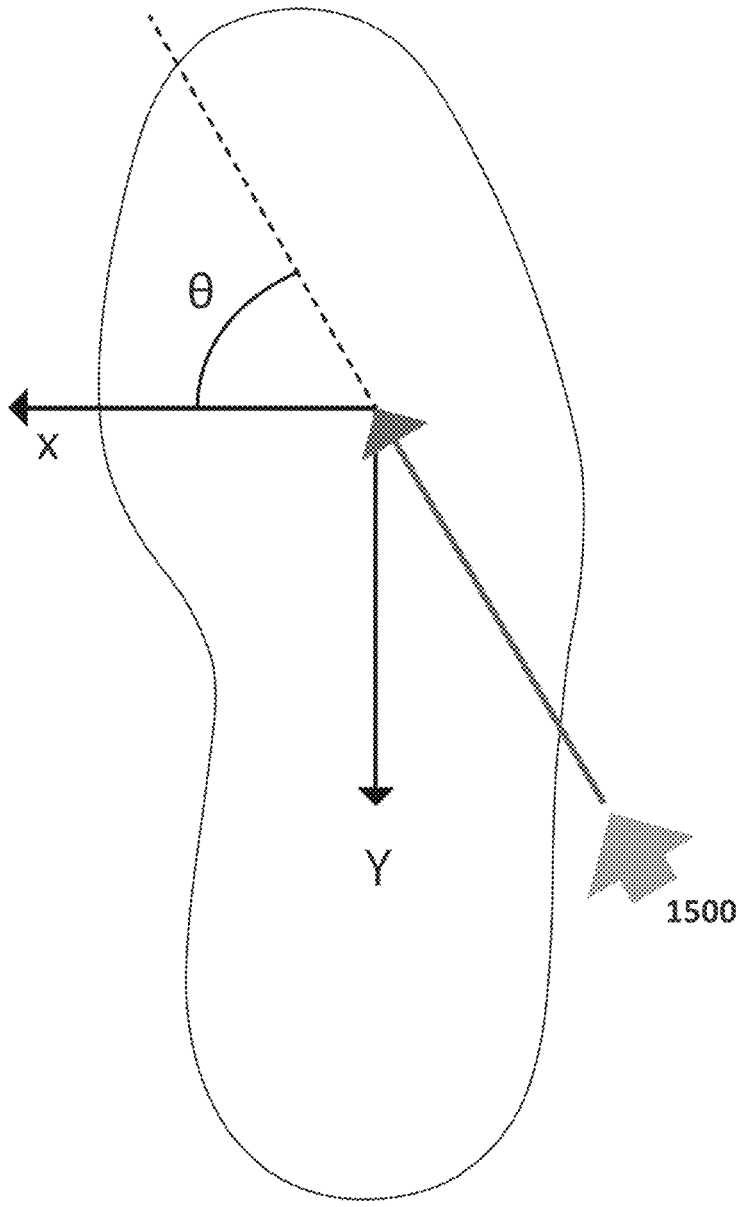
FIG. 15A schematically illustrates an exemplary force vector associated with a golf swing that is executed using a neutral stance.

FIG. 15A schematically illustrates an exemplary force vector 1500 associated with one or more ground reaction forces that are generated in response to the forces exerted by the subject's feet or the subject's shoe on the ground surface (e.g., when the subject is executing a golf-related action or movement). In some cases, the one or more ground reaction forces may correspond to one or more forces that are exerted by the ground surface on the traction members of the shoe in reaction to the forces exerted by the traction members on the ground surface (e.g., when the subject is executing a golf-related action or movement). In some cases, the force vector 1500 may have an orientation corresponding to a direction along which frictional interactions can occur between the traction members and the ground surface. In some cases, the force vector 1500 may be oriented towards a center of pressure in the forefoot region of the shoe when a subject wearing the shoe executes one or more biomechanical actions associated with a golf swing. Because there is an increased possibility of slipping and loss of traction when the subject executes a downswing and applies pressure to the trailing forefoot, it is advantageous to add traction members in the forefoot region of the shoe that are in alignment with the ground reaction forces generated during a golf swing (e.g., during the downswing) so that the subject can leverage the ground reaction forces to perform a series of optimal biomechanical movements that allow the subject to execute a particular type of swing or to hit a particular type of shot type.

In some cases (e.g., for swings executed using a more neutral stance), the force vector 1500 may be disposed within a predetermined angular range θ. In some cases, the predetermined angular range θ may be about 50 degrees to about 75 degrees relative to the lateral (horizontal) axis. In some cases, the predetermined angular range θ may be about 55 degrees to about 70 degrees relative to the lateral (horizontal) axis. In some cases, the predetermined angular range θ may be about 60 degrees to about 65 degrees relative to the lateral (horizontal) axis. In some cases, the force vector may be about 60 degrees, 61 degrees, 62 degrees, 63 degrees, 64 degrees, or 65 degrees relative to the lateral (horizontal) axis.

As discussed elsewhere herein, in some cases, the subject's stance may be different from the neutral stance (e.g., the subject may have an angled stance or a combination of a neutral stance for one foot and an angled stance for the other foot), or the subject's stance may change or vary depending on the type of swing or the type of shot that the subject is executing. In such cases, the force vectors associated with the subject's swing may have a different directionality or orientation than the force vectors typically associated with more neutral stances. Thus, it would be beneficial to configure an outsole with multiple sets of traction members that can manage different force vectors in different directions and/or different sets of force vectors associated with different types of stances and/or different types of swings or shots.

EXAMPLES

In one aspect, the present disclosure provides various examples and embodiments of a golf shoe with an outsole comprising multiple sets of traction members, each individually configured to accommodate force vectors with a different orientation or directionality. In some cases, the multiple sets of traction members may be configured to collectively accommodate a wide range of different ground reaction force vectors associated with many different types of stances, swings, or shots. In some cases, the traction members disclosed herein may be arranged to provide multiple outsole or traction regions that are each tailored to provide optimal traction along different directions of the outsole (e.g., for different types of stances, swings, and/or shots).

Figure 15B:
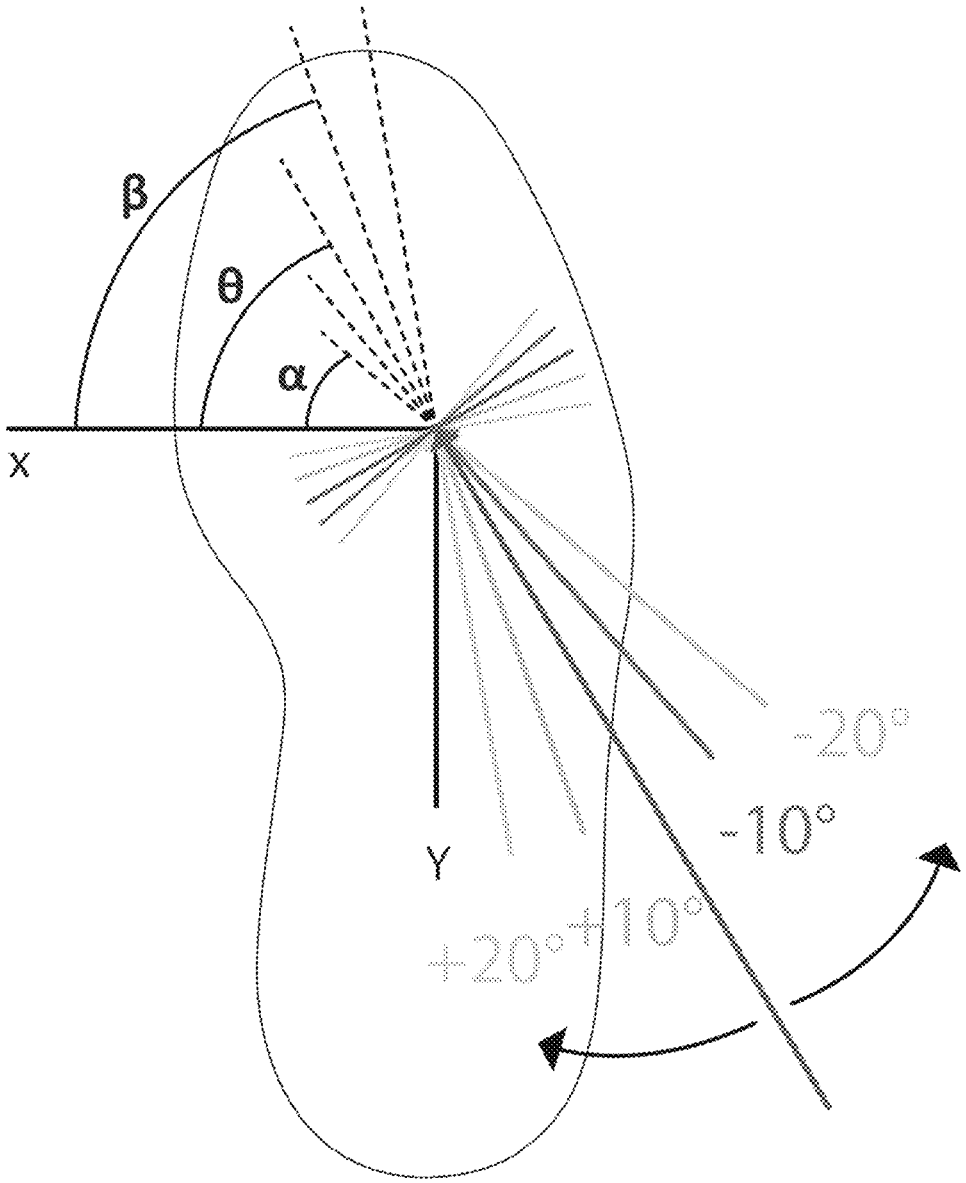
FIG. 15B schematically illustrates a plurality of different force vector directions associated with golf-related actions or movements that are initiated or executed using multiple different stances.

FIG. 15B schematically illustrates a plurality of different force vectors that the traction members of the present disclosure can be configured to accommodate or manage. In some cases, a first set of traction members may be configured to provide traction along a first force vector direction that is disposed at an angle θ relative to a lateral (horizontal) axis of the outsole. In some cases, the angle θ may be associated with a neutral stance. In some cases, a second set of traction members may be configured to provide traction along a second force vector direction that is disposed at an angle α relative to the lateral (horizontal) axis of the outsole. In some cases, the angle α may be associated with an angled stance (e.g., a stance that is angled more inwards or outwards than a neutral stance). In some cases, a third set of traction members may be configured to provide traction along a third force vector direction that is disposed at an angle β relative to the lateral (horizontal) axis of the outsole. In some cases, the angle R may be associated with an angled stance (e.g., a stance that is angled more outwards or inwards than a neutral stance).

In some cases, the angle θ may range from about 50 degrees to about 75 degrees relative to the lateral (horizontal) axis of the shoe. In some cases, the angle θ may range from about 55 degrees to about 70 degrees relative to the lateral (horizontal) axis of the shoe. In some cases, the angle θ may range from about 60 degrees to about 65 degrees relative to the lateral (horizontal) axis of the shoe. In some cases, the angle θ may be about 60 degrees, 61 degrees, 62 degrees, 63 degrees, 64 degrees, or 65 degrees relative to the lateral (horizontal) axis of the shoe.

In some cases, the angle α may be less than the angle θ. In some cases, the angle α may be at most about 65 degrees relative to the lateral (horizontal) axis of the shoe. In some cases, the angle α may be at most about 60 degrees relative to the lateral (horizontal) axis of the shoe. In some cases, the angle α may be at most about 55 degrees relative to the lateral (horizontal) axis of the shoe. In some cases, the angle α may be at most about 50 degrees relative to the lateral (horizontal) axis of the shoe. In some cases, the angle α may be at most about 45 degrees relative to the lateral (horizontal) axis of the shoe. In some cases, the angle α may be at most about 40 degrees relative to the lateral (horizontal) axis of the shoe.

In some cases, the angle β may be greater than the angle θ. In some cases, the angle β may be at least about 60 degrees relative to the lateral (horizontal) axis of the shoe. In some cases, the angle β may be at least about 65 degrees relative to the lateral (horizontal) axis of the shoe. In some cases, the angle β may be at least about 70 degrees relative to the lateral (horizontal) axis of the shoe. In some cases, the angle β may be at least about 75 degrees relative to the lateral (horizontal) axis of the shoe. In some cases, the angle β may be at least about 80 degrees relative to the lateral (horizontal) axis of the shoe.

In some cases, the angular variance between the angle θ and the angle α may be about 5 degrees, about 10 degrees, about 15 degrees, about 20 degrees, or more. In some cases, the angular variance between the angle θ and the angle β may be about 5 degrees, about 10 degrees, about 15 degrees, about 20 degrees, or more. In some cases, the angular variance between the angle θ and the angle α may be greater than or equal to the angular variance between the angle θ and the angle β. In some cases, the angular variance between the angle θ and the angle α may be less than or equal to the angular variance between the angle θ and the angle β.

In some cases, the shoes disclosed herein may comprise an outsole with multiple sets of traction members arranged along multiple different force vector directions. In some cases, the angular variance between each adjacent set of traction members may be constant. In other cases, the angular variance between each adjacent set of traction members may change or vary in an irregular or aperiodic manner.

Outsole Zones

In some embodiments, the outsoles described herein may comprise a plurality of traction elements provided in one or more outsole zones disposed around a central forefoot region and/or a central rearfoot region of the outsole. In some embodiments, different sets or subsets of traction elements may be arranged in different outsole zones according to the structural features or material properties of the traction elements.

Figure 16:
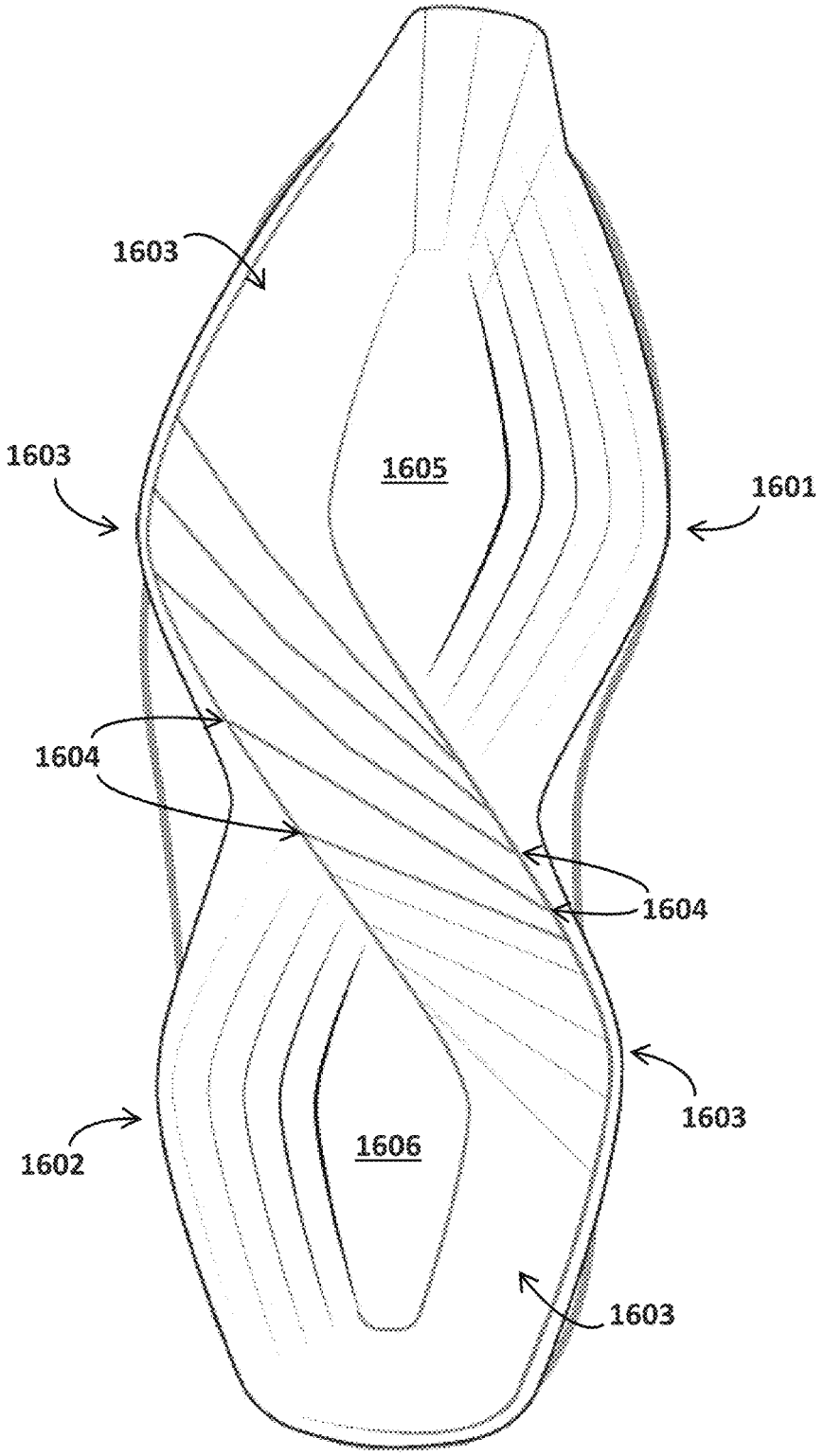
FIGS. 16 and 17 schematically illustrate an example of an outsole comprising an outsole zone with a plurality of tracks extending across the outsole zone, in accordance with some embodiments.

Referring to FIG. 16, in some embodiments, the outsole may comprise a first outsole zone 1601 comprising a first set of traction elements arranged along a perimeter or edge of a medial or lateral forefoot region of the shoe. In some cases, the first set of traction elements may be arranged along a perimeter or edge of a medial forefoot region of the shoe. In other cases, the first set of traction elements may be arranged along a perimeter or edge of a lateral forefoot region of the shoe.

In some embodiments, the outsole may comprise a second outsole zone 1602 comprising a second set of traction elements arranged along a perimeter or edge of a lateral or medial rearfoot region of the shoe. In some cases, the second set of traction elements may be arranged along a perimeter or edge of a lateral rearfoot region of the shoe. In other cases, the second set of traction elements may be arranged along a perimeter or edge of a medial rearfoot region of the shoe.

In some embodiments, the outsole may comprise a third outsole zone 1603 extending diagonally across a midfoot region of the shoe between the medial or lateral forefoot region of the shoe and the lateral or medial rearfoot region of the shoe. In some cases, the third outsole zone may comprise a third set of traction elements. In some cases, the third set of traction elements may be arranged across the midfoot region of the shoe between the medial forefoot region of the shoe and the lateral rearfoot region of the shoe. In other cases, the third set of traction elements may be arranged across the midfoot region of the shoe between the lateral forefoot region of the shoe and the medial rearfoot region of the shoe.

In some cases, the third outsole zone 1603 may be configured to extend from the medial or lateral forefoot region towards a toe region or a forefoot/anterior end of the outsole. In some cases, the third outsole zone 1603 may be configured to extend from the lateral or medial rearfoot region towards a heel region or a rearfoot/posterior end of the outsole.

In some embodiments, the third outsole zone 1603 may be configured to divide the outsole into a first outsole region and a second outsole region. In some cases, the first outsole region may include the first set of traction elements. In some cases, the second outsole region may include the second set of traction elements. In some cases, the third outsole zone and the traction elements disposed in the third outsole zone may be configured to extend between the first set of traction elements and the second set of traction elements.

Central Regions

In some embodiments, the first, second, and/or third outsole zones may be configured to form, define, or outline at least a portion of the central forefoot region 1605 and/or the central rearfoot region 1606 of the outsole. In some cases, the first outsole zone and the third outsole zone may be configured to extend around the central forefoot region of the outsole. In some cases, the second outsole zone and the third outsole zone may be configured to extend around the central rearfoot region of the outsole.

In some cases, the central forefoot region and/or the central rearfoot region of the outsole may include one or more traction elements. In other cases, the central forefoot region and/or the central rearfoot region of the outsole may not or need not include any traction elements.

Tracks

In some embodiments, the third outsole zone 1603 may include a plurality of tracks 1604 extending across the third outsole zone. In some cases, the plurality of tracks 1604 may define or outline one or more paths or pathways across the outsole along which one or more traction elements can be aligned or arranged.

In some cases, the plurality of tracks 1604 may be configured to extend across the outsole in a plurality of different directions. In some cases, the plurality of tracks may have a plurality of different angular orientations relative to the lateral (horizontal) axis of the shoe. In other cases, two or more tracks within the plurality of tracks may have a same angular orientation relative to the lateral (horizontal) axis of the shoe.

Figure 17:
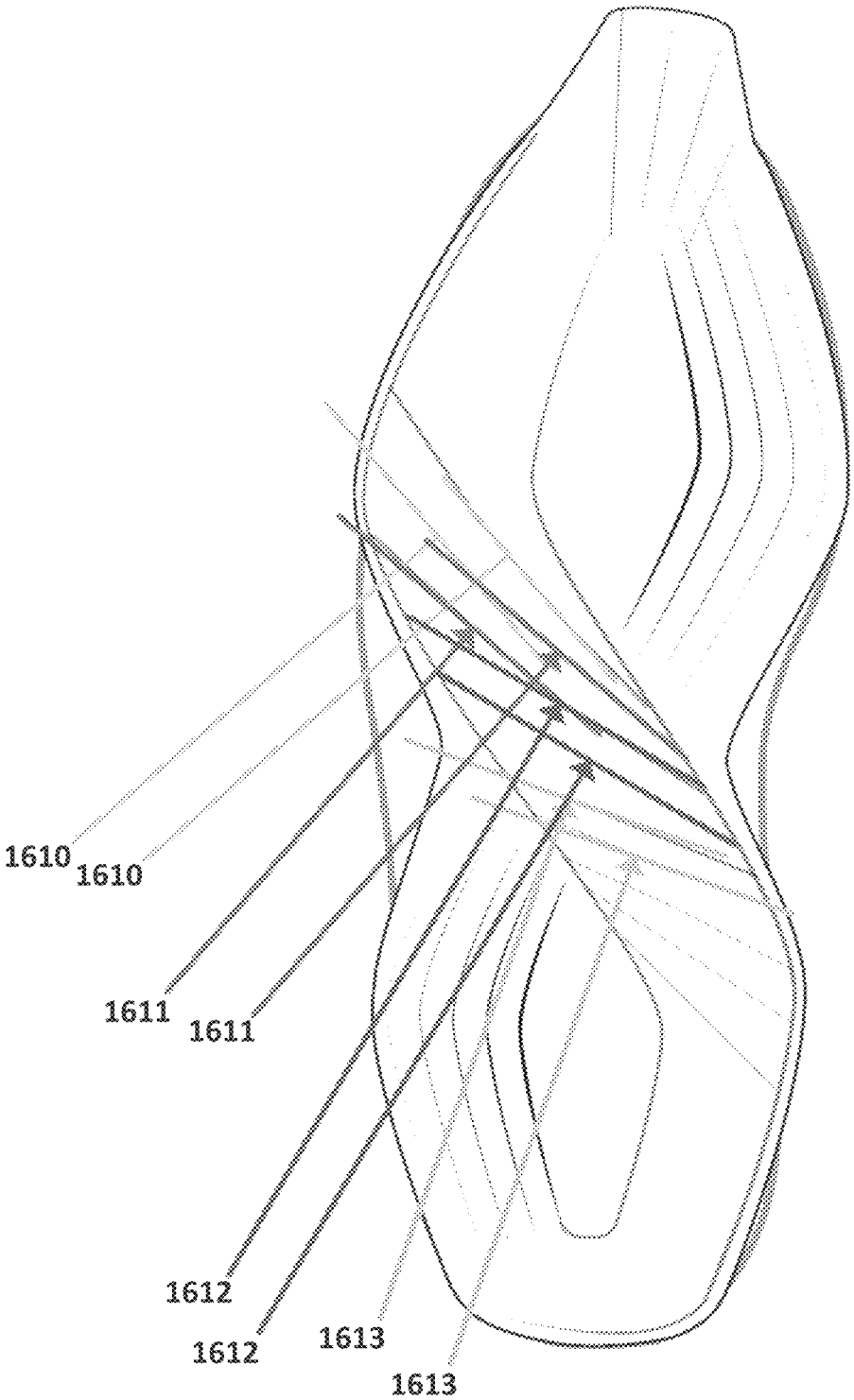
Figure 18:
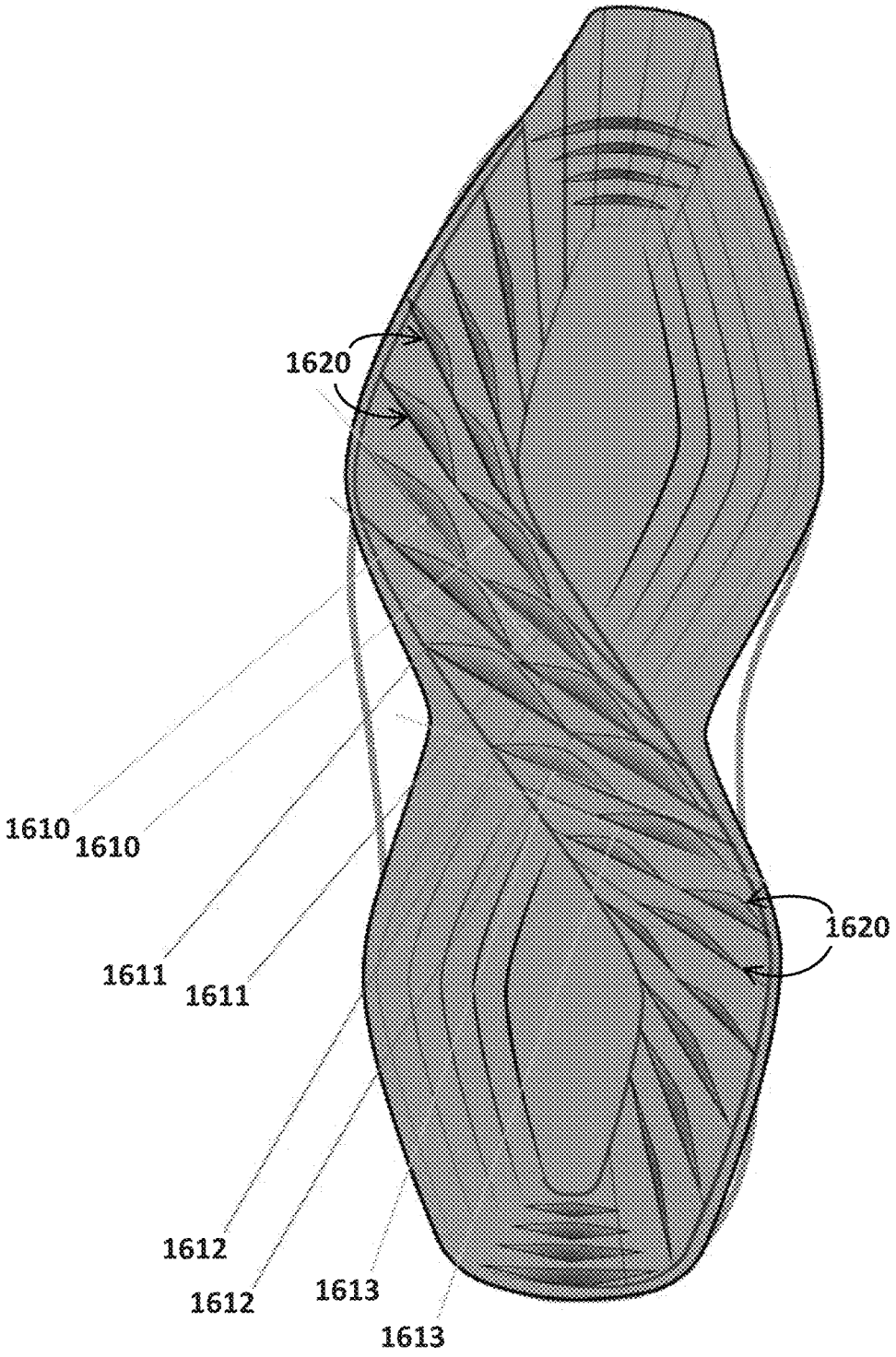
FIG. 18 schematically illustrates a plurality of directional traction elements arranged along one or more tracks extending across the outsole, in accordance with some embodiments.

In some cases, the traction elements in the third set of traction elements may be arranged along different tracks according to an angular orientation of the sidewalls of the traction elements. As shown in FIGS. 17 and 18, in some cases, the traction elements may be arranged along the different tracks to form a plurality of discrete outsole regions that are (i) individually optimized for traction along a specific direction and (ii) collectively optimized to manage a plurality of different ground reaction force vectors oriented in a plurality of different directions 1610, 1611, 1612, 1613.

Directionally Aligned Traction Elements

In some cases, the third outsole zone may comprise multiple sets of directionally aligned traction elements. In some cases, each set of directionally aligned traction elements may include two or more traction elements with sidewalls that are oriented in a same direction.

In some cases, the multiple sets of directionally aligned traction elements may be arranged along different tracks within the plurality of tracks. In some cases, the traction elements in one set of directionally aligned traction elements may have sidewalls that are oriented in a different direction than the sidewalls of the traction elements in another set of directionally aligned traction elements.

In some cases, the multiple sets of directionally aligned traction elements may include (1) a first set of directionally aligned traction elements arranged along a first track and (2) a second set of directionally aligned traction elements arranged along a second track. In some cases, the traction elements arranged along the first track may have sidewalls that are oriented in a different direction than the sidewalls of the traction elements arranged along the second track. In some cases, the first set of directionally aligned traction elements may have sidewalls oriented in a first direction, and the second set of directionally aligned traction elements may have sidewalls oriented in a second direction that is angularly offset from the first direction.

In some cases, the first set of directionally aligned traction elements may be configured to enhance traction in a first direction. In some cases, the second set of directionally aligned traction elements may be configured to enhance traction in a second direction that is different than the first direction. In some cases, the sidewalls of the first set of directionally aligned traction elements may be oriented perpendicular to a first set of force vectors associated with a first type of stance, swing, or golf shot. In some cases, the sidewalls of the second set of directionally aligned traction elements may be oriented perpendicular to a second set of force vectors associated with a second type of stance, swing, or golf shot that is different than the first type of stance, swing, or golf shot.

Progressive Change in Sidewall Orientation

In some cases, the multiple sets of directionally aligned traction elements may include a plurality of traction elements arranged along different tracks according to an orientation of the sidewalls of the traction elements. In some cases, traction elements arranged on different tracks may have different sidewall orientations to manage different ground reaction force vectors that are oriented in different directions.

In some cases, the sidewalls of the traction elements in the third set of traction elements may progressively change in orientation across the plurality of tracks. In some cases, the sidewalls of the traction elements in the third set of traction elements may progressively change in orientation from track to track, or every n number of tracks, wherein n is greater than or equal to 1. In some alternative cases, the sidewalls of the traction elements in the third set of traction elements may progressively change in orientation every $n_1$ number of tracks along a first outsole section and every $n_2$ number of tracks along a second outsole section, where $n_1 \neq n_2$, and so on.

In some cases, the sidewalls of the traction elements in the third set of traction elements may progressively change in orientation between a first portion of the outsole and a second portion of the outsole. In some case, the first portion of the outsole may correspond to a first end of the outsole zone containing the third set of traction elements, and the second portion of the outsole may correspond to a second end of the outsole zone containing the third set of traction elements. In some cases, the first end may be disposed along a lateral or medial forefoot region of the outsole and the second end may be disposed along a medial or lateral rearfoot region of the outsole. In the some cases, the first end may be adjacent or proximal to an anterior end of the outsole and the second end may be adjacent or proximal to a posterior end of the outsole.

In some cases, the sidewalls of the traction elements in the third set of traction elements may progressively change in orientation along a length of the outsole zone containing the third set of traction elements. In some cases, the angular orientation of the sidewalls may progressively change as the third set of traction elements extends across the outsole between a medial or lateral forefoot region of the outsole and a lateral or medial rearfoot region of the outsole.

In some cases, the third set of traction elements may include multiple sets of directionally aligned traction elements arranged along different tracks provided across the outsole. In some cases, the multiple sets of directionally aligned traction elements may include (1) a first set of directionally aligned traction elements arranged along a first track and (2) a second set of directionally aligned traction elements arranged along a second track. In some cases, the first set of directionally aligned traction elements may include traction elements with sidewalls oriented in a first direction or a first set of directions. In some cases, the second set of directionally aligned traction elements may include traction elements with sidewalls oriented in a second direction or a second set of directions. In some cases, the first direction or the first set of directions may not or need not include or coincide with the second direction. In other cases, the first direction or the first set of directions may optionally include or coincide with the second direction. In some cases, the second direction or the second set of directions may not or need not include or coincide with the first direction. In other cases, the second direction or the second set of directions may optionally include or coincide with the first direction.

Directionally Aligned Traction Elements on Different Tracks

In some embodiments, the multiple sets of directionally aligned traction elements may include (1) a first set of directionally aligned traction elements arranged along a first track and (2) a second set of directionally aligned traction elements arranged along a second track. In some optional embodiments, the first set of directionally aligned traction elements and the second set of directionally aligned traction elements may include traction elements with sidewalls oriented in a same or common direction. For example, in some cases, a first directional traction element in the first set of directionally aligned traction elements may have one or more sidewalls oriented in a same direction as one or more other sidewalls of a second directional traction element in the second set of directionally aligned traction elements. Alternatively, the first set of directionally aligned traction elements and the second set of directionally aligned traction elements may not or need not have any traction elements with sidewalls oriented in a same direction.

Traction Element Size/Shape

In some cases, the multiple sets of directionally aligned traction elements may include (1) a first set of directionally aligned traction elements arranged along a first track and (2) a second set of directionally aligned traction elements arranged along a second track. In some cases, the first set of directionally aligned traction elements may include a plurality of traction elements of a same size and/or a same shape. In other cases, the first set of directionally aligned traction elements may include traction elements of different sizes and/or different shapes. In some cases, the second set of directionally aligned traction elements may include a plurality of traction elements of a same size and/or a same shape. In other cases, the second set of directionally aligned traction elements may include traction elements of different sizes and/or different shapes. In some cases, at least one traction element in the first set of traction elements may be of a same size and/or a same shape as another traction element in the second set of traction elements. In other cases, the traction elements in the first set of traction elements may all be sized and/or shaped differently than the traction elements in the second set of traction elements.

Half Moon/Fang Shaped Traction Elements

Figure 19:
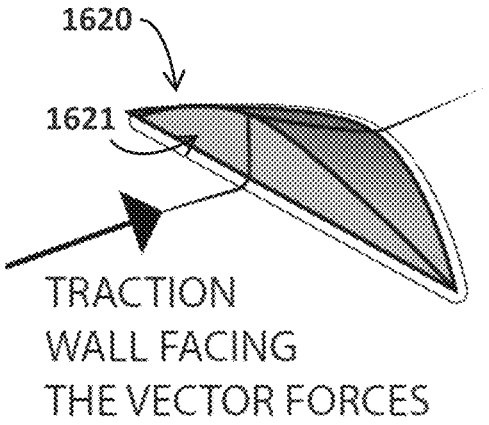
FIG. 19 schematically illustrates an example of a directional traction element that can be arranged along one or more tracks extending across the outsole, in accordance with some embodiments.

Referring now to FIGS. 18 and 19, in some embodiments, the first, second, and/or third sets of traction elements may comprise one or more adaptive traction elements 1620. In some cases, the one or more adaptive traction elements 1620 may have a half-moon shape or a fanged profile as described elsewhere herein.

In some cases, the one or more adaptive traction elements 1620 may have a sidewall 1621 that is perpendicular or orthogonal to the base or bottom surface of the outsole. In some cases, the sidewall 1621 may be oriented in a direction that is perpendicular or orthogonal to one or more ground reaction force vectors generated in response to forces exerted on the ground surface during a golf-related action or movement.

In some cases, the one or more adaptive traction elements may include multiple sets of adaptive traction elements arranged along different tracks. In some cases, the multiple sets of adaptive traction elements may be arranged along the different tracks according to the orientations of the sidewalls of the adaptive traction elements. In some cases, the adaptive traction elements may be arranged along the different tracks to form a plurality of discrete outsole regions that are (i) individually optimized for traction along a specific direction and (ii) collectively optimized to manage a plurality of different ground reaction force vectors oriented in a plurality of different directions 1610, 1611, 1612, 1613.

Additional Traction Elements

In some cases, the outsoles described herein may comprise one or more directional traction elements. In some cases, the one or more directional traction elements may be configured to manage force vectors oriented in one or more specific directions. In some cases, the one or more directional traction elements may be provided along a lateral side and/or a medial side of the outsole to manage forces in a medial-lateral direction and/or a lateral-medial direction. In some cases, the one or more directional traction elements may be provided along an anterior end and/or a posterior end of the outsole to manage forces in an anterior-posterior direction and/or a posterior-anterior direction.

In some cases, the outsoles described herein may comprise one or more omni-directional traction elements. In some cases, the omni-directional traction elements may be configured to manage force vectors oriented in a plurality of different directions. In some cases, the one or more omni-directional traction elements may be provided along a lateral side and/or a medial side of the outsole. In some cases, the one or more omni-directional traction elements may be provided along an anterior end and/or a posterior end of the outsole.

In some cases, the omni-directional traction elements may be configured to manage force vectors oriented in multiple different directions. Although the directional traction elements disclosed herein may be better suited for managing force vectors in certain specific directions, the directional traction elements may not be able to manage other force vectors as effectively. For example, in some cases, the directional traction elements may not be optimized for force vectors that are angularly offset from the specific force vector directions that the directional traction elements are primarily configured to manage. In such cases, the inclusion of omni-directional traction elements may help to enhance the ability of the outsole to manage other important force vectors beyond those managed specifically by the directional traction elements.

In some cases, the omni-directional traction elements disclosed herein may be configured to manage a plurality of different force vectors associated with a variety of different golf-related actions or movements. In some cases, the omni-directional traction elements may be configured to manage (1) a first set of force vectors associated with traversing a course. In some cases, the force vectors associated with traversing a course may include force vectors that can change or vary depending on the terrain or topology of the course. In some cases, the omni-directional traction elements may be configured to manage (2) a second set of force vectors associated with the ground reaction forces generated during a golf swing. In some cases, the ground reaction forces generated during a golf swing may be disposed at an angle that can change or vary based on a subject's stance, as described in greater detail elsewhere herein. In some cases, the omni-directional traction elements may be configured to manage (3) a third set of force vectors associated with a lateral or rotational movement of the shoe relative to the ground surface. In some cases, the lateral or rotational movement of the shoe may be associated with a pushing or pulling motion or movement of the subject's left and/or right foot during a golf-related action or movement. Although the omni-directional traction elements may not have the directional bias or the precise directionality of directional traction elements, the omni-directional traction elements may still provide sufficient traction in multiple different directions so that the outsole can effectively engage with the ground surface regardless of the type of action or movement that the subject is performing, and regardless of the type of ground surface or the topology of the ground surface under the shoe.

Outsole Variations

Figure 20A:
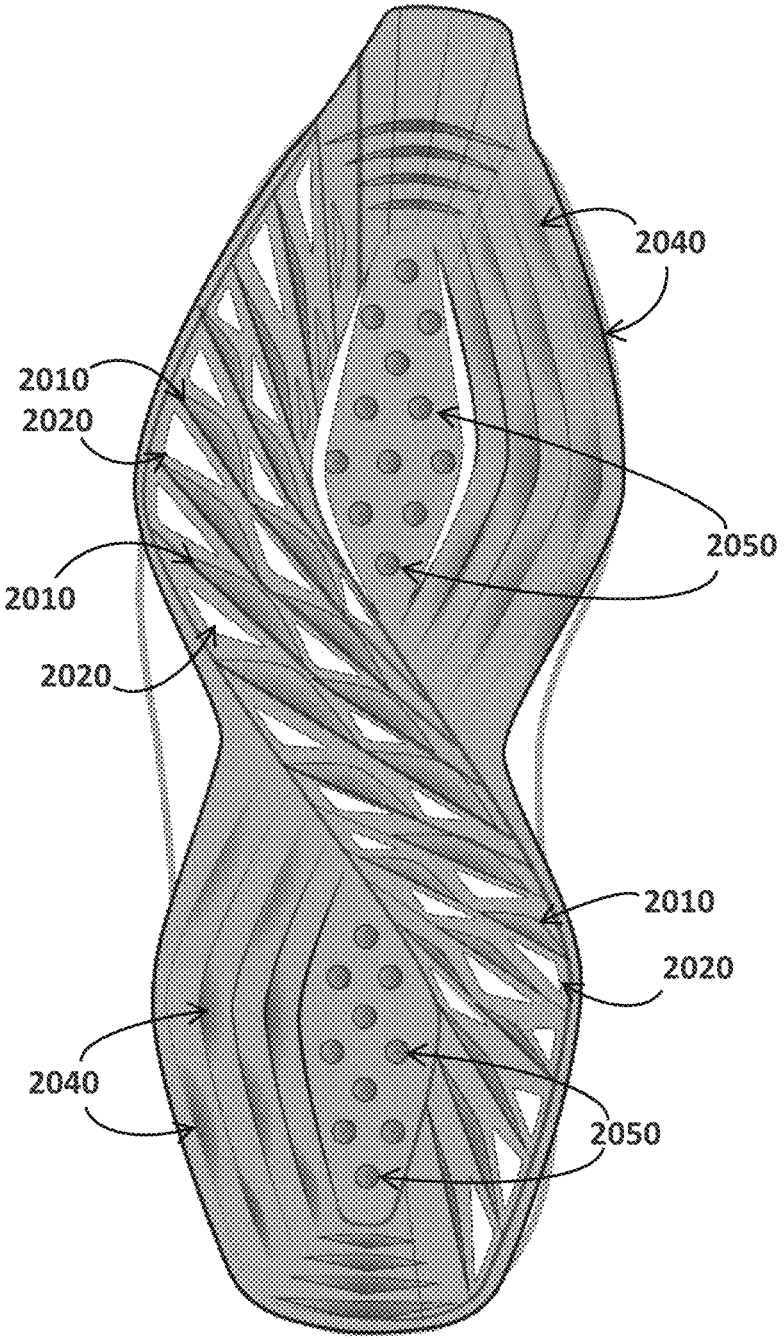
FIGS. 20A-20C schematically illustrate various examples of outsoles with multiple outsole zones comprising a plurality of directional and/or omni-directional traction elements, in accordance with some embodiments.

Referring now to FIG. 20A, in some embodiments, the outsole may comprise a first outsole zone extending along a medial or lateral forefoot region of the shoe. In some cases, the first outsole zone may comprise a plurality of directional traction elements 2040 configured to provide traction in a medial-lateral direction or in a lateral-medial direction.

In some cases, the outsole may further comprise a second outsole zone extending along a lateral or medial rearfoot region of the shoe. In some cases, the second outsole zone may comprise a plurality of directional traction elements 2040 configured to provide traction in a medial-lateral direction or in a lateral-medial direction.

In some cases, the outsole may further comprise a third outsole zone extending diagonally across the outsole between the first outsole zone and the second outsole zone. In some cases, the third outsole zone may comprise a plurality of adaptive traction elements 2010 as described elsewhere herein. In some cases, the adaptive traction elements 2010 may comprise one or more traction elements with a half-moon shape or a fanged profile.

In some cases, the third outsole zone may comprise a plurality of apertures or windows 2020 formed across the third outsole zone to (i) reduce the weight of the outsole and (ii) enhance the flex characteristics of the outsole. In some cases, the apertures or windows 2020 may be disposed in front of or directly adjacent to the adaptive traction elements.

In some cases, the first outsole zone, the second outsole zone, and/or the third outsole zone may be configured to extend around a central forefoot region and/or a central rearfoot region of the outsole. In some cases, the central forefoot region and/or the central rearfoot region may include one or more traction elements. In some cases, the one or more traction elements may include one or more directional traction elements. In some cases, the one or more traction elements may include one or more omni-directional traction elements.

Figure 20B:
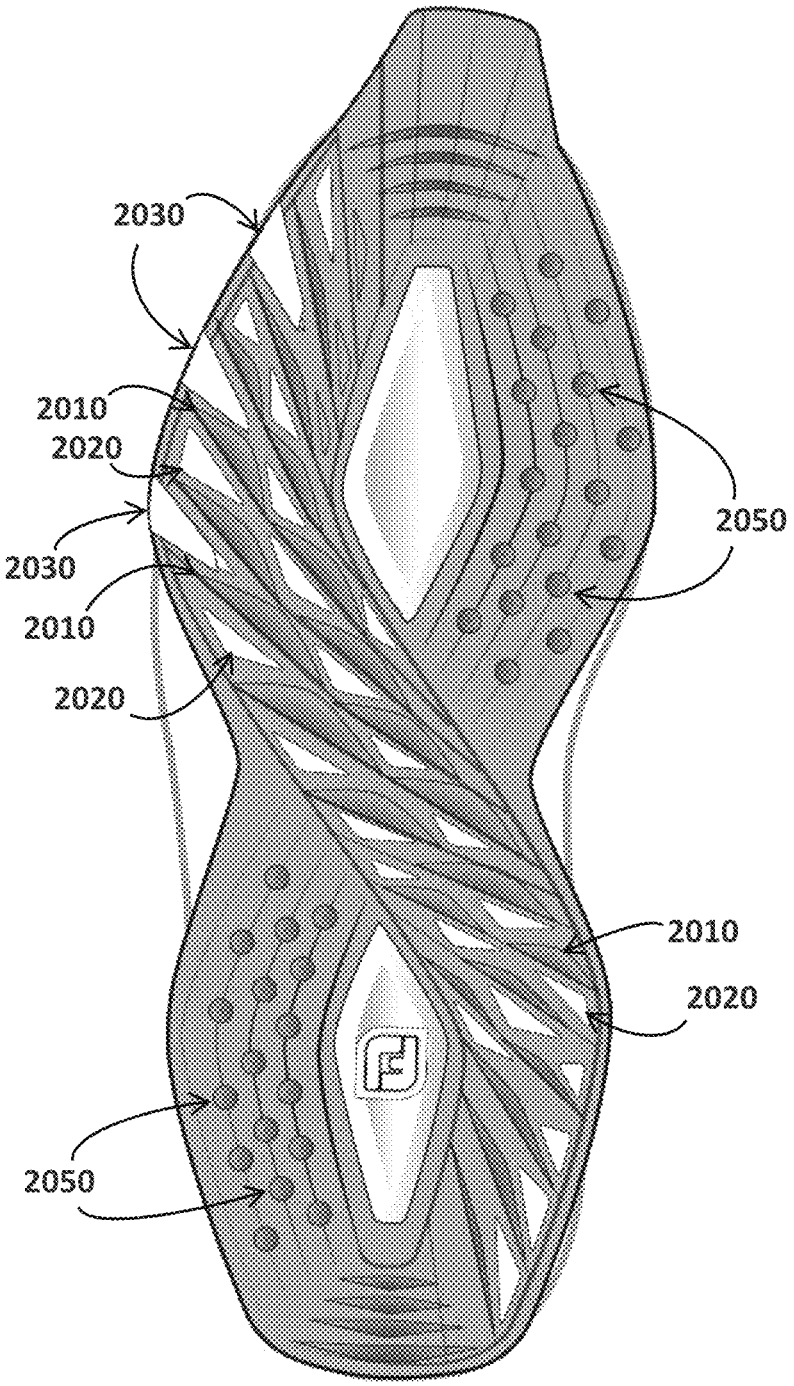

Referring to FIG. 20B, in some embodiments, the outsole may comprise a first outsole zone, a second outsole zone, and a third outsole zone extending between the first and second outsole zones. In some cases, the first outsole zone and/or the second outsole zone may comprise a plurality of omni-directional traction elements 2050. In some embodiments, the third outsole zone may comprise a plurality of adaptive traction elements 2010 with a half-moon shape or a fanged profile. In some cases, the third outsole zone may further comprise a plurality of apertures or windows 2020 formed across the third outsole zone to (i) reduce the weight of the outsole and (ii) enhance the flex characteristics of the outsole.

In some optional embodiments, the third outsole zone may comprise a plurality of flex grooves 2030 extending across a portion or a section of the third outsole zone. In some cases, the plurality of flex grooves 2030 may be positioned between adjacent tracks extending across the outsole. In some cases, the plurality of flex grooves 2030 may be positioned between adjacent or neighboring traction elements that are provided along different tracks extending across the outsole.

In some cases, the first outsole zone, the second outsole zone, and the third outsole zone may be configured to extend around a central forefoot region and/or a central rearfoot region of the outsole. In some cases, the central forefoot region and/or the central rearfoot region may include one or more traction elements. In other cases, the central forefoot region and/or the central rearfoot region may not or need not include any traction elements. In some cases, the central forefoot region and/or the central rearfoot region may be configured as longitudinal flex regions.

Figure 20C:
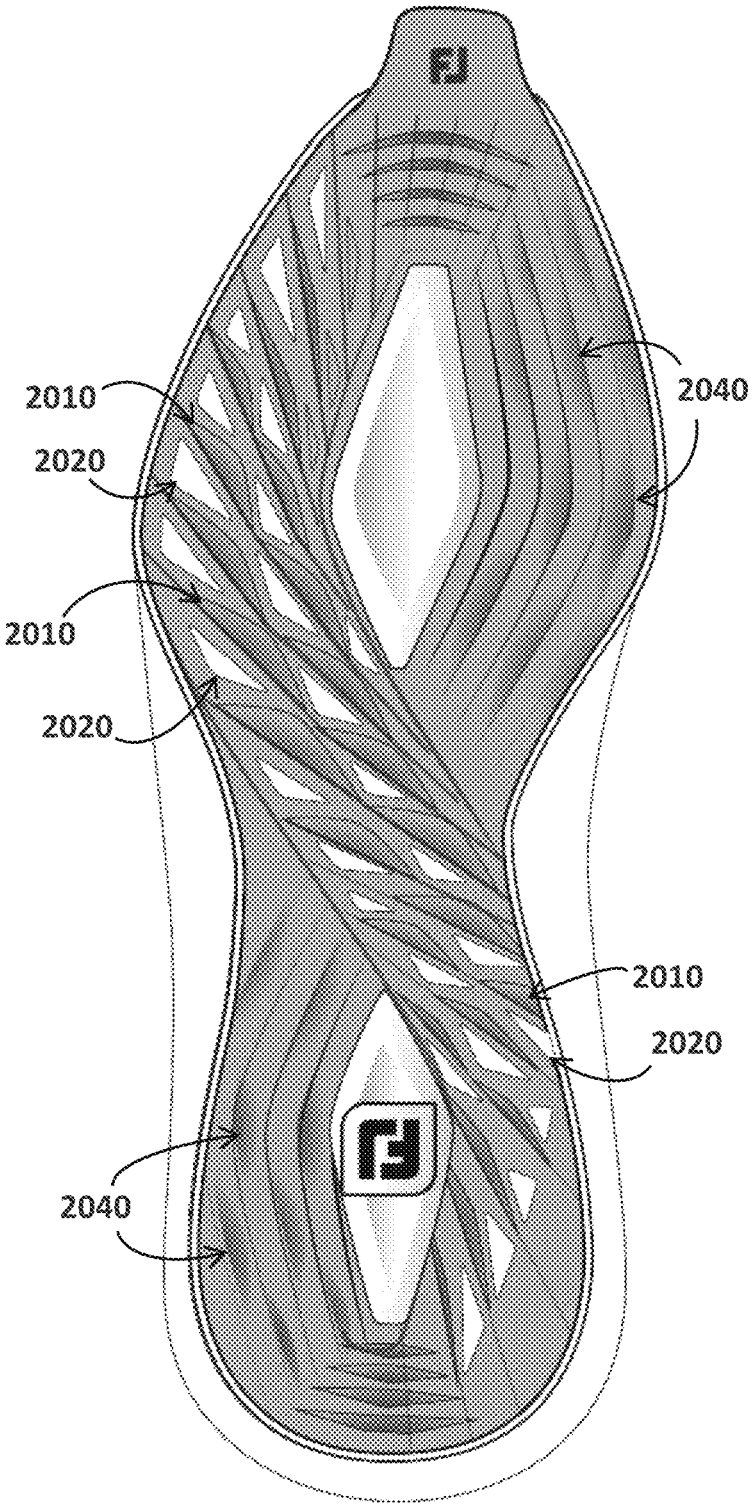

Referring to FIG. 20C, in some alternative embodiments, the outsole may comprise a first outsole zone, a second outsole zone, and a third outsole zone extending between the first and second outsole zones. In some cases, the first outsole zone and/or the second outsole zone may comprise a plurality of directional traction elements 2040 configured to provide traction in a medial-lateral direction or in a lateral-medial direction. In some embodiments, the third outsole zone may comprise a plurality of adaptive traction elements 2010 with a half-moon shape or a fanged profile as described elsewhere herein. In some cases, the third outsole zone may further comprise a plurality of apertures or windows 2020 formed across the third outsole zone to (i) reduce the weight of the outsole and (ii) enhance the flex characteristics of the outsole.

In some cases, the first outsole zone, the second outsole zone, and/or the third outsole zone may be configured to extend around a central forefoot region and/or a central rearfoot region of the outsole. In some cases, the central forefoot region and/or the central rearfoot region may include one or more traction elements. In other cases, the central forefoot region and/or the central rearfoot region may not or need not include any traction elements. In some cases, the central forefoot region and/or the central rearfoot region may be configured as flex regions that can enhance the longitudinal flexibility of the shoe.

Support Structure

In some embodiments, the shoes disclosed herein may comprise a support structure that can be integrated with a portion of the shoe. In some cases, the support structure may be integrated with a portion of the midsole and/or a portion of the outsole. In some cases, the support structure may be configured to enhance the suspension, stiffness, and/or support characteristics of the shoe.

Figure 21A:
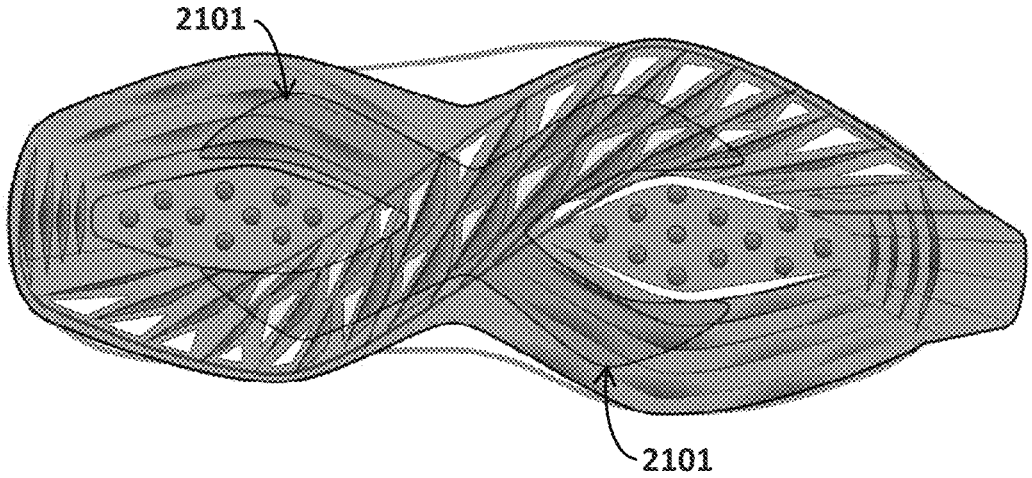
FIGS. 21A-21C schematically illustrate various examples of support structures that can be integrated with the shoes of the present disclosure.
Figure 21B:
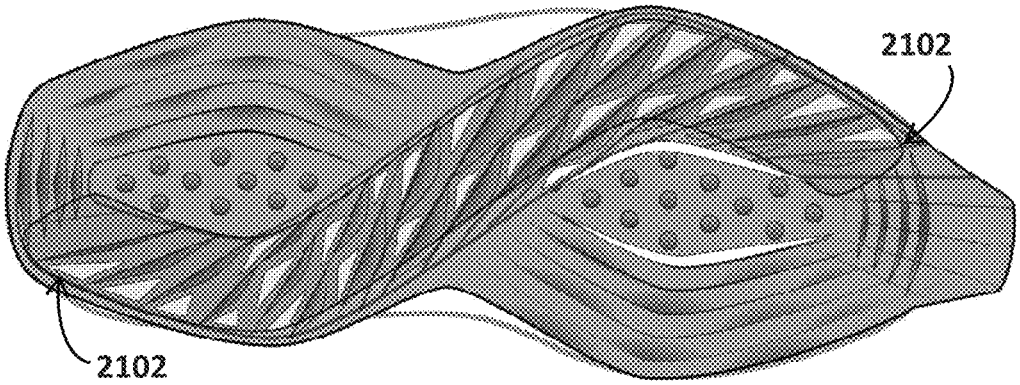
Figure 21C:
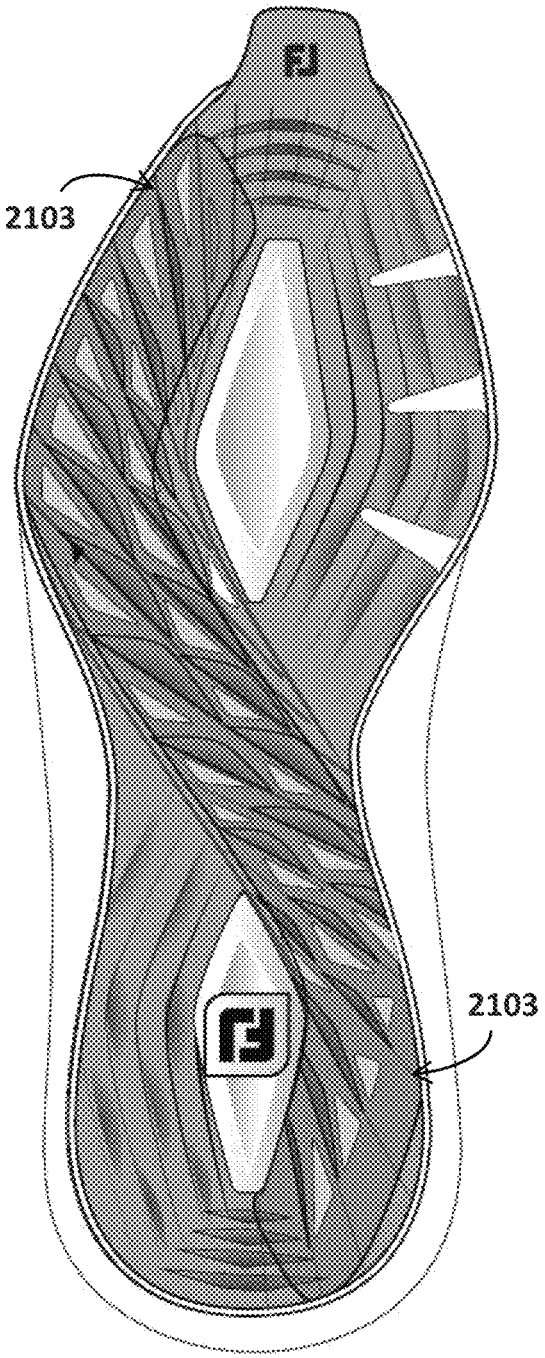

FIGS. 21A-21C illustrate different examples of sole assemblies with an integrated support structure. In some embodiments, the sole assembly may comprise a support structure that is integrated with the outsole material. In some cases, the support structure and the outsole material may be integrated by over injecting the outsole material onto the support structure material, or by over injecting the support structure material onto the outsole material. In some cases, the over injection of the materials may occur within a mold to yield an integrated structure comprising the support structure material joined together with the outsole material. In some non-limiting embodiments, the outsole material may comprise a rubber material, a thermoplastic elastomer (TPE) material, and/or a thermoplastic polyurethane (TPU) material. In some non-limiting embodiments, the support structure material may comprise a thermoplastic polyurethane (TPU) material and/or a thermoplastic elastomer (TPE) material. In other non-limiting embodiments, the support structure material may comprise a carbon material or a carbon fiber material. In some alternative embodiments, the support structure material may comprise one or more composite materials with a fiber-reinforced matrix structure. In other alternative embodiments, the support structure material may comprise a polymeric material such as nylon or acrylonitrile butadiene styrene (also referred to as ABS).

As shown in FIG. 21A, in some cases, the support structure may comprise an X-shaped member 2101. In some case, the X-shaped member 2101 may comprise a first set of members configured to extend from a midfoot region of the shoe to a lateral forefoot region and a medial forefoot region of the shoe. In some cases, the first set of members may be configured to extend around the central forefoot region of the shoe. In some cases, the X-shaped member 2101 may further comprise a second set of members configured to extend from a midfoot region of the shoe to a lateral rearfoot region and a medial rearfoot region of the shoe. In some cases, the second set of members may be configured to extend around the central rearfoot region of the shoe. In some cases, the first set of members and/or the second set of members may include a plurality of members diverging from the midfoot region of the shoe towards (i) a lateral forefoot region of the shoe, (ii) a medial forefoot region of the shoe, (iii) a lateral rearfoot region of the shoe, and (iv) a medial rearfoot region of the shoe. In some cases, the spatial arrangement and structural configuration of the plurality of members may help to stiffen the sole assembly of the shoe without compromising the longitudinal flexibility of the shoe.

As shown in FIGS. 21B and 21C, in some cases, the support structure may comprise an S-shaped member 2102, 2103. In some cases, the S-shaped member 2102, 2103 may comprise a first curved segment extending from the midfoot region of the shoe and along a medial or lateral edge of the forefoot region of the shoe towards an anterior end of the shoe. In some cases, the S-shaped member 2102, 2103 may further comprise a second curved segment extending from the midfoot region of the shoe and along a lateral or medial edge of the rearfoot region of the shoe towards a posterior end of the shoe. In some cases, the first curved segment may be configured to extend around a side or an edge of the central forefoot region of the shoe, and the second curved segment may be configured to extend around a side or an edge of the central rearfoot region of the shoe. In some cases, the spatial arrangement and structural configuration of the curved segments may help to stiffen the sole assembly of the shoe while also providing a spring force effect or an elastic response that can enhance the biomechanical movements associated with various different golf-related actions or movements.

Figure 22A:
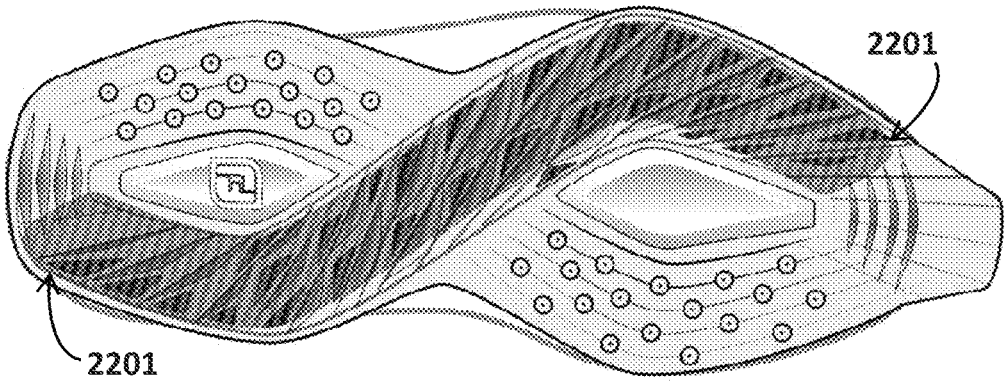
FIGS. 22A and 22B schematically illustrate additional examples of support structures that can be integrated with the shoes of the present disclosure.
Figure 22B:
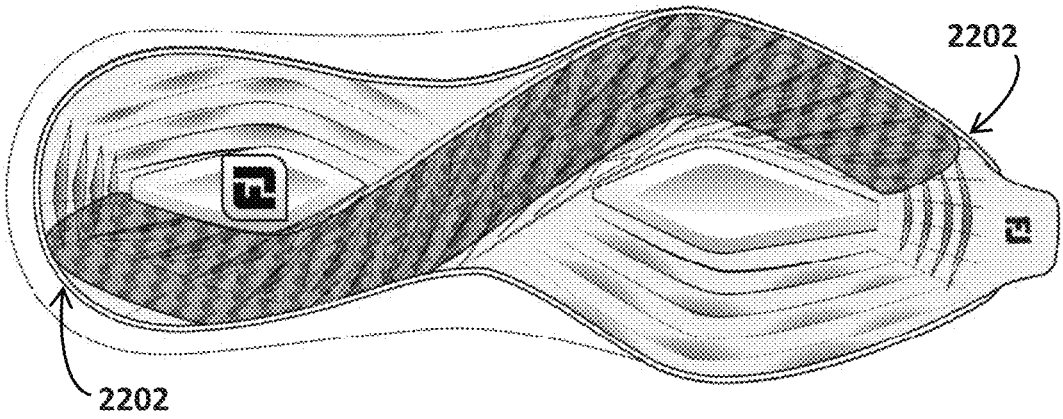

Referring to FIGS. 22A and 22B, in some embodiments, the golf shoe may comprise a support structure comprising a composite material. In some cases, the support structure may comprise an S-shaped carbon insert 2201, 2202. In some cases, the S-shaped carbon insert 2201, 2202 may comprise a first curved segment extending from the midfoot region of the shoe and along a medial or lateral edge of the forefoot region of the shoe towards an anterior end of the shoe. In some cases, the S-shaped carbon insert 2201, 2202 may further comprise a second curved segment extending from the midfoot region of the shoe and along a lateral or medial edge of the rearfoot region of the shoe towards a posterior end of the shoe. In some cases, the first curved segment may be configured to extend around a side or an edge of the central forefoot region of the shoe, and the second curved segment may be configured to extend around a side or an edge of the central rearfoot region of the shoe. In some cases, the spatial arrangement of the curved segments may help to stiffen the sole assembly of the shoe while also providing a spring force effect or an elastic response that can enhance the biomechanical movements associated with various different golf-related actions or movements.

In some non-limiting embodiments, the support structure may have a size and/or a shape that corresponds to a size and/or a shape of one or more outsole zones of the shoe. In some embodiments, the support structure may be aligned with any of the outsole zones described herein. In some embodiments, the support structure may be configured to overlie the first outsole zone, the second outsole zone, the third outsole zone, and/or any other outsole zone(s) as described elsewhere herein.

Split Outsole Configurations

Figure 23:
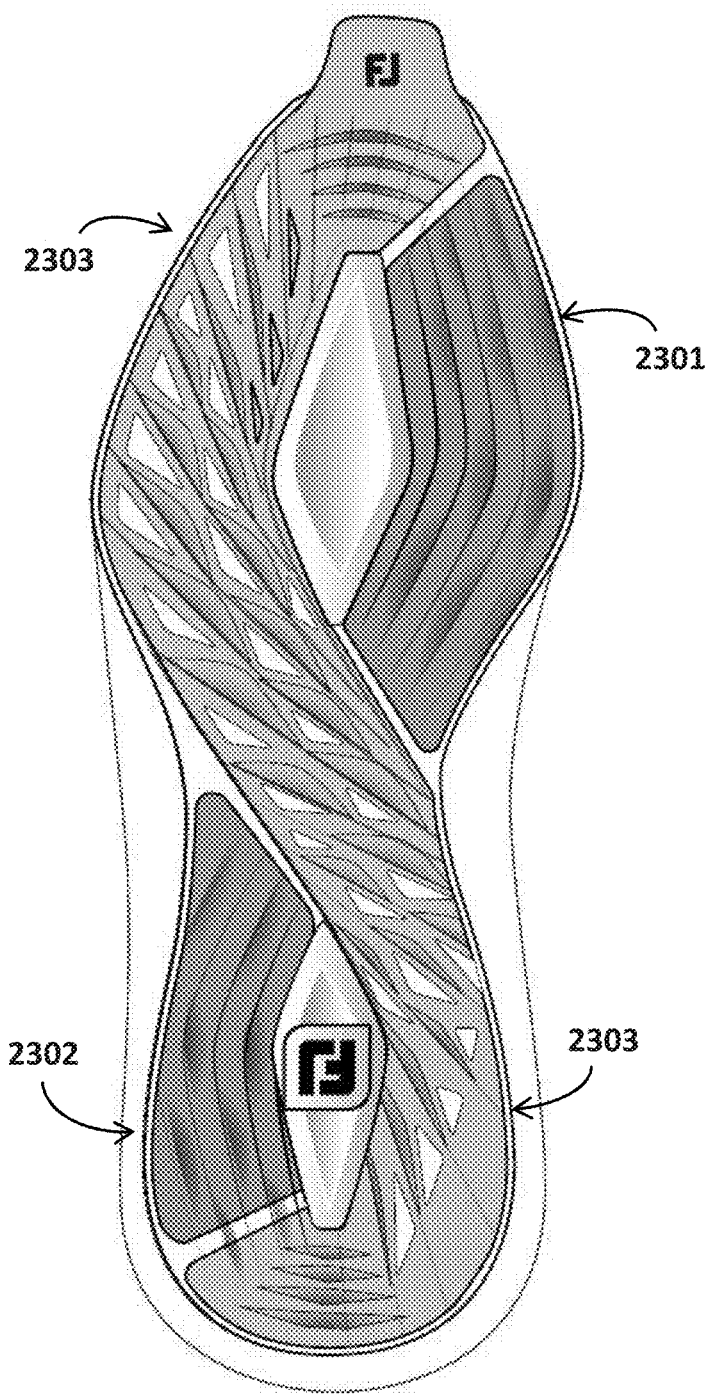
FIGS. 23 and 24 schematically illustrate various examples of outsoles with a split outsole configuration, in accordance with some embodiments.

Referring now to FIG. 23, in some embodiments, the outsoles of the golf shoes disclosed herein may utilize a split outsole configuration. In some cases, the split outsole configuration may include a first outsole zone 2301 extending along a medial or lateral forefoot region of the outsole. In some cases, the split outsole configuration may also include a second outsole zone 2302 extending along a lateral or medial rearfoot region of the outsole. In some cases, the split outsole configuration may further include a third outsole zone 2303 extending diagonally across the midfoot region of the outsole between the first outsole zone and the second outsole zone. In some cases, a portion of the third outsole zone 2303 may be configured to extend from the midfoot region of the outsole and along a lateral or medial side of the forefoot region of the outsole towards the anterior end of the shoe. In some cases, another portion of the third outsole zone 2303 may be configured to extend from the midfoot region of the outsole and along a medial or lateral side of the rearfoot region of the outsole towards the posterior end of the shoe.

In some cases, the first outsole zone 2301 and/or the second outsole zone 2302 may include one or more directional traction elements. In some cases, the one or more directional traction elements may be configured to provide traction in a medial-lateral direction or in a lateral-medial direction.

In some cases, the third outsole zone 2303 may include one or more adaptive traction elements with a half-moon shape or a fanged profile. In some cases, the third outsole zone may further comprise a plurality of apertures or windows formed across the third outsole zone to (i) reduce the weight of the outsole and (ii) enhance the flex characteristics of the outsole.

In some cases, the split outsole configuration may be configured to enhance the flex characteristics of the outsole. In some cases, the split outsole configuration may enhance the flexibility of the outsole along the gaps or areas of separation between the different outsole zones. In some cases, the split outsole configuration may be configured to enhance the flexibility of the outsole along the gaps or areas of separation between (i) the third outsole zone and (ii) the first outsole zone and/or the second outsole zone. In some cases, the split outsole configuration may further enhance the torsional characteristics of the outsole. For example, in some cases, the split outsole configuration may be implemented to control or modulate the torsional stiffness and/or the torsional rigidity of the shoe to better suit a particular subject's needs or preferences. In some cases, the split outsole configuration may be used to make certain regions of the outsole less stiff or rigid in torsion. In some cases, the split outsole configuration may be used to make certain regions of the outsole softer in torsion.

Figure 24:
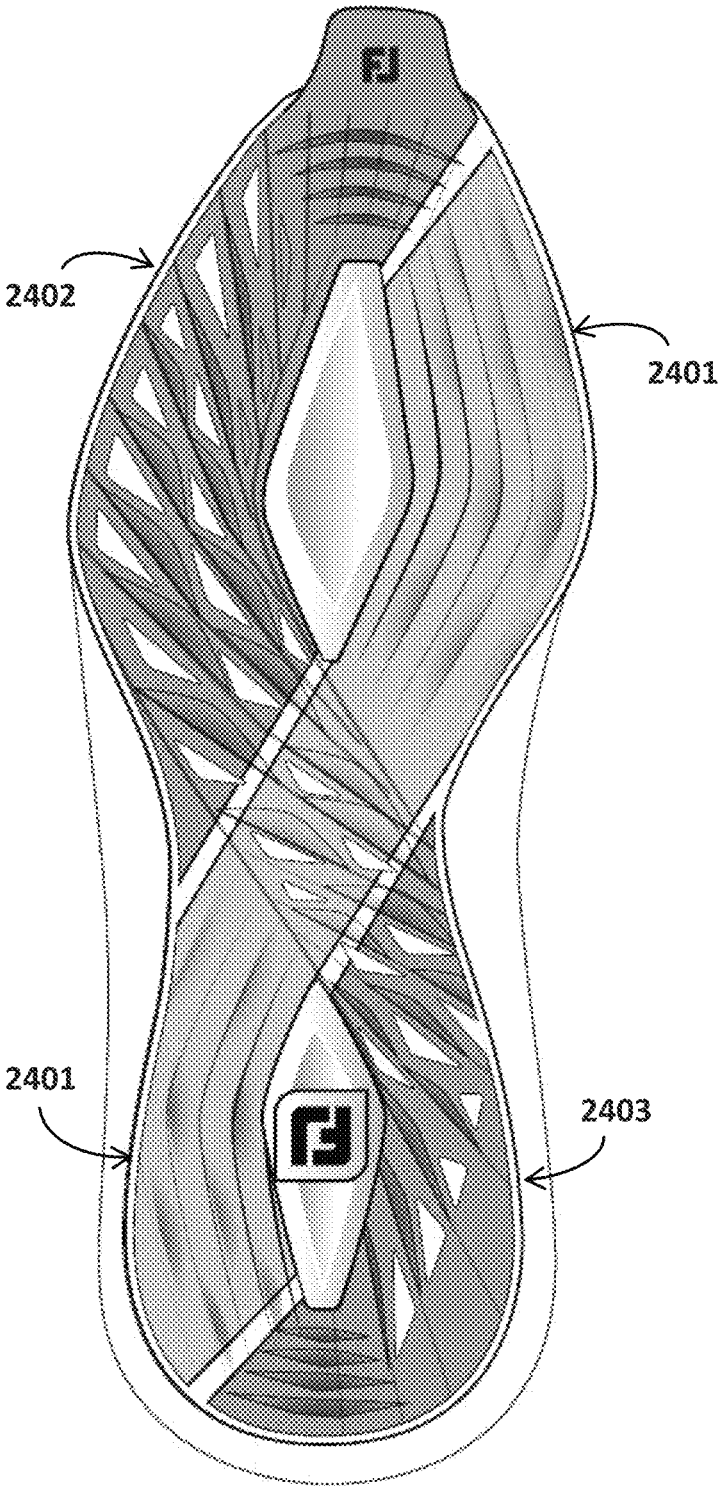

FIG. 24 schematically illustrates another example of a split outsole configuration. In some cases, the split outsole configuration may include a first outsole zone 2401 extending diagonally across a midfoot region of the outsole. In some cases, a portion of the first outsole zone 2401 may be configured to extend from the midfoot region of the outsole and along a medial or lateral side of the forefoot region of the outsole towards the anterior end of the shoe. In some cases, another portion of the first outsole zone 2401 may be configured to extend from the midfoot region of the outsole and along a lateral or medial side of the rearfoot region of the outsole towards the posterior end of the shoe. In some cases, the split outsole configuration may also include a second outsole zone 2402 extending along a lateral or medial forefoot region of the outsole. In some cases, the split outsole configuration may further include a third outsole zone 2403 extending along a medial or lateral rearfoot region of the outsole.

In some cases, the first outsole zone 2401 may include one or more directional traction elements. In some cases, the one or more directional traction elements may be configured to provide traction in a medial-lateral direction or in a lateral-medial direction.

In some cases, the second outsole zone 2402 and/or the third outsole zone 2403 may include one or more adaptive traction elements with a half-moon shape or a fanged profile. In some cases, the second outsole zone 2402 and/or the third outsole zone 2403 may further comprise a plurality of apertures or windows formed across the second and/or third outsole zones to (i) reduce the weight of the outsole and (ii) enhance the flex characteristics of the outsole.

In some cases, the split outsole configuration may be configured to enhance the flex characteristics of the outsole. In some cases, the split outsole configuration may enhance the flexibility of the outsole along the gaps or areas of separation between the different outsole zones.

In some cases, the split outsole configuration may be configured to enhance the flexibility of the outsole along the gaps or areas of separation between (i) the first outsole zone and (ii) the second outsole zone and/or the third outsole zone. In some cases, the split outsole configuration may further enhance the torsional characteristics of the outsole. For example, in some cases, the split outsole configuration may be implemented to control or modulate the torsional stiffness and/or the torsional rigidity of the shoe to better suit a particular subject's needs or preferences. In some cases, the split outsole configuration may be used to make certain regions of the outsole less stiff or rigid in torsion. In some cases, the split outsole configuration may be used to make certain regions of the outsole softer in torsion.

In some optional embodiments, the shoe may comprise a support structure that can be integrated with the sole of the shoe. In some cases, the support structure may be aligned with and/or may overlie the first outsole zone. In some cases, the support structure may be configured to extend along or across a length of the first outsole zone. In some cases, the support structure may comprise an S-shaped support structure as described elsewhere herein. In some cases, the S-shaped support structure may have a size and/or a shape corresponding to the size and/or the shape of the first outsole zone.

Other Outsole Configurations

Figure 25A:
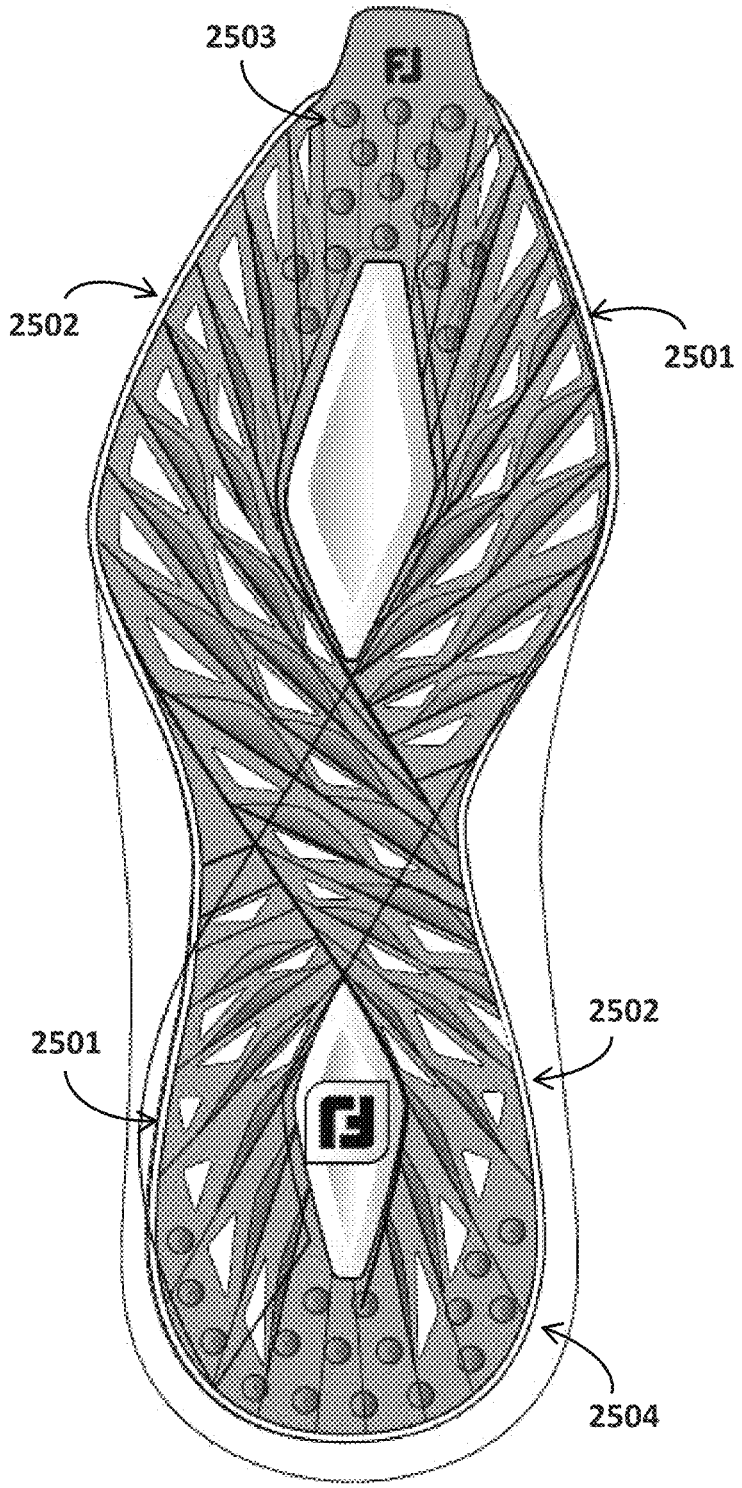
FIG. 25A schematically illustrates an example of an outsole that may not or need not utilize a split outsole configuration, in accordance with some embodiments.

In some embodiments, the shoes described herein may not or need not utilize a split outsole configuration. FIG. 25A illustrates one non-limiting example of an outsole that may not or need not utilize a split outsole configuration. In some cases, the outsole may comprise a first outsole zone 2501 extending along a medial or lateral forefoot region of the shoe and diagonally across the midfoot region of the shoe. In some cases, the first outsole zone 2501 may be configured to extend diagonally across the midfoot region of the shoe and along a lateral or medial rearfoot region of the shoe toward the posterior end of the shoe. In some cases, the outsole may comprise a second outsole zone 2502 extending along a lateral or medial forefoot region of the shoe and diagonally across the midfoot region of the shoe. In some cases, the second outsole zone 2502 may be configured to extend diagonally across the midfoot region of the shoe and along a medial or lateral rearfoot region of the shoe towards the posterior end of the shoe.

In some cases, the outsole may comprise a third outsole zone 2503 provided along the anterior end of the shoe. In some cases, the third outsole zone 2503 may be positioned between or directly adjacent to the forefoot ends of the first outsole zone and the second outsole zone.

In some cases, the outsole may comprise a fourth outsole zone 2504 provided along the posterior end of the shoe. In some cases, the fourth outsole zone 2504 may be positioned between or directly adjacent to the rearfoot ends of the first outsole zone and the second outsole zone.

In some cases, the first outsole zone 2501 and/or the second outsole zone 2502 may include a plurality of adaptive traction elements with a half-moon shape or a fanged profile. In some cases, the first outsole zone and/or the second outsole zone may further comprise a plurality of apertures or windows formed across the first and/or second outsole zones to (i) reduce the weight of the outsole and (ii) enhance the flex characteristics of the outsole.

In some cases, the third outsole zone 2503 and/or the fourth outsole zone 2504 may include one or more omni-directional traction elements. In some cases, the one or more omni-directional traction elements may be configured to provide traction in a plurality of different directions. In some cases, the omni-directional traction elements may be configured to provide grip or traction as the subject walks up and/or down a sloped ground surface. In some cases, the omni-directional traction elements may be configured to provide grip or traction in a plurality of different directions depending on the stance used to initiate or execute a golf swing. In some cases, the omni-directional traction elements may be configured to provide grip or traction as the subject executes a golf-related action or movement involving a translational or rotational motion of the subject's foot relative to the ground surface. In some cases, the translational or rotational motion may involve the subject pushing his or her lead forefoot forward against the ground surface for additional leverage as the subject executes a golf swing. In other cases, the translational or rotational motion may involve the subject pushing his or her trail forefoot forward against the ground surface for additional leverage as the subject executes a golf swing. In some alternative cases, the translational or rotational motion may involve the subject pulling his or her lead rearfoot backwards against the ground surface for additional leverage as the subject executes a golf swing. In other alternative cases, the translational or rotational motion may involve the subject pulling his or her trail rearfoot backwards against the ground surface for additional leverage as the subject executes a golf swing.

Figure 25B:
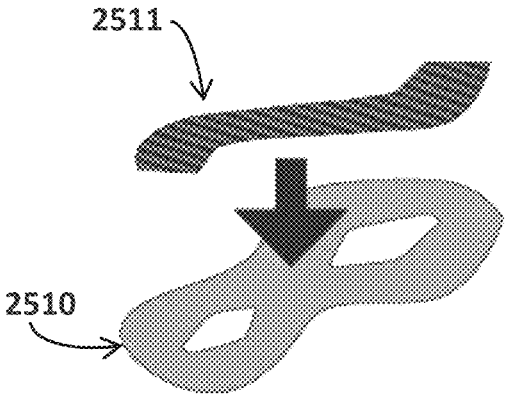
FIGS. 25B and 25C schematically illustrate a process or a method for integrating a support structure with the outsole shown in FIG. 25A.

In some optional embodiments, a support structure may be integrated with the sole of the shoe. As shown in FIG. 25B, in some cases, a support structure comprising a carbon insert 2511 may be integrated with the outsole material 2510 for the shoe (e.g., during a manufacturing or molding process to form the outsole from the outsole material).

Figure 25C:
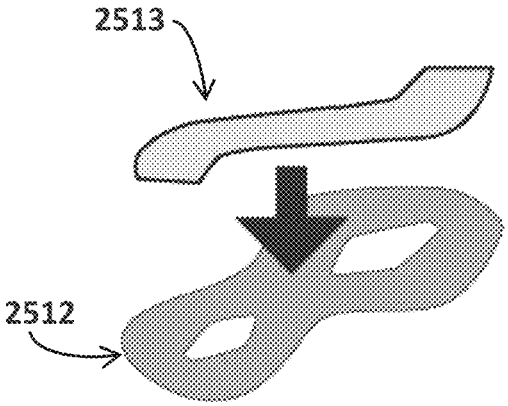

Alternatively, a support structure comprising a TPE insert 2513 may be integrated with the outsole material 2512 for the shoe (e.g., as shown in FIG. 25C). In some non-limiting embodiments, the support structure may be integrally formed with the outsole of the shoe by way of a co-molding or over-injection manufacturing process as described elsewhere herein.

Figure 25D:
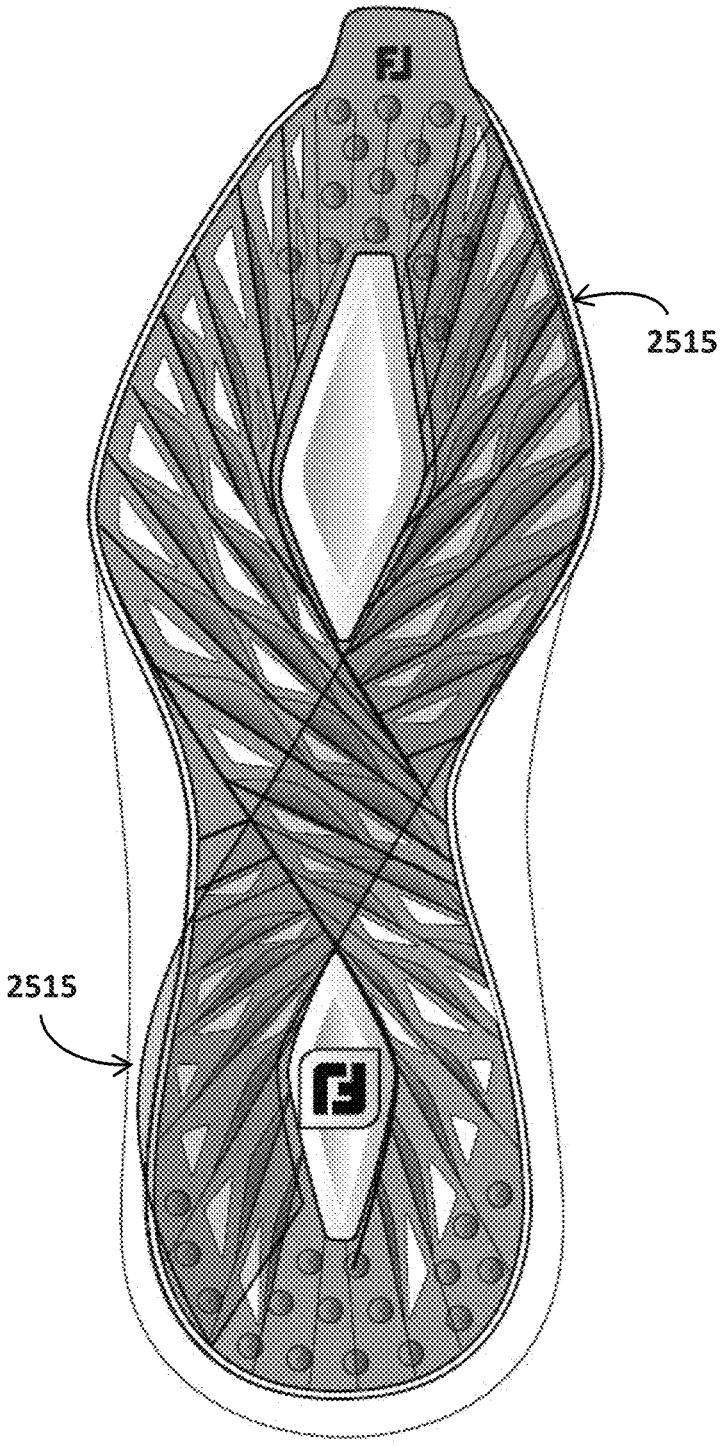
FIGS. 25D and 25E schematically illustrate various different types of support structures that can be integrated with the outsole shown in FIG. 25A.
Figure 25E:
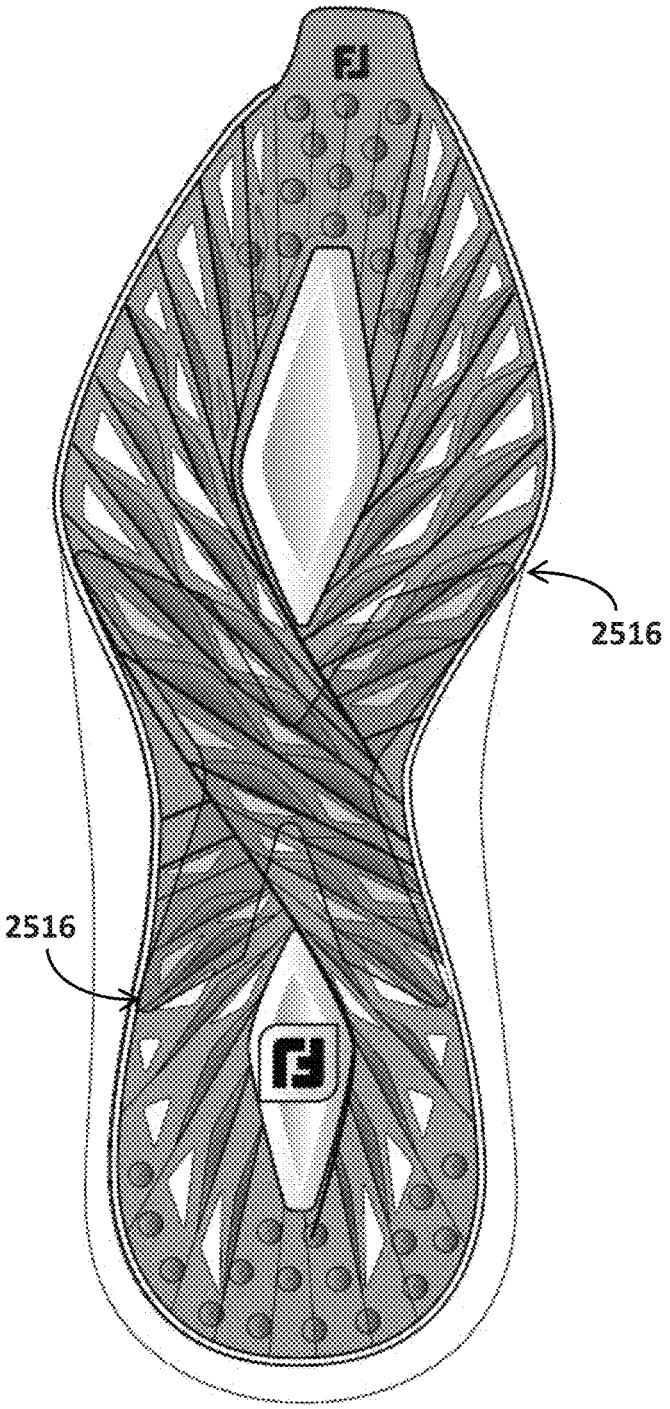

FIGS. 25D and 25E schematically illustrate other examples of support structures that can be integrally formed with the sole of the shoe. In some cases, the support structure may comprise an S-shaped support structure 2515 extending along the first outsole zone and/or the second outsole zone of the shoe. In other cases, the support structure may comprise an X-shaped support structure 2516 positioned within a midfoot region of the shoe.

Multi-Material Outsole

Figure 26A:
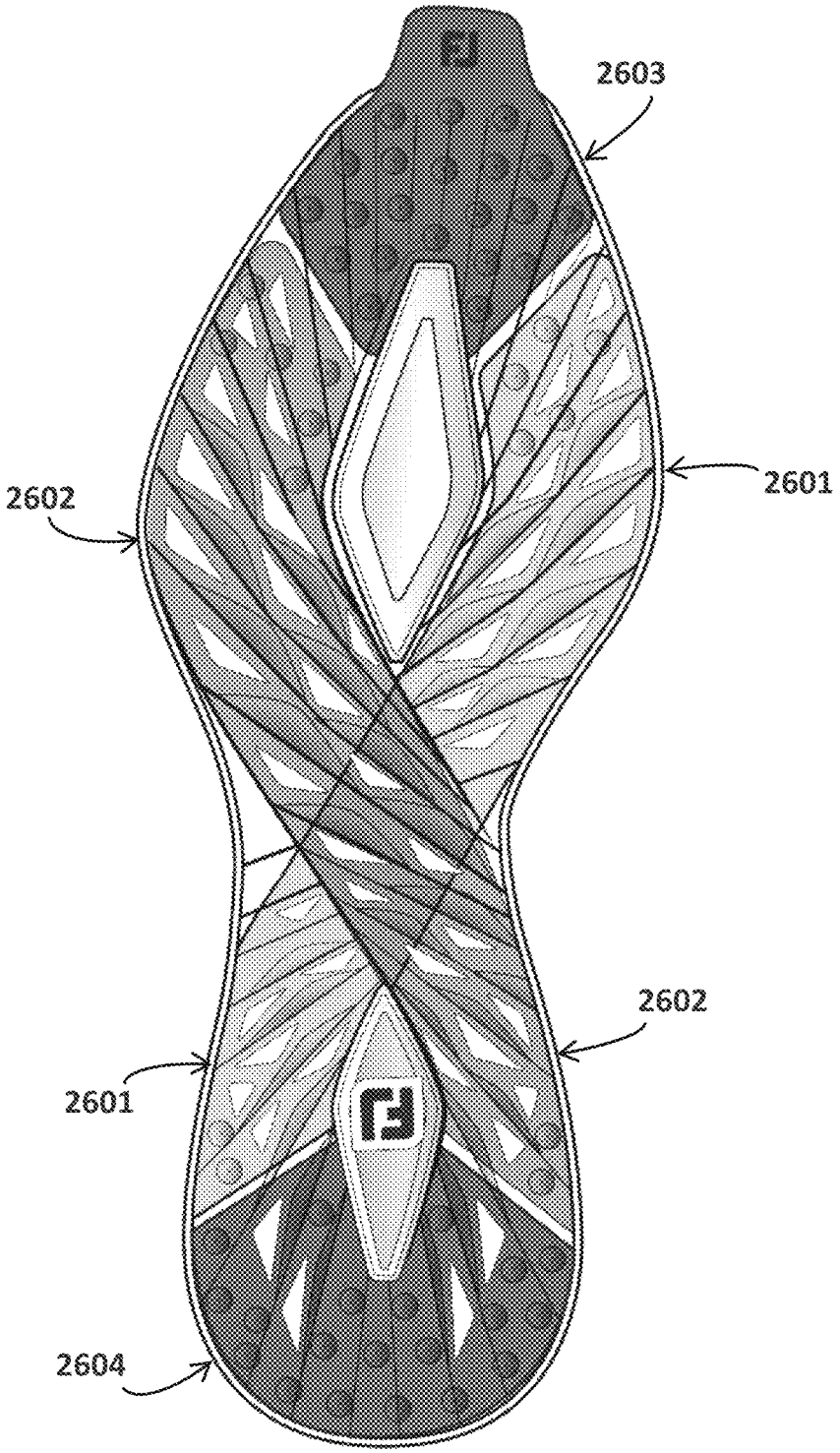
FIGS. 26A and 26B schematically illustrate a multi-piece outsole comprising a plurality of outsole zones formed of different materials, in accordance with some embodiments.
Figure 26B:
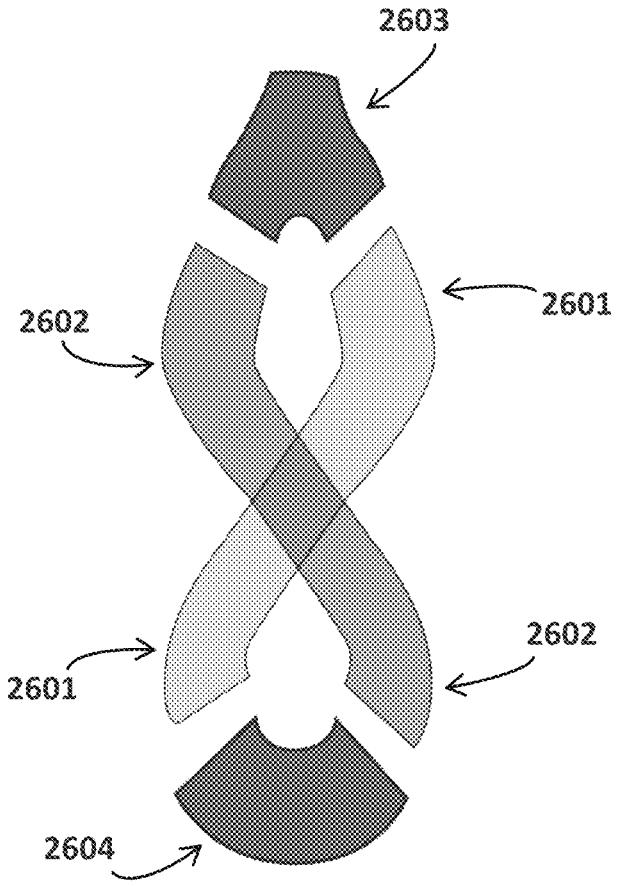

Referring now to FIGS. 26A and 26B, in some embodiments, the shoes disclosed herein may include an outsole comprising two or more outsole zones formed of different materials. In some cases, the outsole may comprise a first outsole zone 2601 extending along a medial or lateral forefoot region of the shoe and diagonally across the midfoot region of the shoe. In some cases, the first outsole zone 2601 may be configured to extend diagonally across the midfoot region of the shoe and along a lateral or medial rearfoot region of the shoe toward the posterior end of the shoe. In some cases, the outsole may comprise a second outsole zone 2602 extending along a lateral or medial forefoot region of the shoe and diagonally across the midfoot region of the shoe. In some cases, the second outsole zone 2602 may be configured to extend diagonally across the midfoot region of the shoe and along a medial or lateral rearfoot region of the shoe towards the posterior end of the shoe.

In some cases, the outsole may comprise a third outsole zone 2603 provided along the anterior end of the shoe. In some cases, the third outsole zone 2603 may be positioned between or directly adjacent to the forefoot ends of the first outsole zone and the second outsole zone.

In some cases, the outsole may comprise a fourth outsole zone 2604 provided along the posterior end of the shoe. In some cases, the fourth outsole zone 2604 may be positioned between or directly adjacent to the rearfoot ends of the first outsole zone and the second outsole zone.

In some cases, the first outsole zone 2601 and/or the second outsole zone 2602 may include a plurality of adaptive traction elements with a half-moon shape or a fanged profile. In some cases, the first outsole zone and/or the second outsole zone may further comprise a plurality of apertures or windows formed across the first and/or second outsole zones to (i) reduce the weight of the outsole and (ii) enhance the flex characteristics of the outsole.

In some cases, the third outsole zone 2603 and/or the fourth outsole zone 2604 may include one or more omni-directional traction elements. In some cases, the one or more omni-directional traction elements may be configured to provide traction in a plurality of different directions. In some cases, the omni-directional traction elements may be configured to provide grip or traction as the subject walks up and/or down a sloped ground surface. In some cases, the omni-directional traction elements may be configured to provide grip or traction in a plurality of different directions depending on the stance used to initiate or execute a golf swing. In some cases, the omni-directional traction elements may be configured to provide grip or traction as the subject executes a golf-related action or movement involving a translational or rotational motion of the subject's foot relative to the ground surface. In some cases, the translational or rotational motion may involve the subject pushing his or her lead forefoot forward against the ground surface for additional leverage as the subject executes a golf swing. In other cases, the translational or rotational motion may involve the subject pushing his or her trail forefoot forward against the ground surface for additional leverage as the subject executes a golf swing. In some alternative cases, the translational or rotational motion may involve the subject pulling his or her lead rearfoot backwards against the ground surface for additional leverage as the subject executes a golf swing. In other alternative cases, the translational or rotational motion may involve the subject pulling his or her trail rearfoot backwards against the ground surface for additional leverage as the subject executes a golf swing.

In some cases, the first outsole zone may comprise a first material, and the second outsole zone may comprise a second material. In some cases, the first material may comprise a TPE material (e.g., Pebax), and the second material may comprise a TPU material. In other cases, the first material may comprise a TPU material, and the second material may comprise a TPE material.

In some cases, the first outsole zone may comprise a first material, and the second outsole zone may comprise a second material. In some cases, the first material and/or the second material may comprise a TPU material. For example, in some cases, the first material may comprise a first TPU material and the second material may comprise a second TPU material.

In some cases, the first TPU material and the second TPU material may comprise different TPU materials or TPU materials with different compositions or material properties. In some cases, the first TPU material may be harder than the second TPU material, or the second TPU material may be softer than the first TPU material. In other cases, the first TPU material may be softer than the second TPU material, or the second TPU material may be harder than the first TPU material.

In some cases, the outsole may comprise a first outsole zone extending along a medial side of the outsole. In some cases, the first outsole zone may comprise a first material (e.g., a first TPU material). In some cases, the outsole may comprise a second outsole zone extending along a lateral side of the outsole. In some cases, the second outsole zone may comprise a second material (e.g., a second TPU material).

In some cases, the first TPU material may comprise a softer TPU material that can provide the first outsole zone with greater off course grip or traction performance, thereby enhancing the overall versatility and wearability of the shoe. In some cases, the second TPU material may comprise a harder TPU material that can enhance the rigidity and/or the durability of the second outsole zone so that the traction elements in the second outsole zone can (i) effectively manage the ground reaction forces generated during a golf swing and (ii) consistently provide on course grip or traction in one or more specific directions or in multiple different directions, without wearing down over time.

In some alternative cases, the first TPU material may comprise a harder TPU material that can enhance the rigidity and/or the durability of the first outsole zone so that the traction elements in the first outsole zone can (i) effectively manage the ground reaction forces generated during a golf swing and (ii) consistently provide on course grip or traction in one or more specific directions or in multiple different directions, without wearing down over time. In some optional cases, the second TPU material may comprise a softer TPU material that can provide the second outsole zone with greater off course grip or traction performance, thereby enhancing the overall versatility and wearability of the shoe.

In some cases, the first outsole zone may be integrated with the second outsole zone by way of a co-molding process or an over-injection process. In some cases, the first material may be over-injected onto the second material, or the second material may be over-injected onto the first material, to form an integrated sub-assembly. In some cases, the first material may be provided within a mold, and the second material may be injected into the same mold to form the integrated sub-assembly. In other cases, the second material may be provided within a mold, and the first material may be injected into the same mold to form the integrated sub-assembly.

In some cases, the integrated sub-assembly may further enhance the torsional characteristics of the outsole. For example, in some cases, the integrated sub-assembly may be implemented to control or modulate the torsional stiffness and/or the torsional rigidity of the shoe. In some cases, the integrated sub-assembly may be configured to increase the torsional stiffness and/or the torsional rigidity of the shoe to a greater degree or by a greater amount compared to other outsole configurations lacking such an integrated sub-assembly. In some cases, the integrated sub-assembly may yield an outsole that is stiffer in torsion than other outsoles with, for example, a split outsole configuration. In some cases, the integrated sub-assembly may yield an outsole that is better suited for tour players who need or prefer shoes that are more supportive and/or more stiff or rigid in torsion.

In some cases, the integrated sub-assembly may be a solid X-shaped part. In some cases, the X-shaped part may comprise a first S-shaped component formed of a first material and a second S-shaped component formed of a second material. In some cases, the first S-shaped component may have a size and/or a shape corresponding to the size and/or shape of the first outsole zone, and the second S-shaped component may have a size and/or a shape corresponding to the size and/or shape of the second outsole zone. In some cases, the first S-shaped component and the second S-shaped component may be combined or joined together to form the X-shaped part.

In some cases, the third outsole zone may comprise a third material, and the fourth outsole zone may comprise a fourth material. In some cases, the third material and/or the fourth material may be different than the first material and/or the second material. In some cases, the third material and the fourth material may comprise a same material or a same type of material. In other cases, the third material and the fourth material may comprise different materials. In some cases, the third material and/or the fourth material may comprise a rubber material.

In some cases, the third outsole zone and/or the fourth outsole zone may be integrally formed with the first outsole zone and/or the second outsole zone. In other cases, the third outsole zone and/or the fourth outsole zone may not or need not be integrally formed with the first outsole zone and/or the second outsole zone.

In some cases, the third outsole zone and/or the fourth outsole zone may be detached, decoupled, or otherwise physically separated from the first outsole zone and/or the second outsole zone. In some cases, the third outsole zone and/or the fourth outsole zone may not or need not be part of the same integrated sub-assembly as the first and second outsole zones. In some cases, the third outsole zone and/or the fourth outsole zone may be separated from the first and/or second outsole zones by one or more gaps or break zones.

Figure 26C:
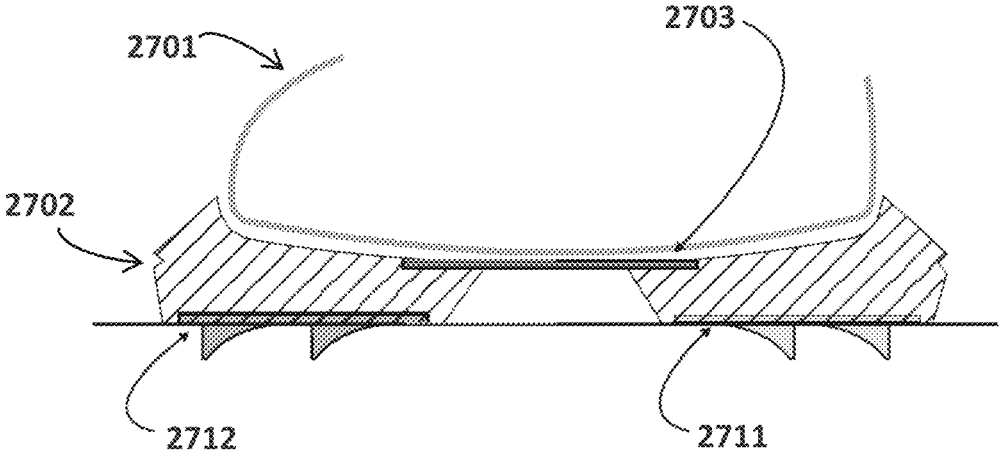
FIGS. 26C and 26D schematically illustrate different cross-sections of a shoe comprising the multi-piece outsole shown in FIGS. 26A and 26B.

FIG. 26C schematically illustrates a cross-sectional view of the forefoot region of a shoe with the outsole configuration(s) shown in FIGS. 26A and 26B. In some cases, the shoe may comprise an upper 2701 and a sole assembly 2702 connected to the upper. In some cases, the shoe may comprise a support structure 2703 as described elsewhere herein. In some cases, the sole assembly 2702 of the shoe may include an outsole with a plurality of outsole zones. In some cases, the plurality of outsole zones may comprise a plurality of different materials. In some cases, the plurality of outsole zones may include a first outsole zone comprising a first set of traction elements 2711 formed of a first material. In some cases, the plurality of outsole zones may include a second outsole zone comprising a second set of traction elements 2712 formed of a second material. In some cases, the first material and the second material may comprise different materials or different types of materials. In some cases, the first outsole zone may be configured to extend along a medial or lateral forefoot region of the shoe. In some cases, the second outsole zone may be configured to extend along a lateral or medial forefoot region of the shoe.

Figure 26D:
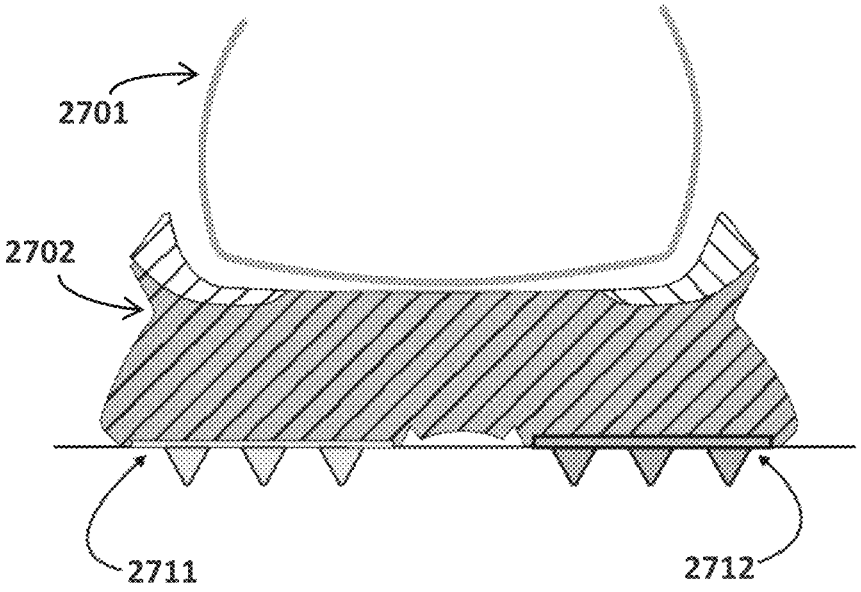

FIG. 26D schematically illustrates a cross-sectional view of the rearfoot region of a shoe with the outsole configuration(s) shown in FIGS. 26A and 26B. In some cases, the shoe may comprise an upper 2701 and a sole assembly 2702 connected to the upper. In some cases, the sole assembly 2702 of the shoe may include an outsole with a plurality of outsole zones. In some cases, the plurality of outsole zones may comprise a plurality of different materials. In some cases, the plurality of outsole zones may include a first outsole zone comprising a first set of traction elements 2711 formed of a first material. In some cases, the plurality of outsole zones may include a second outsole zone comprising a second set of traction elements 2712 formed of a second material. In some cases, the first material and the second material may comprise different materials or different types of materials. In some cases, the first outsole zone may be configured to extend along a lateral or medial rearfoot region of the shoe. In some cases, the second outsole zone may be configured to extend along a medial or lateral rearfoot region of the shoe.

Support Structures

Figure 27A:
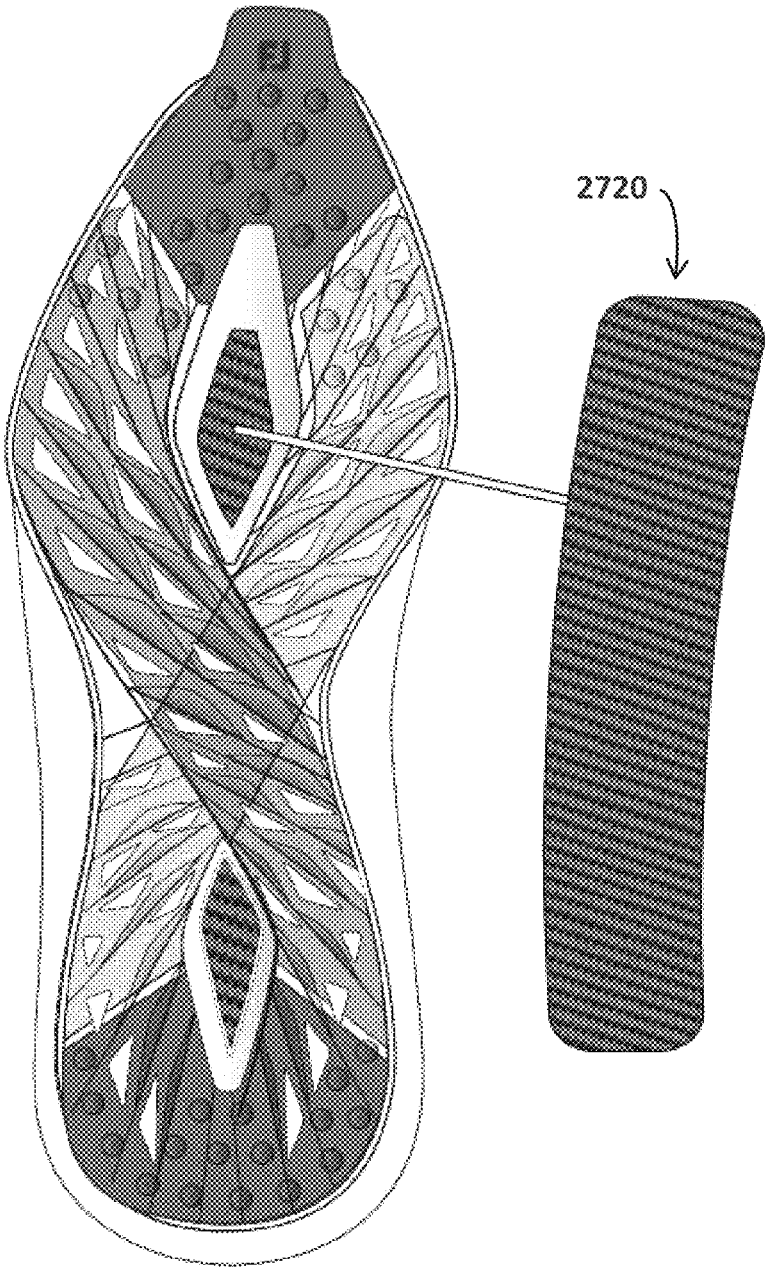
FIGS. 27A and 27B schematically illustrate different examples of support structures that can be integrated with any of the outsoles described herein.
Figure 27B:
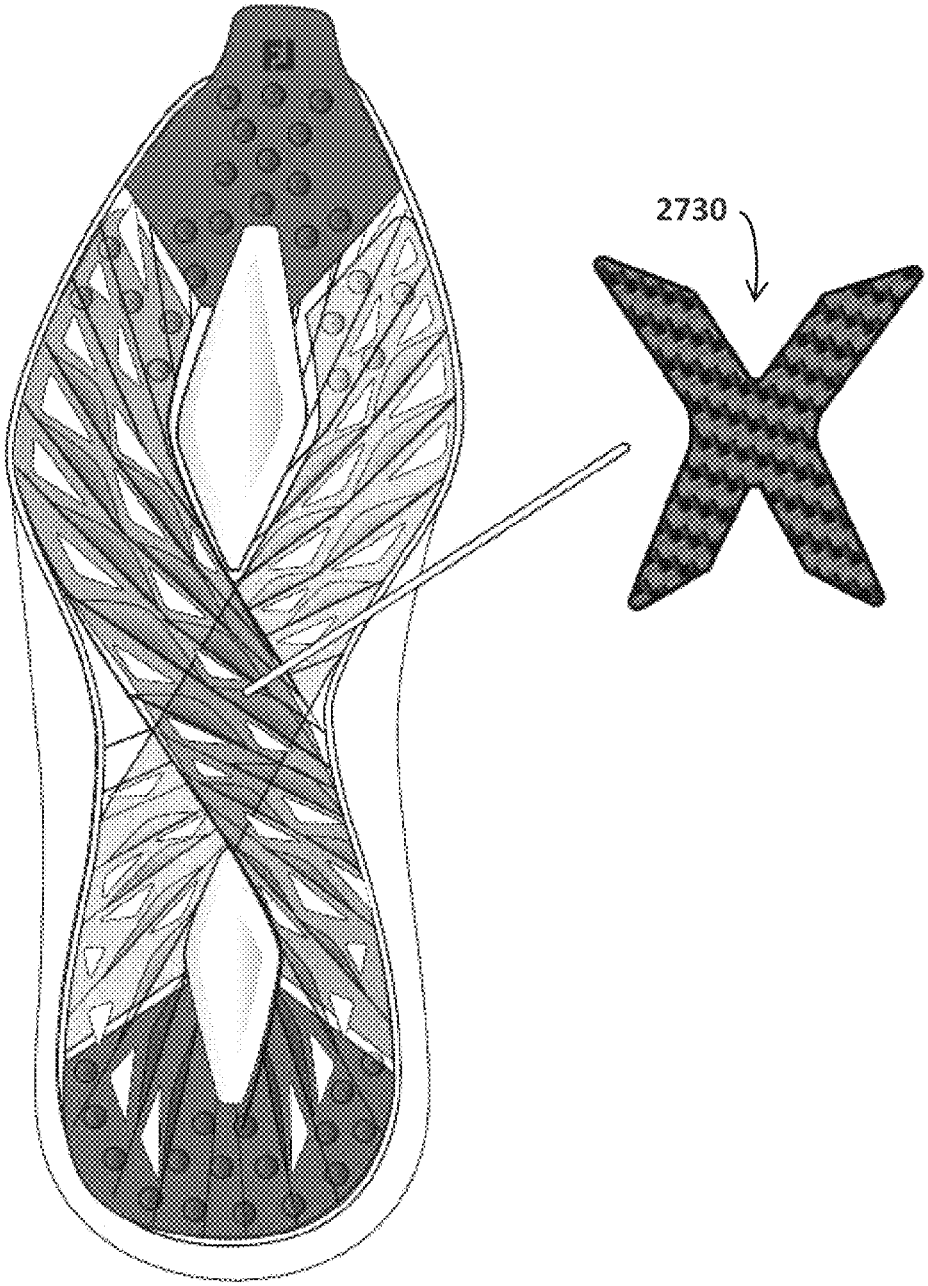

In some embodiments, the shoes of the present disclosure may incorporate or utilize a support structure as described elsewhere herein. In some cases (e.g., as shown in FIG. 27A), the support structure may comprise a carbon strip 2720 positioned between the midsole and the outsole of the shoe. In some cases, a portion of the carbon strip 2720 may be exposed or visible through the central forefoot region and/or the central rearfoot region of the outsole. In other cases (e.g., as shown in FIG. 27B), the support structure may comprise an X-shaped member 2730 that is positioned in or near the midfoot region of the shoe. In some cases, the X-shaped member may not or need not be exposed or visible through the central forefoot region and/or the central rearfoot region of the outsole. In some cases, the X-shaped member may be configured as a frame or chassis with one or more side portions that can be folded upwards and positioned along a medial side and/or a lateral side of the sole assembly or the upper to support the medial and/or lateral sides of the shoe.

Truncated Cones

In some embodiments, the shoes described herein may comprise a plurality of directional traction elements with a truncated cone shape. In some cases, the truncated cone shape may include one or more sidewalls that can engage with the ground surface under the golf shoe. In some cases, the directional traction elements with the truncated cone shape may be distributed across different outsole zones according to an orientation of the sidewalls of the traction elements.

Figure 28A:
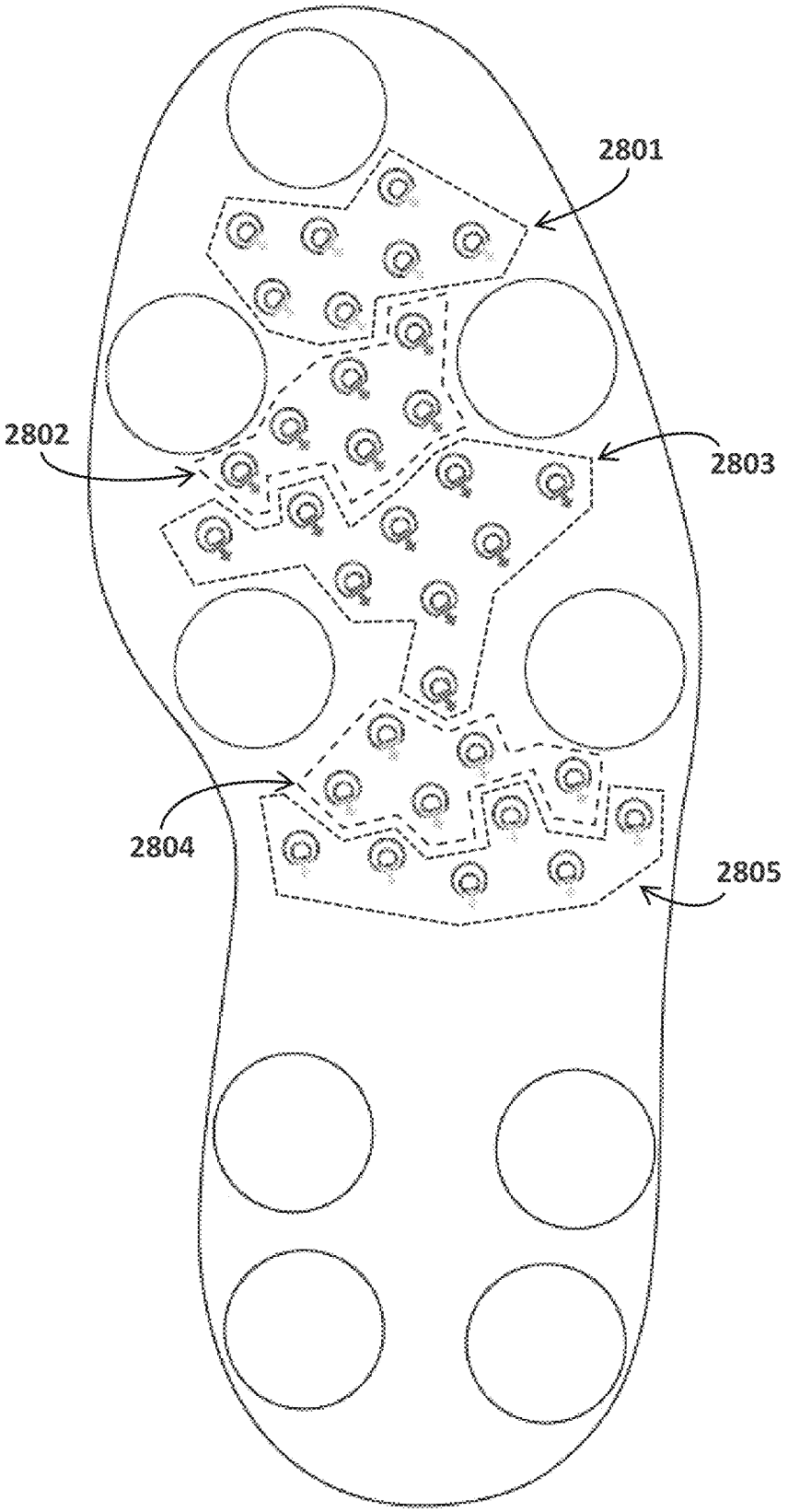
FIG. 28A schematically illustrates an example of an outsole with directional traction elements arranged in different outsole zones according to an angular orientation of the sidewalls of the traction elements, in accordance with some embodiments.

As shown in FIGS. 28A, in some cases, the plurality of directional traction elements may include a first set of directional traction elements 2801 with sidewalls oriented in a first direction and a second set of directional traction elements 2802 with sidewalls oriented in a second direction that is different than the first direction. In some cases, the first set of directional traction elements and the second set of directional traction elements may be arranged in different portions or sections of the outsole.

In some non-limiting embodiments, the plurality of directional traction elements may optionally include a third set of directional traction elements 2803 with sidewalls oriented in a third direction. In some cases, the third direction may be different than the first direction and/or the second direction. In some cases, the third set of directional traction elements may be arranged in a different portion or section of the outsole than the first and/or second set(s) of directional traction elements.

In some non-limiting embodiments, the plurality of directional traction elements may optionally include a fourth set of directional traction elements 2804 with sidewalls oriented in a fourth direction. In some cases, the fourth direction may be different than the first direction, the second direction, and/or the third direction. In some cases, the fourth set of directional traction elements may be arranged in a different portion or section of the outsole than the first, second, and/or third set(s) of directional traction elements.

In some non-limiting embodiments, the plurality of directional traction elements may optionally include a fifth set of directional traction elements 2805 with sidewalls oriented in a fifth direction. In some cases, the fifth direction may be different than the first direction, the second direction, the third direction, and/or the fourth direction. In some cases, the fifth set of directional traction elements may be arranged in a different portion or section of the outsole than the first, second, third, and/or fourth set(s) of directional traction elements.

Figure 28B:
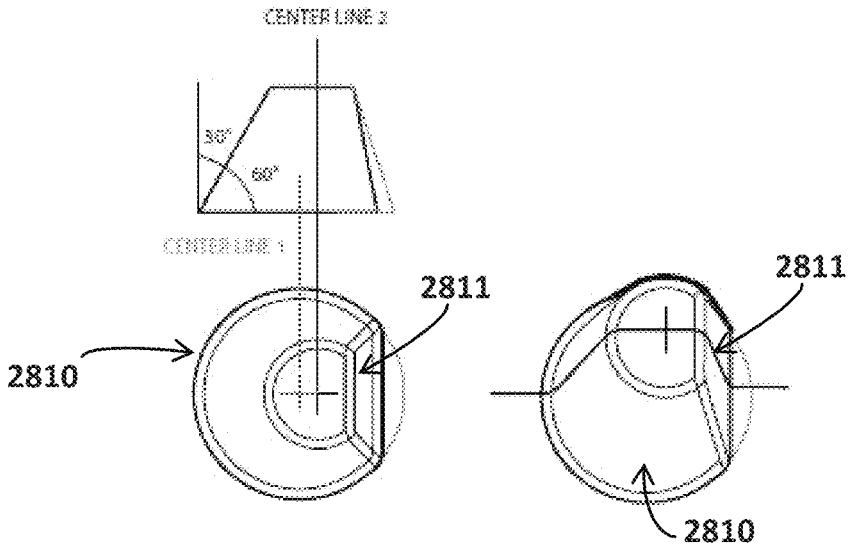
FIGS. 28B and 28C schematically illustrate various non-limiting examples of directional traction elements that can be arranged across any of the outsoles described herein.
Figure 28C:
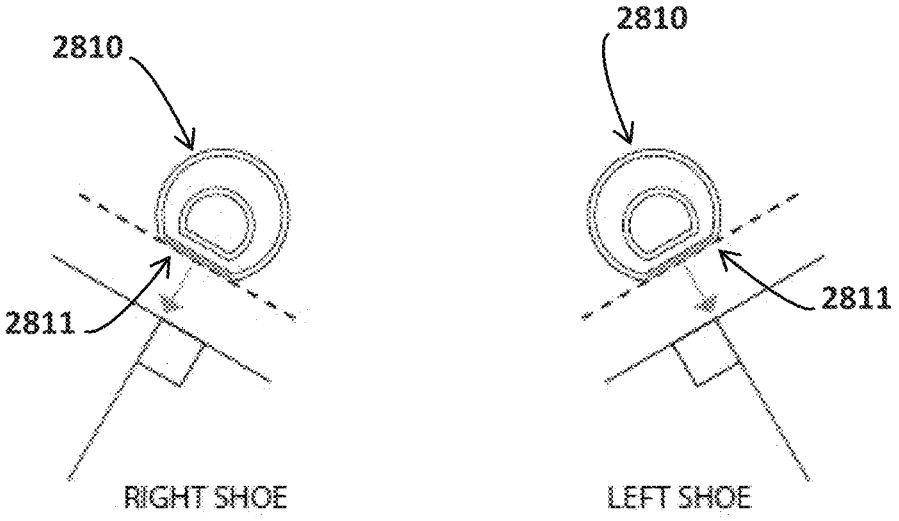

FIGS. 28B and 28C schematically illustrate various examples of directional traction elements with a truncated cone shape. In some cases, the plurality of directional traction elements may comprise one or more cones 2810. In some cases, the one or more cones 2810 may have a truncated sidewall 2811. In some cases, the truncated sidewall 2811 may be a vertical or substantially vertical sidewall extending between the base of the traction element and the distal end of the traction element. In other cases, the truncated sidewall 2811 may be an angled, sloped, or slanted sidewall extending between the base and the distal end of the traction element. In some cases, the truncated sidewalls of the traction elements may be strategically positioned so that the sidewalls are oriented perpendicular to the ground reaction force vectors that are generated during a golf-related action or movement.

Cobblestone

Figure 29A:
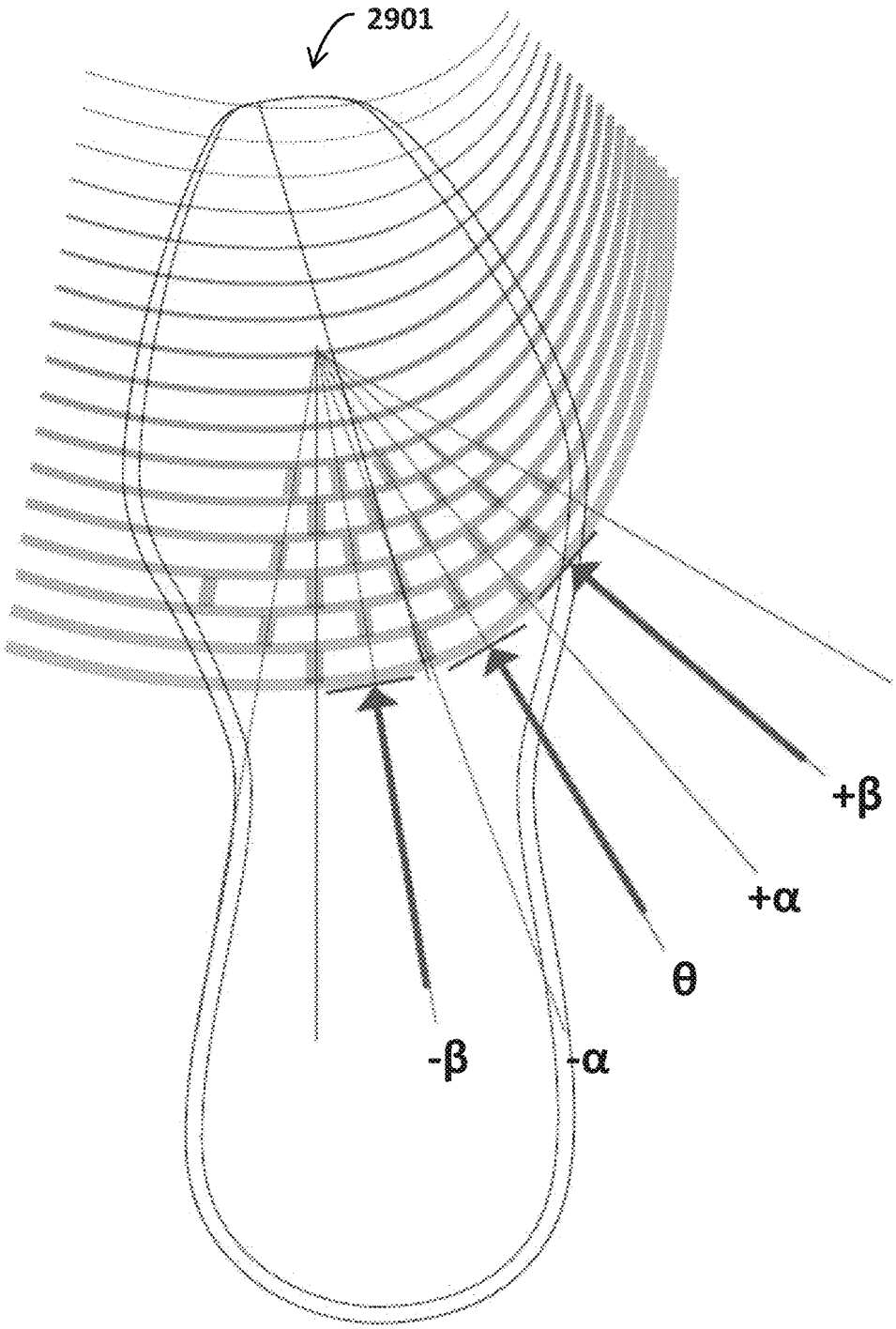
FIGS. 29A and 29B schematically illustrate various non-limiting examples of outsoles with a cobblestone configuration, in accordance with some embodiments.
Figure 29B:
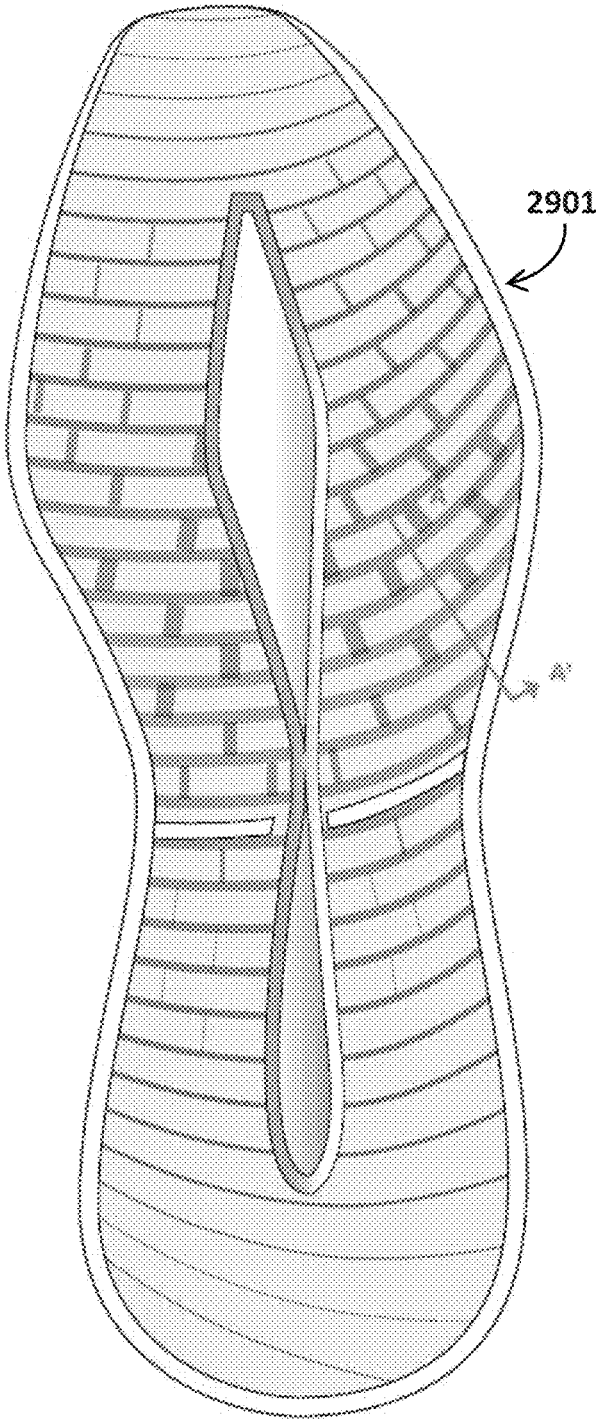

Referring now to FIGS. 29A and 29B, in some non-limiting embodiments, the shoes disclosed herein may include an outsole with a cobblestone configuration 2901. In some cases, the cobblestone configuration 2901 may comprise a plurality of directional traction elements arranged along a plurality of curved tracks extending across the outsole. In some cases, the plurality of directional traction elements may be arranged along or between adjacent tracks. In some cases, the directional traction elements may be staggered across adjacent tracks so that the gaps or spacings between the traction elements in one track are offset from the gaps or spacings between the traction elements in another adjacent track.

In some non-limiting embodiments, the plurality of curved tracks may extend across the outsole along a plurality of curved paths. In some cases, the plurality of curved paths may be parallel to each other. In other cases, the plurality of curved paths may not or need not be parallel to each other.

In some cases, the plurality of curved paths may have a same curvature. In other cases, the plurality of curved paths may have different curvatures. In some cases, the curvature of the curved paths may remain constant or uniform across the outsole. In other cases, the curvature of the curved paths may change or vary across the outsole.

In some cases, the plurality of curved paths may each have a radius of curvature corresponding to a radial distance between (i) a point along the curved paths and (ii) another point in space corresponding to a center of curvature of the curved paths. In some cases, the plurality of curved paths may have a same radius of curvature. In other cases, the plurality of curved paths may have different radii of curvature.

In some cases, the center of curvature for the curved paths may be located on the outsole. In other cases, the center of curvature for the curved paths may not or need not be located on the outsole. In some cases, the plurality of curved paths may have a plurality of different centers of curvature. In some cases, the plurality of different centers of curvature may be offset from each other. In some cases, the plurality of different centers of curvature may not or need not coincide with each other.

In some cases, the plurality of curved tracks may extend circumferentially around a single or common point of origin at different radial distances from the single or common point of origin. In some cases, the single or common point of origin may correspond to or coincide with a center of pressure of the shoe. In some cases, the center of pressure of the shoe may be located at or near the single or common point of origin at one or more critical stages of a golf swing. In some cases, the one or more critical stages may be associated with a down swing of the golf club and the corresponding biomechanical actions or movements to execute the down swing in order to strike a golf ball. In some cases, the biomechanical actions or movements may involve a shifting of the center of pressure to the forefoot region so that the subject can pivot and/or push off of his or her forefoot. In the embodiments described herein, the plurality of directional traction elements may be disposed around a single or common point of origin that is strategically selected and positioned to coincide with the part of the shoe that the center of pressure shifts to when the subject pivots and/or pushes off his or her foot. In some cases, the strategic positioning of the directional traction elements around this point of origin may help to provide traction in situations where slip potential may be higher.

Sidewall Orientation

In some cases, the plurality of directional traction elements may include a series of directional traction elements extending along the curved tracks provided across the outsole. In some cases, the orientations of the sidewalls of the traction elements in the series of directional traction elements may progressively change or vary along a length of the curved tracks. In some cases, adjacent traction elements in the series of directional traction elements may have different sidewall orientations to manage different ground reaction force vectors oriented in different directions.

In some cases, the series of directional traction elements may include a first directional traction element with a sidewall disposed at an angle θ relative to a lateral axis extending horizontally across the outsole. In some cases, the series of directional traction elements may include a second directional traction element that is adjacent to the first directional traction element. In some cases, the second directional traction element may have a sidewall that is disposed at another angle θ±α relative to the lateral (horizontal) axis. In some cases, the series of directional traction elements may further include a third directional traction element that is adjacent to the second directional traction element. In some cases, the third directional traction element may have a sidewall that is disposed at another angle θ±β relative to the lateral (horizontal) axis.

In some cases, the angle θ may range from about 50 degrees to about 75 degrees relative to the lateral (horizontal) axis of the shoe. In some cases, the angle θ may range from about 55 degrees to about 70 degrees relative to the lateral (horizontal) axis of the shoe. In some cases, the angle θ may range from about 60 degrees to about 65 degrees relative to the lateral (horizontal) axis of the shoe. In some cases, the angle θ may be about 60 degrees, 61 degrees, 62 degrees, 63 degrees, 64 degrees, or 65 degrees relative to the lateral (horizontal) axis of the shoe.

In some cases, the angle α may be about 5 degrees, about 10 degrees, about 15 degrees, about 20 degrees, or more. In some cases, the angle β may be about 10 degrees, about 15 degrees, about 20 degrees, about 25 degrees, or more.

Herringbone/Fin-Shaped Traction Elements

Figure 30A:
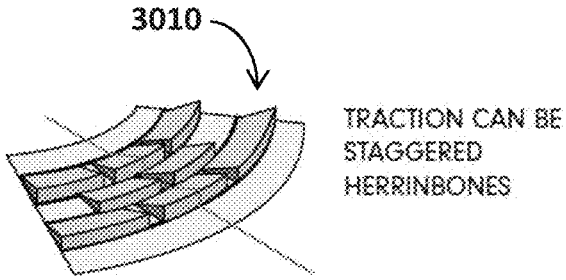
FIGS. 30A and 30B schematically illustrate different non-limiting examples of directional traction elements that can be arranged in a cobblestone configuration.

As shown in FIG. 30A, in some embodiments, the directional traction elements arranged in the cobblestone configuration may include a plurality of herringbone traction elements 3010. In some cases, the plurality of herringbone traction elements 3010 may be staggered relative to each other in a non-channeling and non-trenching configuration.

Figure 30B:
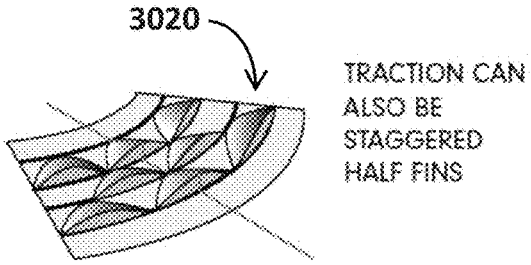

In other embodiments (e.g., as shown in FIG. 30B), the directional traction elements arranged in the cobblestone configuration may include a plurality of fin-shaped or half fin-shaped traction elements 3020. In some cases, the fin-shaped or half fin-shaped traction elements may be staggered relative to each other in a non-channeling and non-trenching configuration.

Variations in Height

In some cases, the height of the directional traction elements may change or vary along a portion or a section of the outsole. In some cases, the height of the directional traction elements may change or vary between a first portion or section of the outsole and a second portion or section of the outsole. In some cases, the first portion or section of the outsole may be in a forefoot region and/or a midfoot region of the outsole. In some cases, the second portion or section of the outsole may be in the midfoot region and/or the rearfoot region of the outsole. In some cases, the distance or spacing between the first and second portions or sections of the outsole may span two or more curved tracks.

In some cases, the height of the directional traction elements may change or vary based on a proximity of the directional traction elements to the first and/or section portions or sections of the outsole. In some cases, the height of the directional traction elements may change or vary based on a distance between the traction elements and the first portion or section of the outsole, or based on a distance between the traction elements and the second portion or section of the outsole. In some cases, the height of the directional traction elements may progressively or successively increase from the first portion or section of the outsole towards the second portion or section of the outsole. In some cases, the directional traction elements that are positioned closer towards the second portion or section of the outsole may have a greater height than the directional traction elements that are positioned closer towards the first portion or section of the outsole.

In some cases, the height of the directional traction elements may change or vary based on the particular track along which the traction elements are provided or disposed. In some cases, directional traction elements positioned along a track that is closer towards the second portion or section of the outsole may have a greater height than the directional traction elements that are positioned along another track that is closer towards the first portion or section of the outsole. In some cases, the height of the directional traction elements may change or vary from track to track to provide different levels of traction in different portions or sections of the outsole.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right", "left", "center", "middle", "proximal", "distal", "anterior", "posterior", "forefoot", "midfoot", and "rearfoot", and the like are relative terms used to refer to one position of an element based on one perspective and should not be construed as limiting the scope of the technology.

All patents, publications, test procedures, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe, comprising:

an upper;

a sole assembly attached to the upper, the sole assembly comprising a midsole and an outsole; and a plurality of traction elements positioned around a central forefoot region and a central rearfoot region of the outsole, wherein the plurality of traction elements comprises:

(i) a first set of traction elements arranged in a first outsole zone along a perimeter or edge of a medial or lateral forefoot region of the golf shoe, (ii) a second set of traction elements arranged in a second outsole zone along a perimeter or edge of a lateral or medial rearfoot region of the golf shoe, and (iii) a third set of traction elements arranged along a third outsole zone extending diagonally across a midfoot region of the golf shoe between the medial or lateral forefoot region of the golf shoe and the lateral or medial rearfoot region of the golf shoe, wherein the third outsole zone includes a plurality of tracks extending across the third outsole zone in a plurality of different directions, wherein the third set of traction elements includes a first set of directionally aligned traction elements with sidewalls oriented in a same direction and a second set of directionally aligned traction elements with sidewalls oriented in a different direction than the sidewalls of the first set of directionally aligned traction elements, wherein the first set of directionally aligned traction elements comprises a first traction element arranged along a first track and wherein the second set of directionally aligned traction elements comprises a second traction element arranged proximal to the first traction element along a second track directly adjacent to the first track, wherein the first traction element and the second traction element have different sidewall orientations.

2. The golf shoe of claim 1, wherein the third outsole zone is configured to extend between the first set of traction elements and the second set of traction elements.

3. The golf shoe of claim 1, wherein the third outsole zone is configured to extend around or along the central forefoot region and the central rearfoot region of the outsole.

4. The golf shoe of claim 1, wherein the central forefoot region or the central rearfoot region is longitudinally flexible.

5. The golf shoe of claim 1, wherein the third outsole zone is configured to extend from the medial or lateral forefoot region to a toe region or a forefoot/anterior end of the outsole.

6. The golf shoe of claim 1, wherein the third outsole zone is configured to extend from the lateral or medial rearfoot region to a heel region or a rearfoot/posterior end of the outsole.

7. The golf shoe of claim 1, wherein the third outsole zone is separated from the first outsole zone and the second outsole zone.

8. The golf shoe of claim 1, wherein the third outsole zone comprises a plurality of apertures or windows formed across the third outsole zone to reduce a weight of the outsole and to enhance a flexibility of the outsole.

9. The golf shoe of claim 1, wherein each of the first set of directionally aligned traction elements and the second set of directionally aligned traction elements includes a series of traction elements positioned or arranged along a same track.

10. The golf shoe of claim 9, wherein the traction elements in the series of traction elements have a same size or a same shape.

11. The golf shoe of claim 9, wherein the traction elements in the series of traction elements have different sizes or different shapes.

12. The golf shoe of claim 1, wherein the sidewalls of the first set of directionally aligned traction elements are oriented in a first direction to enhance traction in said first direction, and wherein the sidewalls of the second set of directionally aligned traction elements are oriented in a second direction to enhance traction in said second direction, wherein said second direction is angularly offset from said first direction.

13. The golf shoe of claim 1, wherein the first set of directionally aligned traction elements is arranged along the first track, and wherein the second set of directionally aligned traction elements is arranged along the second track.

14. The golf shoe of claim 1, wherein the third set of traction elements includes a plurality of directional traction elements with sidewalls that progressively change in orientation across the plurality of tracks.

15. The golf shoe of claim 14, wherein the directional traction elements are arranged along different tracks according to an orientation of the sidewalls of the directional traction elements.

16. The golf shoe of claim 1, wherein the first, second, or third set of traction elements comprises one or more adaptive traction elements.

17. The golf shoe of claim 1, wherein the first track and the second track have different angular orientations.

18. The golf shoe of claim 1, wherein the traction elements in the third set of traction elements and the traction elements in the first or second set of traction elements comprise different types of traction elements.

19. The golf shoe of claim 1, wherein the sidewalls of the traction elements in the first set of traction elements or the second set of traction elements are oriented perpendicular to a bottom surface of the outsole.

20. The golf shoe of claim 1, wherein the sidewalls of the traction elements in the third set of traction elements are oriented perpendicular to a bottom surface of the outsole.

* * * * *